US012077886B2

(12) United States Patent
McCord et al.

(10) Patent No.: US 12,077,886 B2
(45) Date of Patent: Sep. 3, 2024

(54) INSECT BARRIER TEXTILE LINER SYSTEM

(71) Applicant: North Carolina State University, Raleigh, NC (US)

(72) Inventors: Marian G. McCord, Raleigh, NC (US); Richard Michael Roe, Raleigh, NC (US); Charles S. Apperson, Raleigh, NC (US); Andre J. West, Raleigh, NC (US); Emiel A. DenHartog, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 983 days.

(21) Appl. No.: 16/368,494

(22) Filed: Mar. 28, 2019

(65) Prior Publication Data

US 2020/0048801 A1 Feb. 13, 2020

Related U.S. Application Data

(60) Provisional application No. 62/649,007, filed on Mar. 28, 2018.

(51) Int. Cl.

| | |
|---|---|
| ***D04B 1/10*** | (2006.01) |
| ***D04B 1/16*** | (2006.01) |
| ***D04B 1/24*** | (2006.01) |

(52) U.S. Cl.

CPC ..... *D04B 1/102* (2013.01); *D04B 1/16* (2013.01); *D04B 1/24* (2013.01); *D10B 2331/02* (2013.01); *D10B 2331/10* (2013.01); *D10B 2501/04* (2013.01)

(58) Field of Classification Search

CPC ... D04B 1/22; D04B 1/24; D04B 1/10; D04B 1/102; D04B 1/104; D04B 7/28; D04B 9/38; A41D 13/001; A41B 17/00; A41B 9/08; A41B 9/12; D10B 2403/0213; D10B 2501/04

See application file for complete search history.

(56) References Cited

U.S. PATENT DOCUMENTS

| | | | | | |
|---|---|---|---|---|---|
| 2,344,811 | A | * | 3/1944 | Gill | A42B 1/0187 2/457 |
| 3,191,185 | A | * | 6/1965 | Martin | A41D 1/06 411/965 |
| 3,783,451 | A | * | 1/1974 | Malin | A41D 27/28 2/DIG. 1 |
| 4,395,781 | A | * | 8/1983 | Myers | A01K 55/00 2/84 |
| 4,422,184 | A | * | 12/1983 | Myers | A01K 55/00 2/84 |

(Continued)

FOREIGN PATENT DOCUMENTS

| | | | | |
|---|---|---|---|---|
| CN | 103653380 A | * | 3/2014 | |
| CN | 102883611 B | * | 1/2015 | A01N 25/34 |

(Continued)

*Primary Examiner* — Danny Worrell
(74) *Attorney, Agent, or Firm* — THOMAS | HORSTEMEYER, LLP

(57) ABSTRACT

Mosquito resistant textiles and garments are provided that demonstrate resistance to mosquito bites without the use of pesticides or chemicals. The textiles and garments provide 90% or more resistance to mosquito bite resistance.

18 Claims, 47 Drawing Sheets

(56) References Cited

U.S. PATENT DOCUMENTS 4,685,152 A * 8/1987 Heare ..... A41D 13/001 2/84
4,716,594 A * 1/1988 Shannon ..... A41D 31/04 2/DIG. 1
4,985,933 A * 1/1991 Lemoine ..... A41D 13/001 2/84
5,214,797 A * 6/1993 Tisdale ..... A41D 13/001 2/84
5,249,307 A * 10/1993 Lemoine ..... A41D 13/02 2/84
5,341,511 A * 8/1994 Wells ..... A41D 13/001 2/243.1
5,343,564 A * 9/1994 Reynolds ..... A41D 13/001 2/70
5,357,635 A * 10/1994 Lemoine ..... A41D 13/001 2/84
5,600,850 A * 2/1997 Shannon ..... A41D 13/001 2/69
5,713,076 A * 2/1998 Davis ..... A42B 1/0182 2/202
5,717,990 A * 2/1998 Alquist ..... A42B 1/046 2/202
5,794,263 A * 8/1998 Carman ..... A41D 13/001 2/202
11,582,968 B2 * 2/2023 West ..... A01N 31/02
2002/0124293 A1 * 9/2002 Zeiler ..... A41D 13/001 2/4
2005/0278837 A1 * 12/2005 Wallerstein ..... A41D 13/001 2/456
2006/0048258 A1 * 3/2006 Seo ..... A41D 13/001 2/4
2012/0005812 A1 * 1/2012 Corzatt ..... A41D 13/001 2/456
2013/0232676 A1 * 9/2013 Corzatt ..... A41D 13/001 2/455
2014/0041285 A1 * 2/2014 Russell ..... D04B 21/04 43/132.1
2017/0118926 A1 * 5/2017 Toye ..... A01G 13/043
2017/0143051 A1 * 5/2017 Patton ..... B32B 5/12
2019/0021409 A1 * 1/2019 West ..... A41B 9/12
2019/0230920 A1 * 8/2019 West ..... D06M 13/144
2020/0048801 A1 * 2/2020 McCord ..... D04B 1/24
2020/0297047 A1 * 9/2020 West ..... A41B 9/12
2021/0092910 A1 * 4/2021 Toye ..... A01G 13/0206

FOREIGN PATENT DOCUMENTS

JP 2000303354 A * 10/2000
KR 20050058378 A * 6/2005
KR 102210832 B1 * 2/2021
WO WO-2012095533 A1 * 7/2012 ..... A01K 13/006
WO WO-2023015252 A2 * 2/2023

* cited by examiner

INSECT BARRIER TEXTILE LINER SYSTEM

CROSS-REFERENCE TO RELATED APPLICATIONS

This application claims the benefit of and priority to U.S. Provisional Application Ser. No. 62/649,007, having the title "INSECT BARRIER TEXTILE LINER SYSTEM", filed on Mar. 28, 2018, the disclosure of which is incorporated herein by reference in its entirety.

STATEMENT REGARDING FEDERALLY SPONSORED RESEARCH OR DEVELOPMENT

This invention was made with government support under grant number W911QY-16-1-0001 awarded by the U.S. Army Natick Soldier Systems Center. The government has certain rights in this invention.

TECHNICAL FIELD

The present disclosure generally relates to textiles and uses thereof.

BACKGROUND

Infectious diseases transmitted by insects and other animal vectors have long been associated with significant human illness and death; for example, malaria, dengue fever, yellow fever, and plague cause a significant fraction of the global infectious disease burden. These diseases profoundly restrict socioeconomic status and development in countries with the highest rates of infection, many of which are located in the tropics and subtropics. Progress against these diseases followed the early 20th century discovery that mosquitoes transmitted diseases such as malaria, yellow fever, and dengue, leading to environmental control of mosquito breeding areas as well as to widespread application of pesticides. However, these tools, although initially very successful soon displayed inherent weaknesses. Vector control programs were limited in effectiveness due to the development of insecticide resistance, and other environmental controls raised significant concerns regarding unintended damage to the environment.

Today, vector-borne diseases remain a worldwide concern and a significant cause of human morbidity and mortality, as FIG. 4 illustrates. The World Health Organization has declared the Zika virus and associated health threats an international public health emergency. The virus, spread primarily through mosquito bites, is linked to serious birth defects in babies of mothers who were infected while pregnant. First detected in the Americas last spring, Zika has now spread to 33 countries in the region.

Vector-borne diseases have had a devastating impact on the readiness of combat troops. Because of their increased exposure through training and operations out of doors, deployed military personnel are often at greater risk of receiving arthropod bites than endemic populations. Although prevention and treatment is vastly improved from earlier times, vector-borne diseases remain a significant threat in military and humanitarian operations today, resulting in reductions in manpower, lost duty days, and decreased combat effectiveness.

Presently, the military uses chemical treatments to prevent exposure to vector-borne diseases. The Arthropod Repellent System (ARS) is the current standard of protection required by the Department of Defense. The ARS consists of 1) a permethrin-treated uniform, 2) the repellent DEET applied to exposed skin, and 3) proper wearing of the military uniform. Research shows that the most popular insect repellent DEET applied as a single dose to primary human liver cells is a potential endocrine disruptor in women. Also, the only bite proof clothing available for protection from mosquitoes use chemical insecticides and/or are not effective. Exposure to chemical pesticides is undesirable to large segments of the population, especially pregnant women and children; therefore, these individuals may be choosing to risk infection in order to limit their potential exposure to insecticides. Additionally, the growing mosquito resistance to insecticides, especially those used in clothing, reduces their effectiveness, placing the wearers unknowingly at risk. Non-chemical, bite-proof clothing offers an economical, sustainable and accessible solution to the problem. Furthermore, under operational conditions, these chemical measures often result in incomplete protection. Mosquito resistance to existing insecticidal chemistries is problematic in some areas of military operations, and there are no alternatives and equally-effective chemical treatments for clothing that can replace pyrethroid-based applications. In addition, chemically-treated clothing declines in effectiveness as there is a loss of permethrin content with normal usage as well as laundering. More importantly, military personnel are concerned that exposure to chemical treatments has adverse effects on their health or that of their family members. As a result, compliance in the use of required protective measures, especially use of insecticides and repellents, is often low among military personnel deployed in theatres of operation. Therefore, there is an urgent need to improve the current insecticide-based protection system and to develop an alternative effective bite-proof system that reduces the insecticide dose and human exposure to chemical treatments and that could also be transferrable to the private sector.

Insecticidal-treated textile materials (e.g. bed nets) have been shown to be an effective mechanism of vector control by killing mosquitoes via chemical transfer from the material. These chemically-treated textiles are also effective as insect repellents. However, most of these chemistries have undesirable effects/consequences, and new substantial challenges are arising. Among the most serious challenges is the rapidly developing biological resistance to existing insecticidal and drug chemistries. Furthermore, significant risks to humans exist from exposure to pesticides during storage and transport, material treatment, and use (exposure to vapors or dermal or oral contact). Insecticidal treatment of materials also poses risks to the environment from accidental spillage of pesticides during storage and transport, from improper disposal, and from the washing of nets in natural bodies of water.

Conventional, non-chemical, vector protective textiles using existing technologies require either a nearly continuous or monolithic barrier that traps heat and moisture within the garment or is thick, bulky and inflexible and impractical for hot climates. There is an urgent, unmet need for chemical-free garments that provide safe protection from mosquito biting while providing outstanding comfort. There remains a need for improved textiles capable of preventing mosquito bites, e.g. without the need for chemical treatments, while still maintaining comfort and strength.

SUMMARY

Textiles are provided that demonstrate resistance to mosquito bites without the use of pesticides or chemicals.

Conventional textiles with their respective protective mechanisms cannot meet all of these criteria. Hence, a combination of these mechanisms and respective textiles must be found in order to develop comfortable, insect resistant textiles. Various textile fabric systems are provided that can meet the above criteria.

The textiles encompass a new generation of non-toxic, environmentally safe, and effective protective textile materials that do not rely solely on the actions of insecticidal chemistries, as well as a mechanism for the design of those materials. The materials described herein are effective via structural and physical attributes that have been engineered to prevent insect bites, or to trap and render the insect harmless without contaminating the environment or posing a potential human health risk. These alternative materials will mitigate the incidence of insecticide resistance in the vector population and provide an effective alternative to current chemically treated materials.

The design criteria for these insect resistant textiles are somewhat dependent on mosquito anatomy parameters, mainly proboscis diameter and length, and comfort parameters. Therefore, the textiles are provided with adequately sized pores that offer good air circulation but will hinder the insect from making direct contact with the skin. The textile can have particular characteristics so that it will function as a protective barrier. The thermal properties of the textile can be made to be appropriate for the climate in which it will be worn. Conventional textiles with their respective protective mechanisms cannot meet all of these criteria. Hence, a combination of these mechanisms and respective textiles are provided in order to develop comfortable, insect resistant textiles. The textiles provided herein can meet the above criteria.

Single layer fabrics, as described herein, are remarkably thin with microscopic pores to prevent proboscis penetration, but have ample pore area to provide exceptional heat and moisture vapor transport. New manufacturing technologies and much finer elastomeric yarns than were previously possible can now be combined to create sophisticated lightweight and flexible fabrics that are extremely comfortable and offer outstanding fit. In bench-top assays using a fabricated device for blood-feeding mosquitoes and arm-in-cage studies, these fabrics demonstrate remarkably high bite resistance.

Garments made from these fabrics can easily be constructed in such a way as to allow unhampered movement and high range of motion. Areas of the body that may be more attractive to a mosquito, e.g., ankles and behind the knees, as well as areas over which the fabric may deform, e.g., elbows, knees, and a pregnant women's abdomen can include extra protection. In some embodiments, this can be achieved with a double layer combination of fabrics or by further increasing the density of the material. In some aspects, the textiles provided are used as a liner in the garment, where the garment will further include an outer layer or outer material.

A predictive (mathematical) model for the structure of bite-proof textiles solely based on a physical barrier system is provided, and prototype fabrics were made and evaluated. Laboratory tests showed that these textile prototypes provided complete protection from mosquito bites with air/moisture vapor permeability superior to that of conventional physical barrier materials or even chemical treated uniforms. Based on these results, this unique textile structure has demonstrated enormous potential for mitigating the incidence of vector-borne diseases by preventing human-vector contact.

Various textiles for military clothing and equipment are provided having an impenetrable physical barrier to insect vectors, thus reducing the contagion and disability of military personnel due to vector-borne diseases. However, military personnel are only a subset of the worldwide human population at risk of vector-borne disease. For example, malaria is a devastating global health problem that affects millions worldwide, resulting in an enormous economic and public health burden, particularly in developing countries.

In various aspects, effective protective textiles are provided that protect against insect vectors. These alternative materials mitigate the development of insecticide resistance in the vector population, and provide an economical and effective alternative to current chemically-treated materials. Such materials represent a significant improvement to currently available protective systems to the U.S. military and also offer an additional option to the general population in the fight against vector-borne disease.

Textile structures are provided that demonstrate exceptional comfort while providing 99.9% protection from mosquito bites in arm-in-cage studies. In some aspects, three-dimensional (3-D) spacer fabrics that provide total bite resistance with no resistance to air or moisture transfer are provided. This type of fabric can be woven, weft or warp knitted (with almost zero waste) and has a "front" (away from the body) and a "back" (next to the body) side and a "pile" layer joining the two sides. Careful design of these fabrics yields a structure that is geometrically impenetrable by the mosquito. These fabrics, when optimized, provide maximal comfort and effectiveness by manipulating the fabric structure, yarn type and yarn diameter.

Textiles having a single layer are provided that are remarkably thin with microscopic pores that prevent proboscis penetration, but ample pore area to provide exceptional heat and moisture-vapor transport. New manufacturing technologies and much finer elastomeric yarns than were previously possible can now be combined to create sophisticated lightweight and flexible fabrics that are extremely comfortable and offer outstanding fit. In bench top assays and arm-in-cage studies, these fabrics demonstrate extremely high bite resistance.

Garments made from these fabrics are provided that allow unhampered movement and high range of motion. Areas of the body that may be more attractive to a mosquito, e.g., ankles and behind the knees, as well as areas over which the fabric may deform, e.g., elbows, knees, and a pregnant women's abdomen can include extra protection. This can be achieved with a double layer combination of fabrics or by further increasing the density of the material.

The garment construction takes advantage of new ultrasonic seaming technology, which seals seams by melting the fabric under pressure. There is no need for needle or thread, allowing garments to be constructed without any pierce points or weakness at edges. Garment seams and curves are easily created, giving more versatility and natural movement. Individual garment components may be interlocked, e.g., the top to the bottom, while easily separated from each other when in a safe environment.

In various aspects, a superfine knitted textile is provided capable of bite resistance of about 90%, about 95%, about 98%, about 99%, about 99.9%, or more or wherein the textile has a bite resistance of about 95% or greater when measured according to the in vivo feeding bioassay described herein. In some aspects, a superfine knitted textile is provided capable of bite resistance of about 90%, about 95%, about 98%, about 99%, about 99.9%, or more or wherein the textile has a bite resistance of about 95% or greater when measured according to the arm-in-cage test described herein. In some aspects, the textile includes a superfine blended yarn, for example a blend of a nylon and a polyurethane. The superfine, blended yarn can be knitted in a single jersey knit to form the superfine, knitted textile having a textile thickness of about 300 μm or less and a plurality of pores having an average pore size of about 27.5 μm or less. In some aspects, the superfine knitted textile has a thickness of about 80 μm or less, and the average pore size is less than about one-third of the thickness. In some aspects, the average pore size is smaller than the maximum pore size to provide mosquito bite resistance based upon the thickness of the textile.

The blended yarn can include filaments having a denier of about 15-25 or about 20. The superfine knitted textile can be further processed to decrease the pore size, e.g. by one or both of heat setting the superfine knitted textile and repeated washing of the superfine knitted textile without detergent.

In some aspects, a weft spacer knitted textile is provided. The weft spacer knitted textile can include a polyester yarn with a yarn counts selected from the group consisting of 70 D×2 ends, 70 D×3 ends, and 70 D×4 ends; a thickness of about 2.2 mm to 2.8 mm; and a plurality of pores having an average pore size of about 28 μm to about 200 μm. The weft spacer knitted textile can be further processed to decrease the pore size, e.g. by one or both of heat setting the weft spacer knitted textile and repeated washing of the weft spacer knitted textile without detergent. Yarn counts, as notated above, describe the denier of the yarns and the number of yarns per feed yarn (for example, 70 D×2 ends describes two 70 denier yarns in one feed yarn).

In various aspects, a spacer fabric textile is provided having a front layer and a back layer, and further having a pile layer joining the front layer and the back layer. The spacer fabric textile can have a plurality of pores having a minimum pore size, wherein the textile has a thickness that is greater than the minimum thickness to provide mosquito bite resistance based upon the minimum pore size.

In various aspects, a spacer fabric textile is provided having a front layer and a back layer, and further having a pile layer joining the front layer and the back layer. The spacer fabric textile can have a plurality of pores and a minimum thickness, wherein the pores have a pore size smaller than the maximum pore size to provide mosquito bite resistance based upon the minimum thickness of the textile.

In various aspects, the spacer fabric textile can have a thickness of about 2.0 mm to 2.2 mm and a pore size is about 0.1 mm to 0.6 mm, a thickness of about 2.2 mm to 2.4 mm and a pore size of about 0.4 mm to 0.7 mm, a thickness of about 2.4 mm to 2.5 mm and a pore size of about 0.7 mm to 0.9 mm, a thickness of about 2.5 mm to 2.6 mm and a pore size of about 0.8 mm to 1.1 mm, a thickness of about 2.6 mm to 2.7 mm and a pore size of about 0.9 mm to 1.3 mm, a thickness of about 2.7 mm to 2.8 mm and a pore size of about 1.0 mm to 1.4 mm, a thickness of about 2.8 mm to 2.9 mm and a pore size of about 1.3 mm to 1.6 mm, or a thickness of about 2.9 mm to 3.0 mm and a pore size of about 1.4 mm to 1.8 mm.

In various aspects, a knitted fabric textile is provided having a plurality of microscopic pores. The textile can be made from a fine elastomeric yarn. The textile can have pores with a pore size of about 18 μm, about 17 μm, about 16 μm, about 15 μm, or less.

In various aspects, a spacer fabric textile is provided having a front layer and a back layer, and further having a pile layer joining the front layer and the back layer. The textile can have a thickness and a plurality of pores having a minimum pore size. In various aspects, one or more of the following is adjusted to provide 95% to 100% mosquito bite resistance, e.g. at least 95%, 99%, 99.9%, or 100% mosquito bite resistance: (i) the thickness, (ii) the minimum pore size, (iii) a pore tortuosity, (iv) a pore shape, (v) a number of structures external or internal to the pores that prevent bending of a mouth part sheath of a mosquito, and (vi) a presence of fine structures on the external or internal surface of the pores that hit an antenna or other sensor organ of a mosquito when on a surface of the textile. The pore size can be the minimum pore size that prevents the mosquito from inserting its proboscis through the fabric. The pore tortuosity can be such that it prevents the mosquito from inserting its mouthparts through the fabric. The pore shape can discourage the mosquito from probing the fabric. The fabric thickness can prevent bending of a mouth part sheath of a mosquito so that the stylets of the proboscis can be inserted into the skin. The fine structures on the external or internal surface of the pores can contact antennae or other sensory organs of a mosquito when on a surface of the textile, discouraging the mosquito from probing the fabric.

In various aspects, a fabric textile is provided having a plurality of microscopic pores. The textile can be made from a fine elastomeric yarn. The textile can have pores with a pore size of about 20 μm, about 19 μm, about 18 μm, about 17 μm, about 16 μm, about 15 μm, or less. In various aspects, one or more of the following is adjusted to provide at least 95%, 99%, 99.9%, or 100% mosquito bite resistance: (i) the thickness, (ii) the minimum pore size, (iii) a pore tortuosity, (iv) a pore shape, (v) a number of structures external or internal to the pores that prevent bending of a mouth part sheath of a mosquito, and (vi) a presence of fine structures on the external or internal of the pores that hit an antenna or other sensor organ of a mosquito when on a surface of the textile. In various aspects, one or more of the following is adjusted to provide at least 95% to 100% mosquito bite resistance: (i) the thickness, (ii) the minimum pore size that prevents the mosquito from inserting its proboscis through the fabric, (iii) a pore tortuosity that prevents the mosquito from inserting its mouthparts through the fabric, (iv) a pore shape that discourages the mosquito from probing the fabric, (v) fabric thickness that prevents bending of a mouth part sheath of a mosquito so that the stylets of the proboscis can be inserted into the skin, and (vi) a presence of fine structures on the external or internal surface of the pores that contact antennae or other sensory organs of a mosquito when on a surface of the textile discouraging the mosquito from probing the fabric. The textile can be a single fabric layer or can have more (e.g. about 2, 3, or 4) fabric layers.

The textiles can be made with a variety of stitches and stitch patterns. For example, in various embodiments, the textile is woven, weft-knitted, warp-knitted, or a combination thereof. In various aspects, nanofibers are incorporated into the textile. The textile can have an open area that is about 2% to 4%, about 4% to 6%, about 6% to 8%, about 8% to 10%, about 10% to 12%, about 12% to 14%, about 14% to 16%, about 16% to 18%, or more.

In various aspects, the textiles can be treated with a repellent or insecticide. For example, the treatment can be applied to the pile yarns, or on the outer face of the fabric of one or more layers. The treatment can be applied during manufacture of the textile layer, to the manufactured textile layer, or to a garment made from one or more of the textiles.

The textile can have bite resistance of about 95% to 100%, e.g. about 90%, about 95%, about 98%, about 99%, or more or can have a bite resistance of about 100% when measured according to the in vivo, arm-in-cage feeding bioassay described herein. The textile can have bite resistance of about 95% to 100%, e.g. about 90%, about 95%, about 98%, about 99%, or more or can have a bite resistance of about 100% when measured according to the arm-in-cage test described herein.

In various aspects, garments are provided containing the textiles described herein. The garments can include any garment, such as a sock, an undergarment, pants, a shirt, a hat, or a combination thereof. The undergarment can be designed for civilian use or for military use in a variety of climates. The garments can be made to be comfortable while still providing the desired level of mosquito bite resistance. The textile provided herein can be a liner in the garment, e.g. the garment can further include additional textiles that form an outer layer.

Other systems, methods, features, and advantages of the mosquito bite-resistant textiles and garments will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Further aspects of the present disclosure will be readily appreciated upon review of the detailed description of its various embodiments, described below, when taken in conjunction with the accompanying drawings.

FIG. 6A depicts the safe thickness for pore sizes spanning Case 1, Case 2, and Case 3. FIG. 6B is a close-up version of the graph depicted in the box from FIG. 6A highlighting the predicted safe thickness versus pore size for Case 1 only.

(FIG. 14A) 5-10 days old starved mosquitos; (FIG. 14B) test cage and volunteer's arm; (FIG. 14C) testing frame.

(FIG. 23A) thickness; (FIG. 23B) pore size; (FIG. 23C) weight; and (FIG. 23D) location on the graph of the safe thickness versus pore size for *Aedes aegypti*.

DETAILED DESCRIPTION

In various aspects, mosquito bite-resistant textiles and garments made therefrom are provided. The textiles can include spacer fabric textiles having a combination of pore size and thickness of provide mosquito bite resistance while maintaining the desired comfort and durability of the garment. The textiles can include a single layer or a few thin layers (e.g. 2 or 3 layers) and are remarkably thin with microscopic pores that prevent proboscis penetration, but ample pore area to provide exceptional heat and moisture vapor transport. In some aspects, the thickness and pore size can provide for mosquito bite resistance. In some aspects, the shape of the pores can provide for mosquito bite resistance. In some aspects, the tortuosity of the path through the pores can provide for mosquito bite resistance. In some aspects, the external and/or internal structure of the textile can provide for mosquito bite resistance. In some aspects, structure on the surface that hit antennae and other sense organs of the mosquito can provide for mosquito bite resistance. In some aspects, a combination of more than one or all of these features can provide for mosquito bite resistance.

Figure 1:
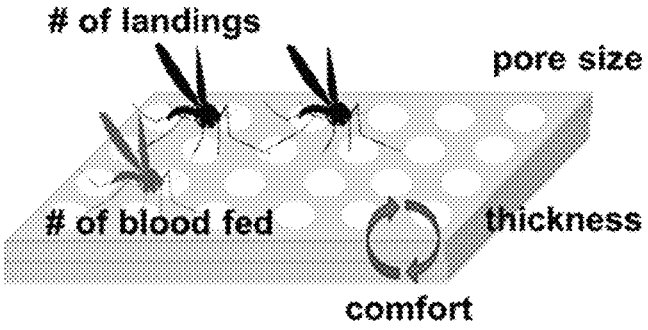
FIG. 1 is a figure highlighting the characterization of wearable bite-proof materials for mosquito bite-resistance.

Protection from mosquito bites can be achieved via a variety of approaches. Female mosquitoes seek a blood meal by detecting olfactory cues (temperature, odor, or both) of a potential host, and the structure of textiles can diminish the diffusion of these cues to reduce the possibility of hunting host. Moreover, the textiles can provide a bite-proof barrier to mosquitoes without the use of insecticides. These two aspects make a high possibility for textiles to prevent mosquitoes from reaching underlying human skin. The structure is also a factor in determining the comfort of textiles. Hence, as shown in FIG. 1, the structural factors including pore size and thickness of a protective fabric affect not only the comfort of the textiles, but also number of landings and probing, and number of blood feeds.

A geometrical model was established to predict the bite-proof capacity for Case 1, Case 2 and Case 3, to cover the entire effective range of combinations of pore sizes and thicknesses. Based on the predictive model, three prototyping strategies were carried out for producing fabrics for each case: superfine knit for Case 1, weft spacer knit and 3-D spacer fabrics for Case 2, 3-D spacer fabrics for Case 3.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting. The skilled artisan will recognize many variants and adaptations of the embodiments described herein. These variants and adaptations are intended to be included in the teachings of this disclosure and to be encompassed by the claims herein.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant specification should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

Although any methods and materials similar or equivalent to those described herein can also be used in the practice or testing of the present disclosure, the preferred methods and materials are now described. Functions or constructions well-known in the art may not be described in detail for brevity and/or clarity. Embodiments of the present disclosure will employ, unless otherwise indicated, techniques of chemistry, material science, and textiles manufacturing and engineering and the like, which are within the skill of the art. Such techniques are explained fully in the literature.

It should be noted that ratios, concentrations, amounts, and other numerical data can be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to about 5%" should be interpreted to include not only the explicitly recited values of about 0.1% to about 5%, but also include individual values (e.g., 1%, 2%, 3%, and 4%) and the sub-ranges (e.g., 0.5%, 1.1%, 2.2%, 3.3%, and 4.4%) within the indicated range. Where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In some embodiments, the term "about" can include traditional rounding according to significant figures of the numerical value. In addition, the phrase "about 'x' to 'y'", where 'x' and 'y' are numerical values, includes "about 'x' to about 'y'".

Definitions

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

The articles "a" and "an," as used herein, mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Textile Design Considerations

Hybrid multilayer textiles and spacer fabrics are provided. The textiles in both approaches can have at least two layers. Superfine knitted single-layer textiles are also provided. Each layer may have a differently patterned fabric or even be of different fabric types.

The protective effect can be, at least to some extent, dependent upon the pore size of a fabric, as well as fabric thickness. A single layer of a 2D textile, whether woven, weft knitted, or warp knitted, can be capable of preventing mosquito bites if designed to provide the appropriate combination of pore size and thickness. Thermophysiological comfort is mainly determined by pore size, pore area per fabric area, and fabric insulation properties. Unfortunately, for these fabrics, a reduction in pore size and an increase in thickness generally decrease air and moisture vapor permeability.

TABLE 1

The relationship between structure parameters, comfort and protective capacity

| Pore size | Thickness | # of Landings | # of Blood Fed | Comfort |
|---|---|---|---|---|
| LARGE | LOW | LOW | HIGH | HIGH |
| LARGE | HIGH | HIGH | LOW | HIGH |
| SMALL | HIGH | LOW | LOW | LOW |
| SMALL | LOW | HIGH | LOW | MEDIUM |

The relationships between structural factors and bite-proof capacity are neutrally described in Table 1. The fabric with large pore size offers adequate air permeability for comfort. When changing its thickness from low to high, the number of blood feeds is reduced because of the vertical block of fabric, but the number of landings increase because of the repeat hunting and landing of mosquito without blood feeding. The fabric with small pore size can reduce the number of blood feeds by horizontally excluding the mosquito proboscis. When changing its thickness from high to low, the number of landings will relatively increase because more host cues can be easily detected by a mosquito. The comfort in this case would be more complex for the combination of small pore size and low thickness. Due to different combinations of pore size and thickness, a series of prototyping fabrics were produced for bioassay testing and comfort testing.

Figure 2:
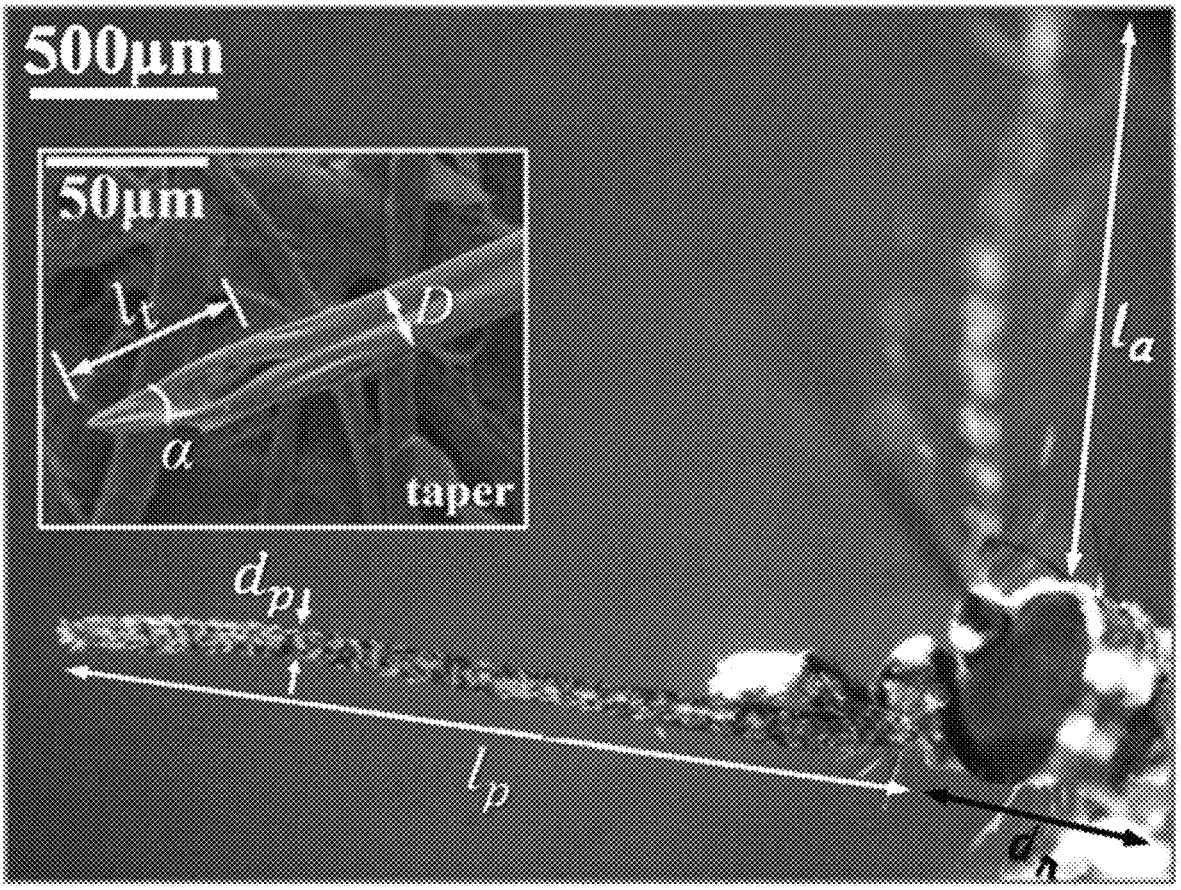
FIG. 2 is a figure demonstrating the anatomy of the head, proboscis and proboscis tip of *Aedes aegypti* females.

The Entire Range of Effectiveness for Physical Barrier Against Mosquito Biting According to the mosquito anatomy as illustrated in FIG. 2, the main design criteria of the combination of thickness and pore sizes were determined by dimensions of *Aedes aegypti* mosquito head and proboscis listed in Table 2. In other words, the longitudinal length of a mosquito head and proboscis influences the selection of vertical thickness of fabric, while the transverse length (or diameters of mosquito head and proboscis) influences the choice of the horizontal size of pore. The mosquito used in this project was *Aedes aegypti* females, and the thickness are 2161-2490 μm for Case 2 and 2491-3200 μm for Case 3, and the pore sizes for each case are 27.6-720 μm for Case 2 and 721-1800 μm for Case 3.

TABLE 2

Dimensions of mosquito head, proboscis, proboscis tip and antenna (*Aedes aegypti* females, Mean ± SD)

| | Head | Proboscis | Proboscis tip | Antenna |
|---|---|---|---|---|
| Lengths | $l_k$ (mm) 0.68 ± 0.11 | $l_m$ (mm) 2.14 ± 0.12 | $l_t$ (μm) 75 ± 0.3 | $l_t$ (mm) 0.36 ± 0.02 |

TABLE 2-continued

| Dimensions of mosquito head, proboscis, proboscis tip and antenna (*Aedes aegypti* females, Mean ± SD) | | | | |
|---|---|---|---|---|
| | Head | Proboscis | Proboscis tip | Antenna |
| Diameters | $d_k$ (mm) 0.68 ± 0.11 | $d_m$ (μm) 85.06 ± 0.16 | D (μm) 27.5 ± 0.6 | N/A |

Figure 3A:
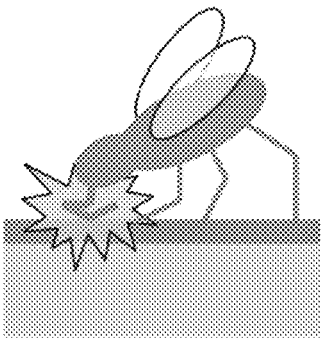
FIGS. 3A-3B are diagrams of three exemplary embodiments of a protective textile, including Case 1: a thin textile where the pore size is smaller than proboscis diameter (FIG. 3A); Case 2: a textile where both thickness and pore size are moderate but there is a tortuous path (FIG. 3B); and Case 3: a textile with the highest thickness that allows high porosity and wide pore area variation for excluding mosquito (FIG. 3C).
Figure 3B:
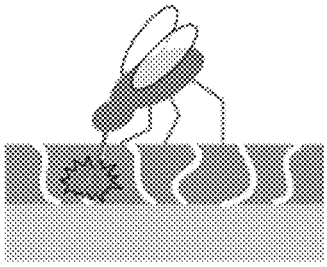
Figure 3C:
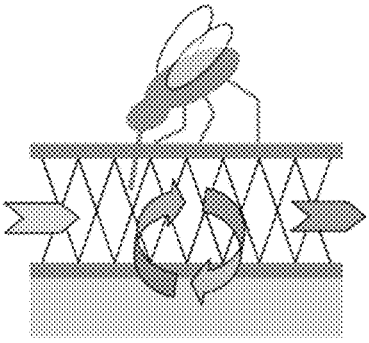

According to thickness and pore size mentioned above, three approaches of bite-proof textiles were considered as shown in FIGS. 3A-3C. In FIG. 3A, the textile is thin and pore size is smaller than proboscis diameter for excluding mosquito. In FIG. 3B, both of the thickness and pore size are moderate in this case. The pore area of textile can be easily changed by yarn level manipulation and varies its comfort and mechanical properties in this case. In FIG. 3C, the textile has highest thickness that allows high porosity and wide pore area variation for excluding mosquito. The pore size could be larger than the mosquito head, while the thickness has a minimum value corresponding to the length of head and proboscis of mosquito. Thermophysiological comfort, as determined by pore diameter, pore area per-unit and fabric insulation properties, performs well for having a lager pore size in this case.

Figure 4A:
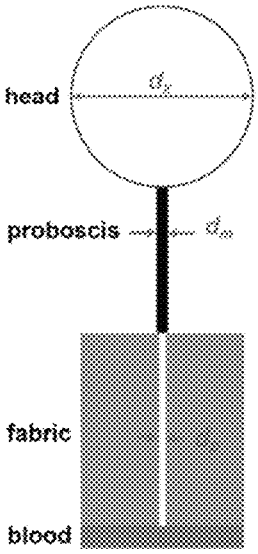
FIG. 4A is a figure depicting the protection mechanisms for the exemplary textile embodiment in FIG. 3A.
Figure 4B:
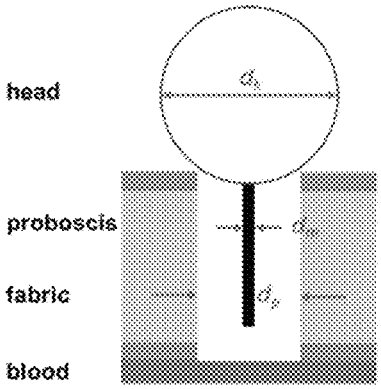
FIG. 4B is a figure depicting some of the protection mechanisms for the exemplary textile embodiment in FIG. 3C.
Figure 4C:
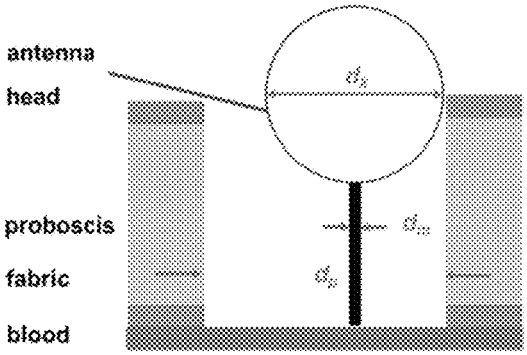
FIG. 4C is a figure depicting the protection mechanisms for the exemplary textile embodiment in FIG. 3C.

Three mechanisms for each case have also been summarized for design before fabric prototyping as shown in FIGS. 4A-4C:

Case 1: fabric is very thin but pores are too small for proboscis to penetrate (pore diameter<proboscis diameter);

Case 2: fabric is moderate thickness but head cannot completely penetrate pore (pore diameter >proboscis diameter<head diameter);

Case 3: fabric is thick, pore larger than head, but tip of proboscis cannot completely penetrate (pore diameter>head diameter).

The pore size for Case 1 fabrics is small, which may reduce air and moisture permeability. As in line 4 of Table 1, it is important to find a balance between bite-proof capacity and comfort. A proper predictive model can assist in fabric design.

Figure 5:
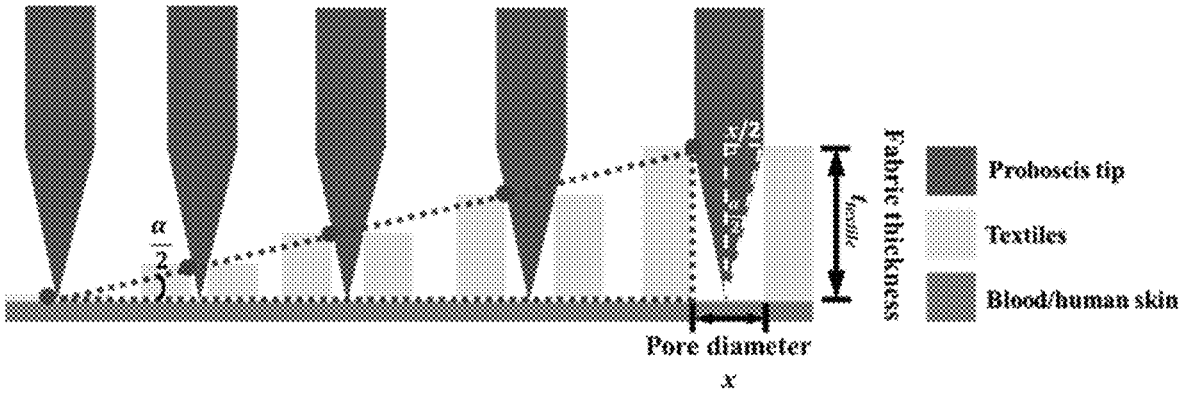
FIG. 5 is a schematic fabric model when the pore size is less than the diameter of the mosquito proboscis tip.

As shown in FIG. 2, proboscis tip is the first part to touch skin or protective fabric before blood feeding of mosquito. The shape parameters of proboscis tip include diameter (D), length of tip ($l_t$) and tip angle (α). These parameters determine the combination of pore sizes and thicknesses for candidate fabrics. Assuming the cross section of proboscis tip is an isosceles triangle as shown in FIG. 5, the thickness of the textile that is needed to prevent penetration is:

$$t_{textile} = \frac{x}{2\tan(\frac{\alpha}{2})} \quad 0 \le x \le D \tag{1}$$

where x is pore size, α is tip angle. If the pore size is x and thickness is greater than $t_{textile}$, the proboscis cannot reach the underlying human skin. If the thickness is lower than $t_{textile}$, the fabric will fail to provide complete protection.

Figure 6A:
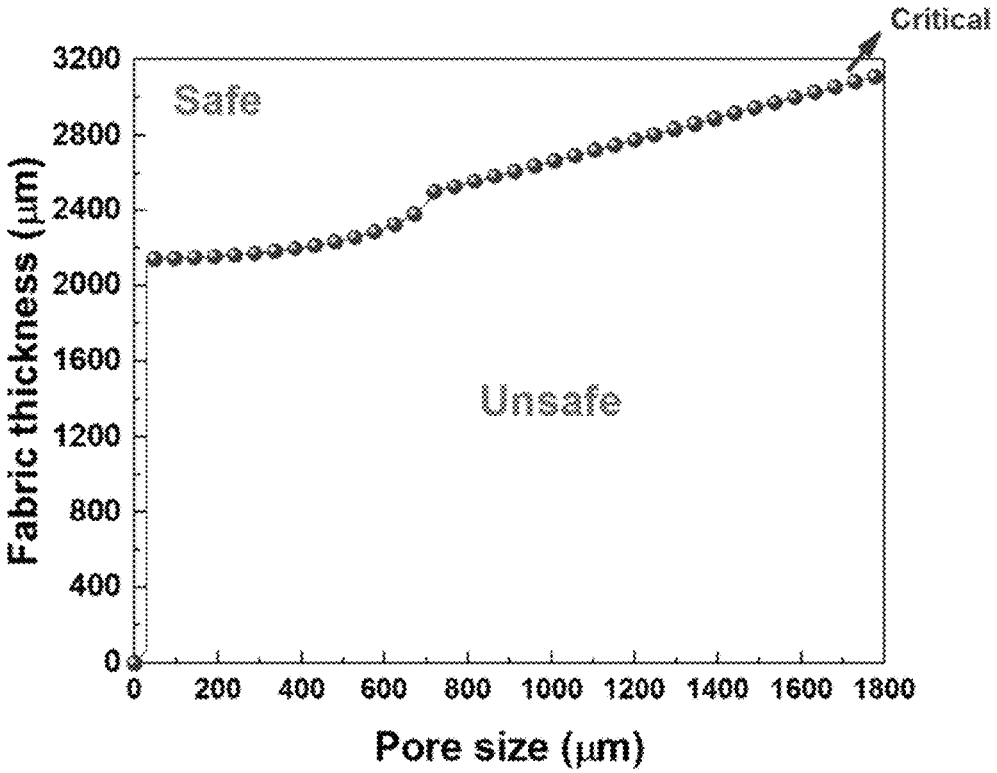
FIGS. 6A-6B are graphs of the predicted safe thickness versus pore size for *Aedes aegypti*.

According to the measurement of the proboscis tip of *Aedes aegypti*, the approximate shape parameters are: α=25°, $l_t$=75 μm, D=27.5 μm. Thus, the predicted safe thicknesses and pore sizes for the entire range of Case 1, 2 and 3 textiles for *Aedes aegypti* mosquitoes is shown in FIG. 6A.

Figure 6B:
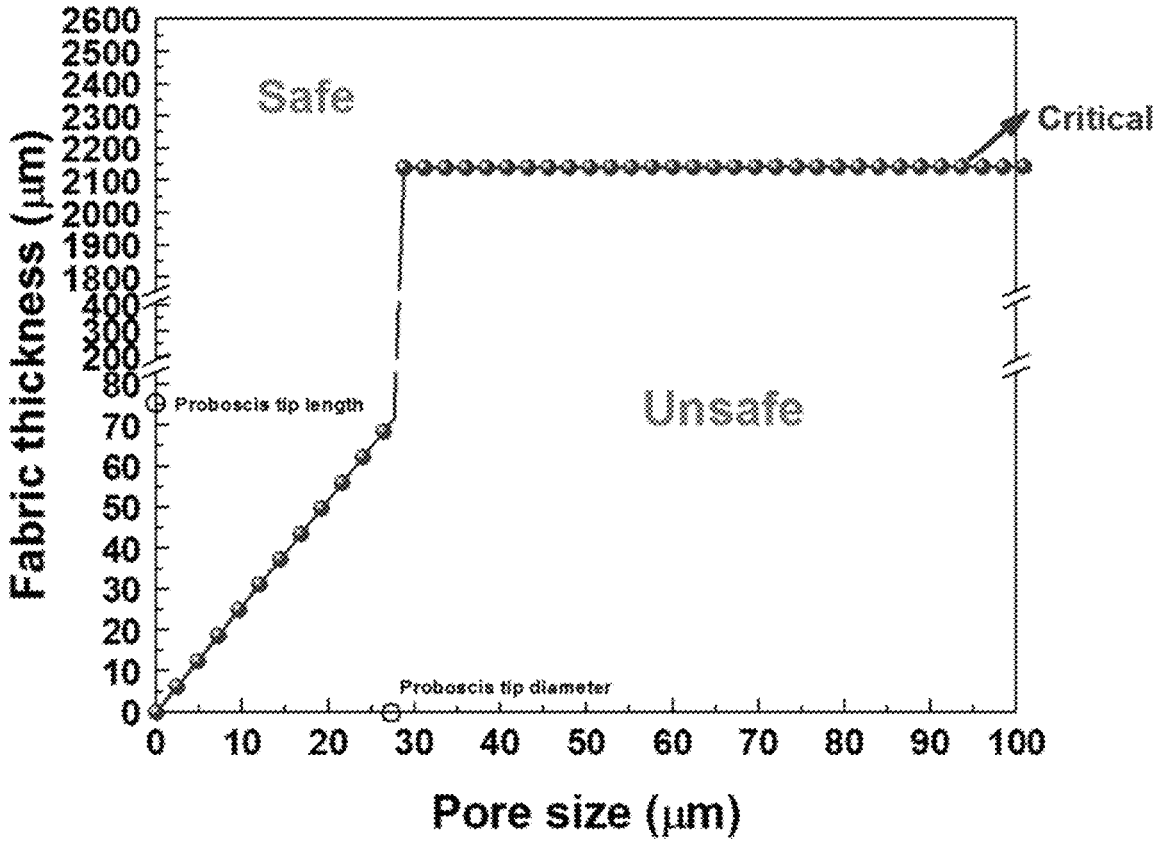

FIG. 6B shows the predicted safe thickness versus pore size for Case 1. The range of pore size is 0-27.5 μm, and the range of thickness is 0-2140 μm. There is a step up in thickness at a pore size of approximately 27.5 um because at this diameter the proboscis can penetrate the pore. This covers a wide range of thicknesses between 80-2140 μm. This range allows a wide window for fabric thickness selection.

Textiles

A variety of textiles are provided. In various aspects, a spacer fabric textile is provided having a front layer and a back layer, and further having a pile layer joining the front layer and the back layer. The spacer fabric textile can have a plurality of pores and a minimum thickness. As described above, since the pore size needed to provide mosquito bite resistance is also a function of the fabric thickness (e.g., a thicker fabric can have a larger maximum pore size and still provide bite resistance, while a thinner fabric will need a smaller maximum pore size to provide the same bite resistance), a maximum pore size that is sufficient to provide bite resistance can vary based on the maximum thickness of the textile. In some embodiments, it is desirable to determine the maximum pore size to provide bite resistance for a textile having a minimum thickness of that textile and then provide pores that have an average pore size smaller than the determined maximum pore size for bite resistance. Thus, in embodiments, the pores of a textile of the present disclosure can have a pore size smaller than the maximum pore size that is sufficient to provide mosquito bite resistance based upon the minimum thickness of the textile. In various aspects, a woven or knitted fabric textile is provided having a plurality of microscopic pores. The textile can be a superfine knitted textile, e.g. having a thickness of about 300 μm or less.

In various aspects, the spacer fabric textile can have a thickness of about 2.0 mm to 2.2 mm and a pore size of about 0.1 mm to 0.6 mm, a thickness of about 2.2 mm to 2.4 mm and a pore size of about 0.4 mm to 0.7 mm, a thickness of about 2.4 mm to 2.5 mm and a pore size of about 0.7 mm to 0.9 mm, a thickness of about 2.5 mm to 2.6 mm and a pore size of about 0.8 mm to 1.1 mm, a thickness of about 2.6 mm to 2.7 mm and a pore size of about 0.9 mm to 1.3 mm, a thickness of about 2.7 mm to 2.8 mm and a pore size of about 1.0 mm to 1.4 mm, a thickness of about 2.8 mm to 2.9 mm and a pore size of about 1.3 mm to 1.6 mm, or a thickness of about 2.9 mm to 3.0 mm and a pore size of about 1.4 mm to 1.8 mm.

In various aspects, a woven or knitted fabric textile is provided having a plurality of microscopic pores. The textile can be made from a fine yarn. The yarn can be elastomeric. The textile can have pores with a pore size of about 18 μm, about 17 μm, about 16 μm, about 15 μm, or less.

In various aspects, a spacer fabric textile is provided having a front layer and a back layer, and further having a pile layer joining the front layer and the back layer. The textile can have a thickness and a plurality of pores having a minimum pore size. In various aspects, one or more of the following is adjusted to provide at least 95%, 99%, 99.9%, or 100% mosquito bite resistance: (i) the thickness, (ii) the minimum pore size, (iii) a pore tortuosity, (iv) a pore shape, (v) a number of structures external or internal to the pores that prevent bending of a mouth part sheath of a mosquito, and (vi) a presence of fine structures on the external or internal of the pores that hit an antenna or other sensor organ of a mosquito when on a surface of the textile.

In various aspects, a knitted fabric textile is provided having a plurality of microscopic pores. The textile can be made from a fine elastomeric yarn. The textile can have pores with a pore size of about 20 μm, about 19 μm, about 18 μm, about 17 μm, about 16 μm, about 15 μm, or less. In various aspects, one or more of the following is adjusted to provide at least 95%, 99%, 99.9%, or 100% mosquito bite resistance: (i) the thickness, (ii) the minimum pore size, (iii) a pore tortuosity, (iv) a pore shape, (v) a number of structures external or internal to the pores that prevent bending of a mouth part sheath of a mosquito, and (vi) a presence of fine structures on the external or internal of the pores that hit an antenna or other sensor organ of a mosquito when on a surface of the textile. The textile can be a single fabric layer or can have more (e.g. about 2, 3, or 4) fabric layers.

In various aspects, a superfine knitted textile is provided capable of bite resistance of about 90%, about 95%, about 98%, about 99%, about 99.9%, or more or wherein the textile has a bite resistance of about 100% when measured according to the in vivo feeding bioassay described herein. In some aspects, a superfine knitted textile is provided capable of bite resistance of about 90%, about 95%, about 98%, about 99%, about 99.9%, or more or wherein the textile has a bite resistance of about 100% when measured according to the arm-in-cage test described herein. In some aspects, the textile includes a superfine blended yarn, for example a blend of a nylon and a polyurethane. The superfine blended yarn can be knitted in a single jersey knit to form the superfine knitted textile having a textile thickness of about 300 μm or less and a plurality of pores having an average pore size of about 27.5 μm or less. In some aspects, the superfine knitted textile has a thickness of about 80 μm or less and the average pore size is less than about one-third of the thickness. In some aspects, the average pore size is smaller than the maximum pore size to provide mosquito bite resistance based upon the thickness of the textile.

The blended yarn can include filaments having a denier of about 15-25 or about 20. The superfine knitted textile can be further processed to decrease the pore size, e.g. by one or both of heat setting the superfine knitted textile and repeated washing of the superfine knitted textile without detergent.

In some aspects, a weft spacer knitted textile is provided. The weft spacer knitted textile can include a polyester yarn with a yarn count selected from the group consisting of 70 D×2 ends, 70 D×3 ends, and 70 D×4 ends; a thickness of about 2.2 mm to 2.8 mm; and a plurality of pores having an average pore size of about 28 μm to about 200 μm. The weft spacer knitted textile can be further processed to decrease the pore size, e.g. by one or both of heat setting the weft spacer knitted textile and repeated washing of the weft spacer knitted textile without detergent.

The textile can include a variety of yarn type (monofilament, multifilament, spun yarn), yarn count index, and yarn spacing (picks/wefts/stitches per cm) in production direction and cross direction. In some aspects, a polyester yarn is used. The yarn can be an elastomeric yarn such as spandex (elastane). The yarn can be a polyester filament yarn or a polyester monofilament yarn. The textile can be made from a blend of two or more yarns. The textile can be a nylon/cotton blend, e.g. a 50/50 nylon/cotton blend (although other blending ratios may be used). The textile can be flame resistant. For example, the textile can be a flame-resistant blend of rayon/para-aramid/nylon, e.g. a 65/25/10 Flame Resistant (FR) rayon/para-aramid/nylon blend.

The textiles can be made with a variety of stitches and stitch patterns. For example, in various embodiments, the textile is woven, weft, or warp. The textile can have an open area that is about 2% to 4%, about 4% to 6%, about 6% to 8%, about 8% to 10%, about 10% to 12%, about 12% to 14%, about 14% to 16%, about 16% to 18%, or more.

The textile can have bite resistance of about 90%, about 95%, about 98%, about 99%, or more or can have a bite resistance of about 100% when measured according to the in vivo feeding bioassay described herein. The textile can have bite resistance of about 90%, about 95%, about 98%, about 99%, or more or can have a bite resistance of about 100% when measured according to the arm-in-cage test described herein.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Example 1

Textile Prototype Production

FIG. 6A shows the predicted safe thickness versus pore size of Case 1, Case 2, and Case 3. Based on the predictive model, we have investigated different combinations of pore sizes/thicknesses spanning the entire range of effectiveness as a physical vector barrier. For Case 1, two types of superfine knit were produced with different yarn counts. For Case 2, weft spacer fabrics with same structure and different yarn counts, and warp spacer fabrics with same structure and different thickness were produced. For Case 2 and Case 3, a series of spacer fabrics with different structure were utilized to verify the predictive model and provides the basis for future design of 3-D spacer fabrics.

Figure 7:
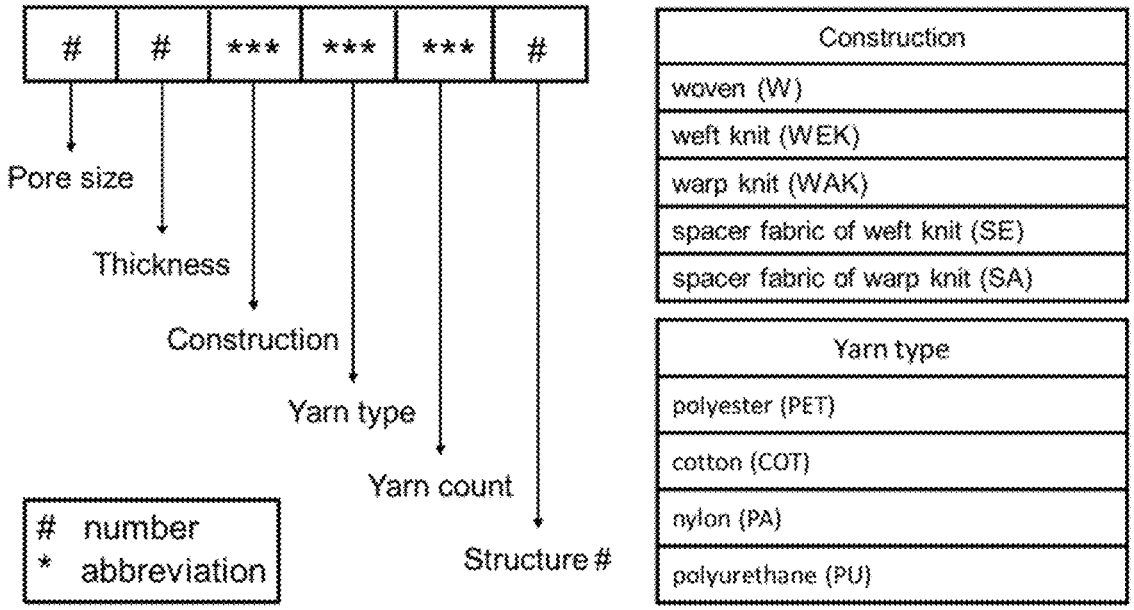
FIG. 7 is a diagram depicting the fabric naming convention used for characterizing exemplary textiles described herein.
Figure 8A:
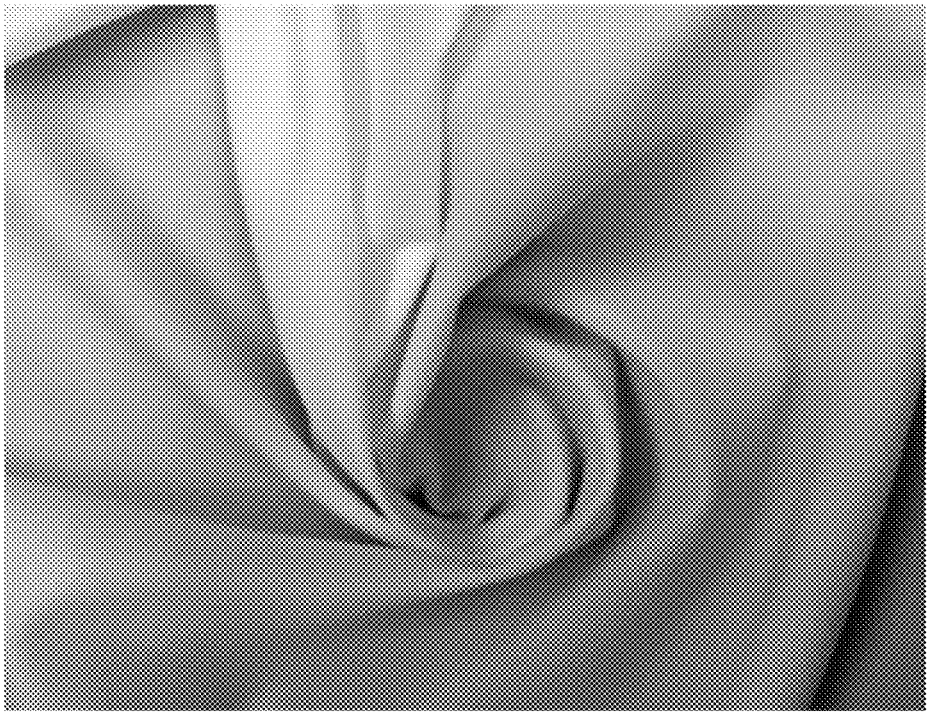
FIGS. 8A-8B are an image of an exemplary superfine knit textile (FIG. 8A) and the corresponding pore distribution (FIG. 8B).
Figure 8B:
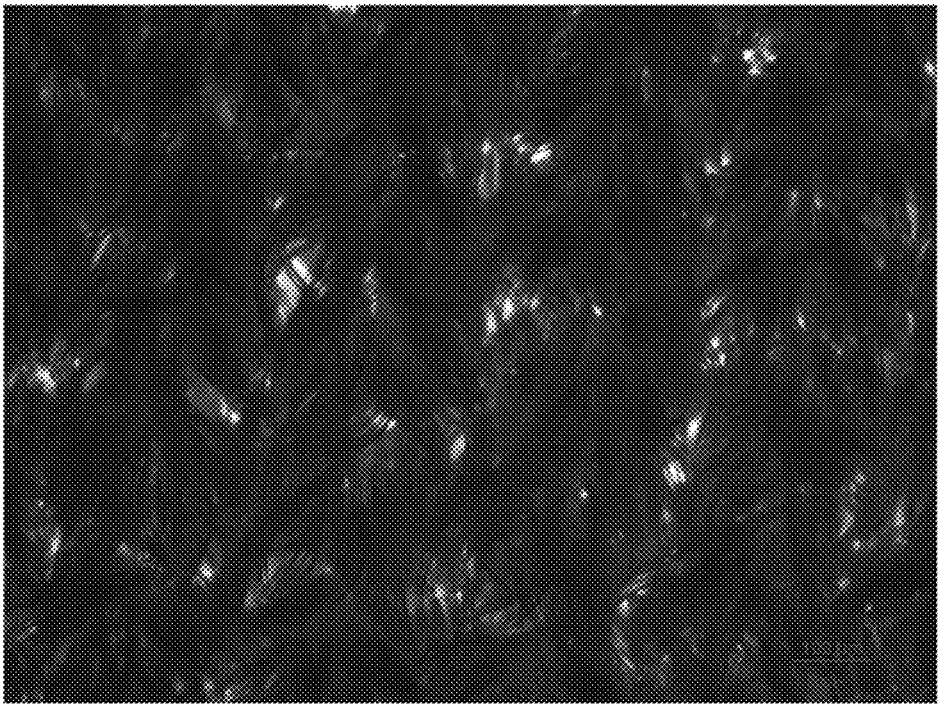
Figure 9A:
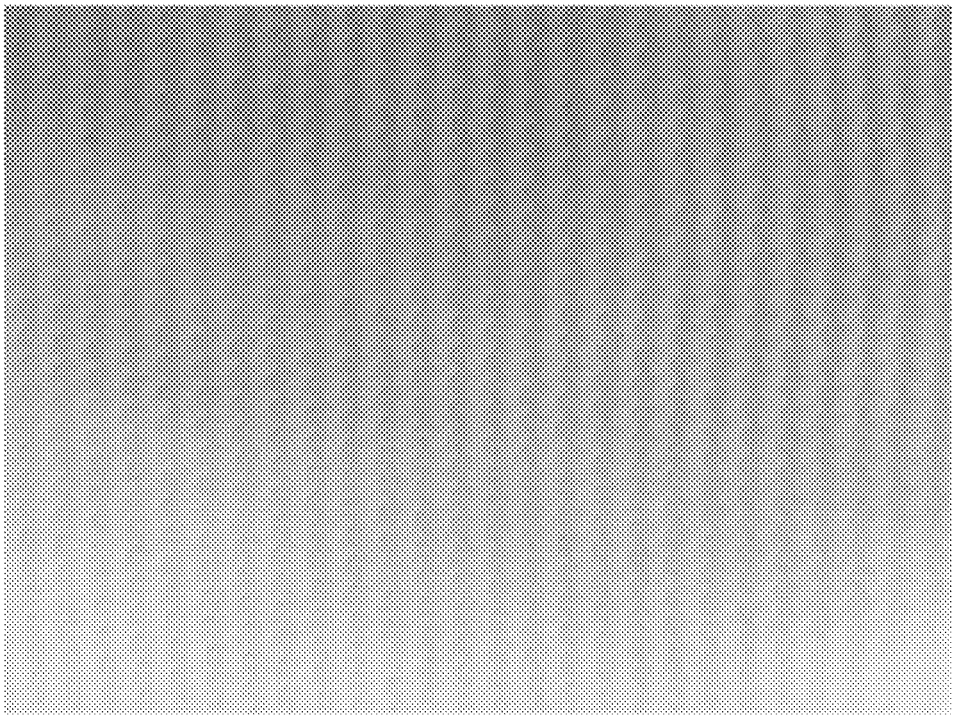
FIGS. 9A-9B are an image of an exemplary Weft spacer fabric with 70 D×2 ends (FIG. 9A) and the corresponding pore distribution (FIG. 9B).
Figure 9B:
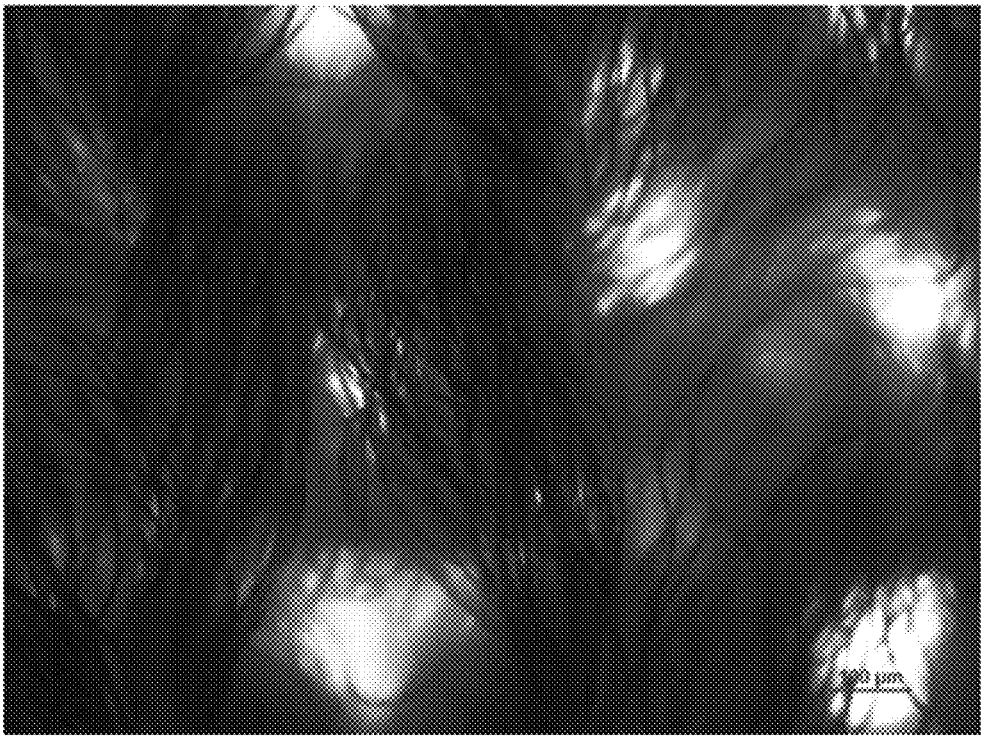
Figure 10A:
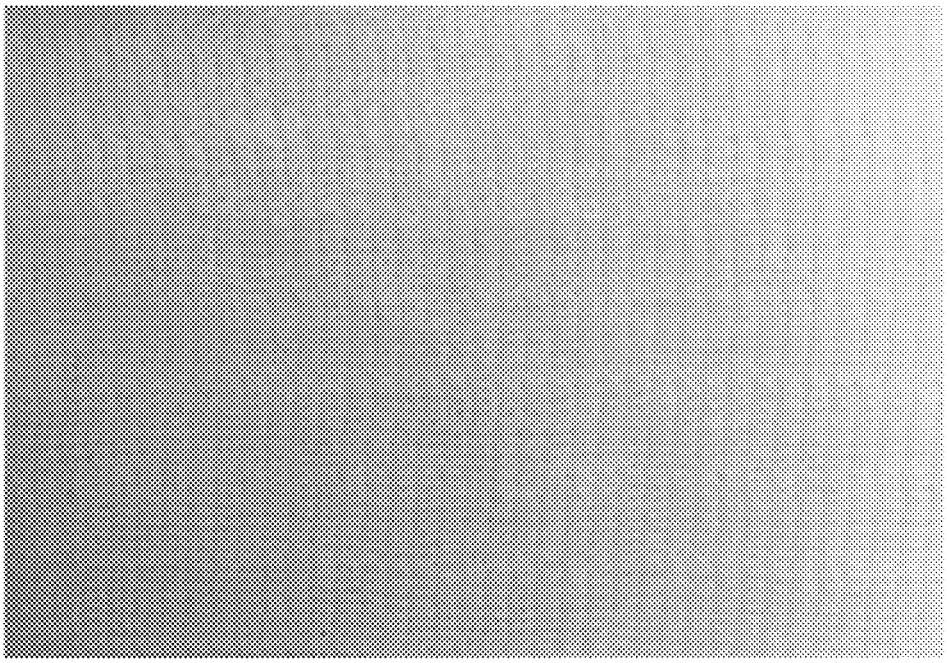
FIGS. 10A-10B are images of a top surface (FIG. 10A) and bottom surface (FIG. 10B) of an exemplary 3-D spacer fabric.
Figure 10B:
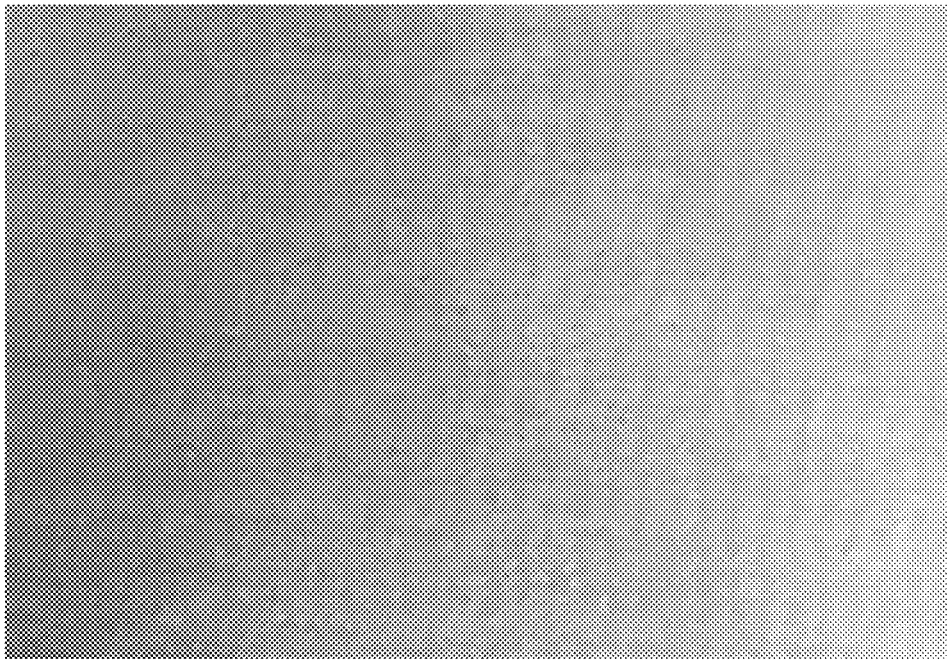
Figure 11A:
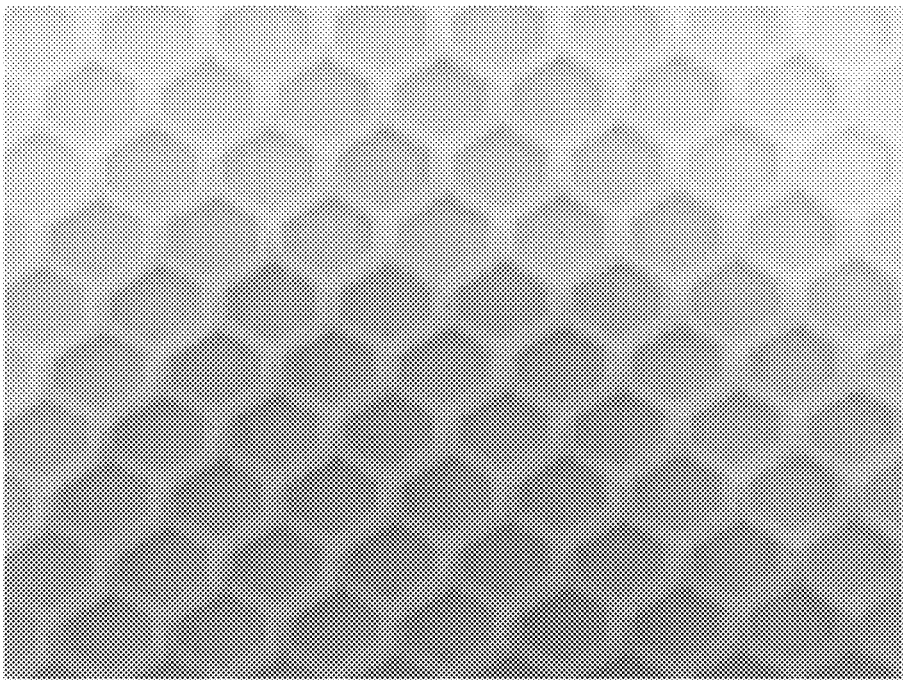
FIGS. 11A-11D are images of commercially available 3-D spacer fabrics: 370_2_SA_PA_SC 1502 (FIG. 11A); 510_2_SA_PA_D_SC044 (FIG. 11B); 700_2.5_SA_PA_SC082 (FIG. 11C); and 1400_3_SA_PA_SC2119 (FIG. 11D).
Figure 11B:
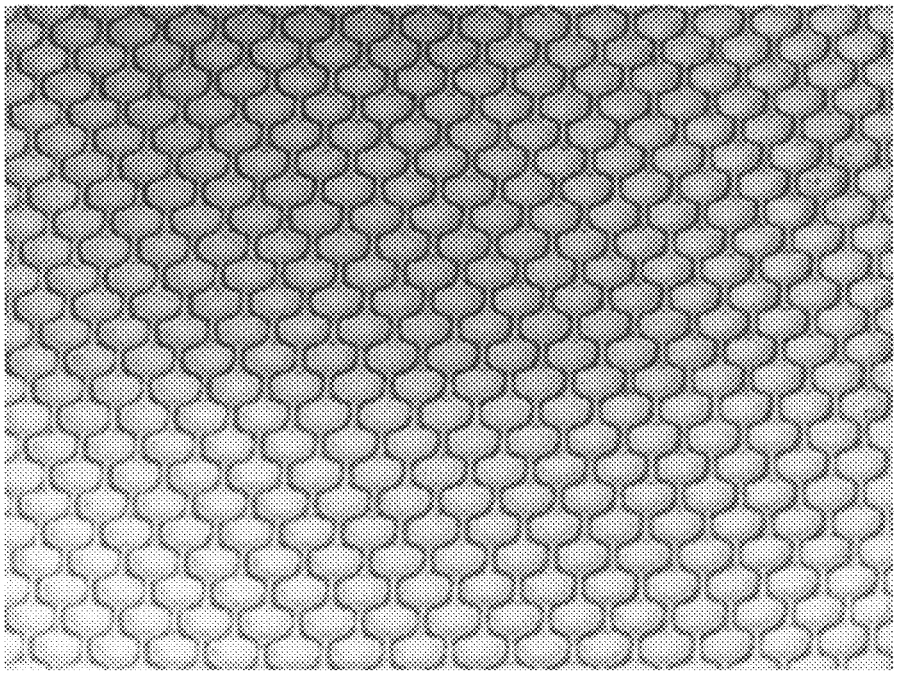
Figure 11C:
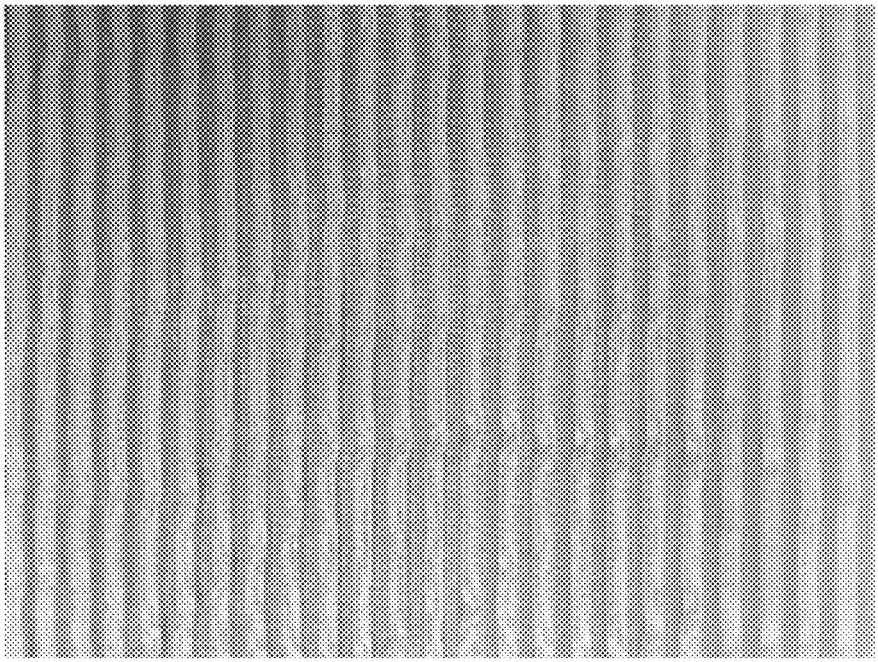
Figure 11D:
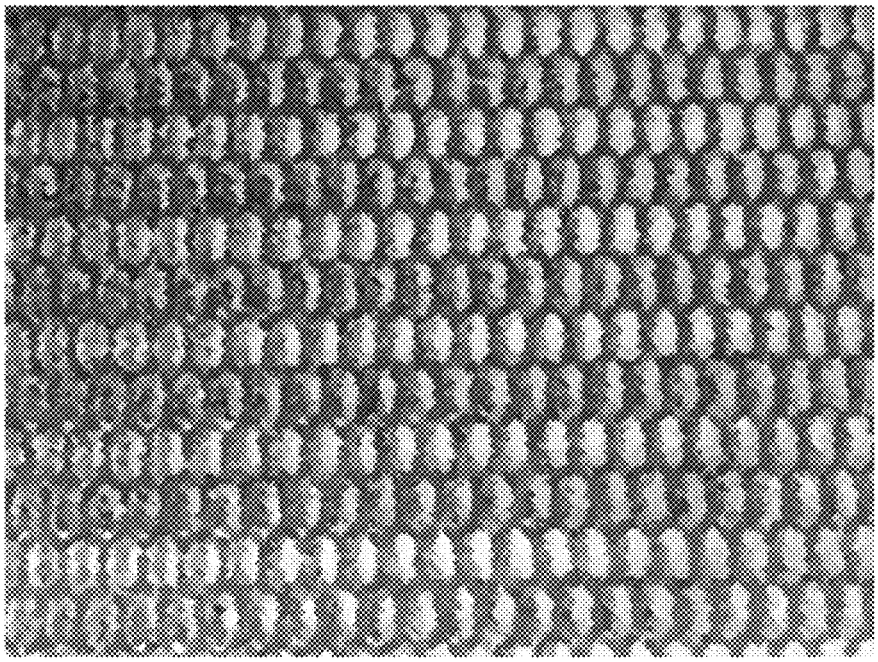

A naming convention of fabrics was introduced to name different fabrics for each case shown in FIG. 7 to obey a clear identification from each other. Table 3 lists the naming convention for fabrics for each case. In order to have a clear expression of figures and tables in this disclosure, the naming convention is abbreviated for use in figures and tables to represent only the pore size, thickness and number of structure. For example, a superfine knit called 37_0.3_WEK_PA/PU_20D/15D_1 is simplified to 37_0.3_1; the first number (37) is the average pore size for the fabric and the second number (0.3) is the thickness in mm of the fabric.

TABLE 3

Naming convention for fabrics and their structure, composition and yarn count

| | Name codes | Structure | Composition | Yarn count |
|---|---|---|---|---|
| Case 1 | 37_0.3_WEK_PA/PU_20D/15D_1 | Single jersey | Polyamide/Polyurethane | 20D/15D |
| | 16_0.26_WEK_PA/PU_20D/15D_1H | Single jersey | Polyamide/Polyurethane | 20D/15D |
| | 28_0.3_WEK_PA/PU_20D/20D_2 | Single jersey | Polyamide/Polyurethane | 20D/20D |
| | 23_0.28_WEK_PA/PU_20D/20D_2W | Single jersey | Polyamide/Polyurethane | 20D/20D |
| | 50_1.8_WEK_PET_70D_1 | Tuck | Polyester | 70D |
| | 37_2.2_WEK_PET_70D_2 | Tuck | Polyester | 70D |
| | 32_2.6_WEK_PET_70D_3 | Tuck | Polyester | 70D |
| Case 2 | 120_2_SE PA/PET_9D/70D_1 | Single jersey + satin weave | Polyamide/Polyester | 9D/70D |
| | 130_2.2_SE_PA/PET_9D/70D_2 | Single jersey + satin weave | Polyamide/Polyester | 9D/70D |
| | 140_2.4_SE_PA/PET_9D/70D_3 | Single jersey + satin weave | Polyamide/Polyester | 9D/70D |
| | 145_2.6_SE_PA/PET_9D/70D_4 | Single jersey + satin weave | Polyamide/Polyester | 9D/70D |
| | 150_3.0_SE_PA/PET_9D/70D_6 | Single jersey + satin weave | Polyamide/Polyester | 9D/70D |
| | 155_3.2_SE_PA/PET_9D/70D_7 | Single jersey + satin weave | Polyamide/Polyester | 9D/70D |
| Case 3 | 370_2_SA_PA_SC1502 | N/A | Polyamide | N/A |
| | 510_2_SA_PA_5C044 | N/A | Polyamide | N/A |
| | 700 2.5 SA PA SC082 | N/A | Polyamide | N/A |
| | 1400_3_SA_PA_SC2119 | N/A | Polyamide | N/A |

Superfine Knit

Generally, decreasing pore diameter is associated with lower air and moisture vapor permeability, as shown in row 3 of Table 1. However, decreasing thickness for a given pore diameter may improve the water/air permeability of the fabric. The superfine knits used in our studies of bite-resistance have a thickness of approximately 300 um.

The first superfine knit is single jersey structure made from a blended Nylon (PA) and polyurethane (PU) yarn. The average pore size of the knit is 37 μm, and thickness is 0.3 mm. This superfine knit is named as 37_0.3_WEK_PA/PU_20D/15D_1.

Because the pore size is larger than 27.5 μm, the composition of PA/PU yarn was changed from 20 D/15 D to 20 D/20 D in order to reduce the pore size. The second superfine knit is named as 28_0.3_WEK_PA/PU_20D/20D_2. Although the average pore size was decreased to 28 μm, it is still larger than the critical size of 27.5 μm for a fabric of 0.3 mm thickness. Two promising methods for reducing pore diameters of the fabrics were utilized. The first one is heat setting and the second method is regular washing without detergent. The heat set fabric is named 16_0.26_WEK_PA/PU_20D/15D_1H, and the washed fabric is named 23_0.28_WEK_PAPU_20D20D_2W.

In brief, prototyping fabrics for Case 1 include:

(1) 37_0.3_WEK_PA/PU_20D/15D_1

(2) 16_0.26_WEK_PA/PU_20D/15D_1H (3) 28_0.3_WEK_PA/PU_20D/20D_2

(4) 23_0.28_WEK_PA/PU_20D/20D_2W

Figure 49:
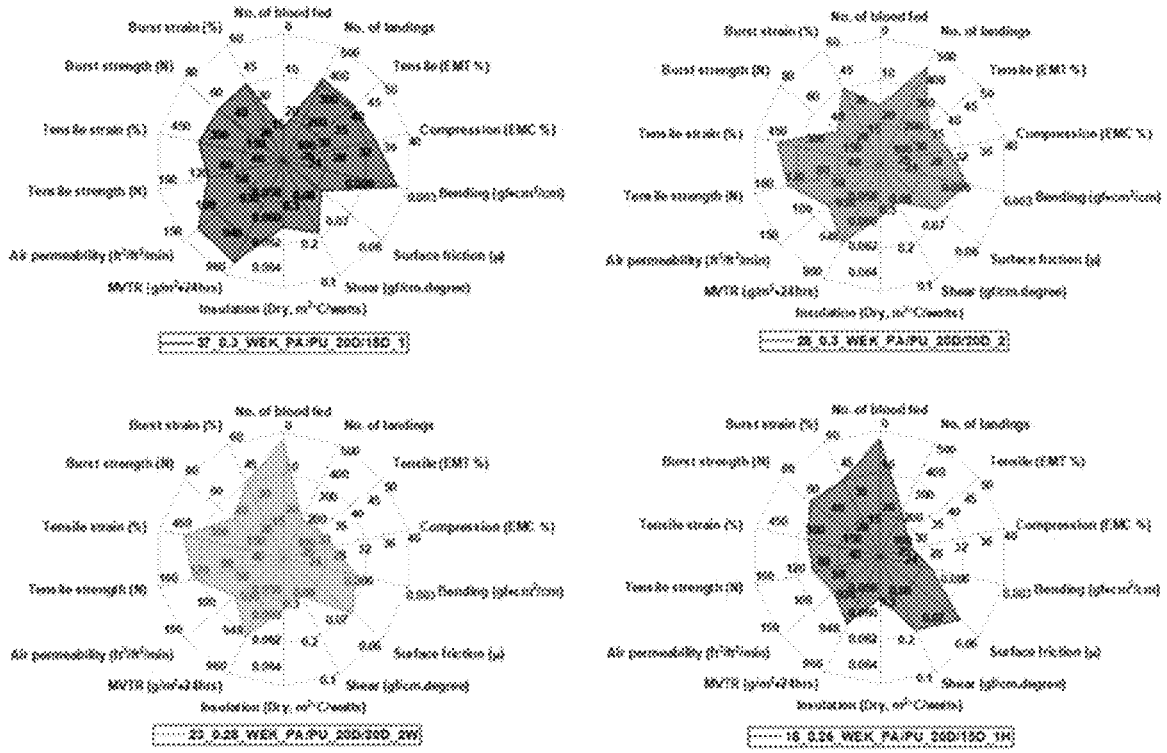
FIG. 49 Performance of each Case 1 fabric: ultra-thin knits.
Figure 50A:
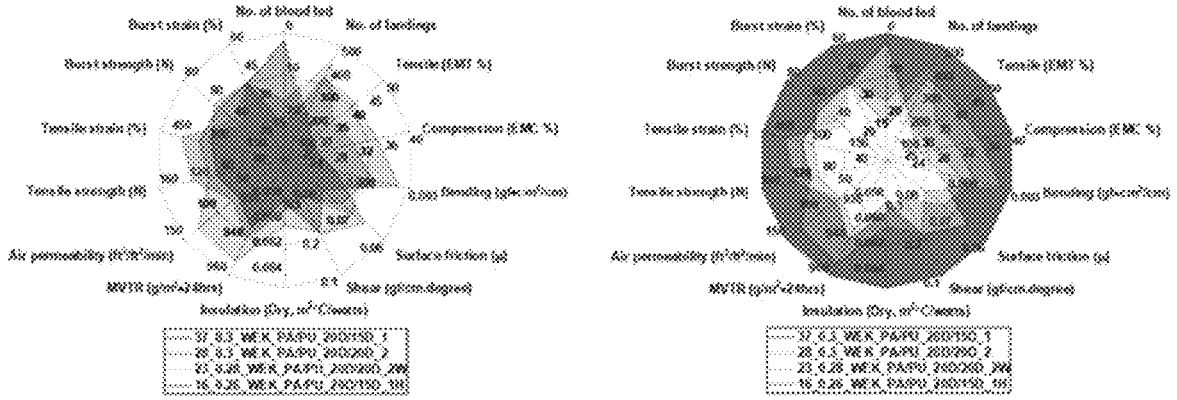
FIGS. 50A-C show the process for determining the range of performance criteria for Case 1 fabrics. Minimum and maximum values for Case 1 fabrics are shown in Table 4.
Figure 50B:
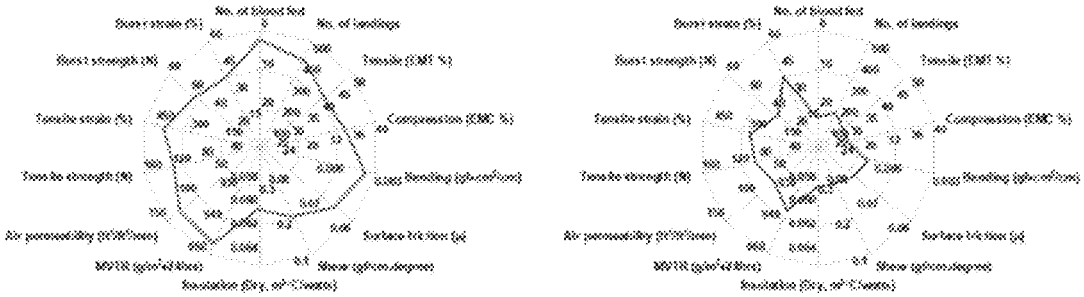
Figure 50C:
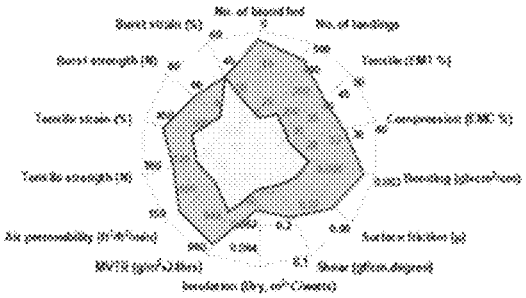

As shown in FIG. 49, tests on Case 1 fabrics included: bioassay test, KES tests, insulation test, moisture vapor transmission rate, air permeability, tensile test and burst test. Fabrics 37_0.3_WEK_PA/PU_20D/15D_1 and 28_0.3_WEKPA/PU_20D/20D_2 had higher numbers of blood fed mosquitoes, and therefore, lower bite resistance than fabrics 23_0.28_WEKPA/PU_20D/20D_2W and 16_0.26_WEK_PA/PU_20D/15D_1H. KES test results show that fabrics 37_0.3_WEK_PA/PU_20D/15D_1 and 28_0.3_WEK_PA/PU_20D/20D_2 are more easily deformable than fabrics 23_0.28_WEK_PA/PU_20D/20D_2W and 16_0.26_WEK_PA/PU_20D/15D_1H. FIGS. 50A-C show the performance range for Case 1 fabrics: (50A) Superimposition of all radar charts for Case 1 fabrics; (50B) Extracting maximum values and drawing continuous loops; (50C) Representation of performance range as area between loops. Minimum and maximum values for Case 1 fabrics are shown in Table 4.

TABLE 4

Minima and maxima of performances for Case 1

| | Performances | Unit | Minima | Maxima |
|---|---|---|---|---|
| Bioassay test | No. of blood fed | — | 2 | 22 |
| | No. of landings | — | 170 | 425 |
| Comfort evaluations | Tensile (EMT) | % | 28.20 | 41.03 |
| | Compression (EMC) | % | 25.27 | 34.87 |
| | Bending | $gf^*cm^2/cm$ | 0.0035 | 0.0065 |
| | Surface friction (μ) | — | 0.0658 | 0.0786 |
| | Shear | gf/cm·degree | 0.21 | 0.30 |
| | Insulation (Dry) | $rm^{2\circ}C/watts$ | 0.0583 | 0.0602 |
| | MVTR | $g/m^2 \cdot 24hrs$ | 943.63 | 955.62 |
| | Air permeability | $ft^3/min/ft^2$ | 69 | 128 |
| Durability | Tensile strength | N | 86 | 118 |
| | Tensile strain | % | 290 | 412 |
| | Burst strength | N | 34 | 56 |
| | Burst strain | % | 40 | 40 |

Weft Spacer Knit

Several patterns were designed for producing weft knitting fabrics, and one was selected to produce models of Case 2 fabrics.

Figure 51A:
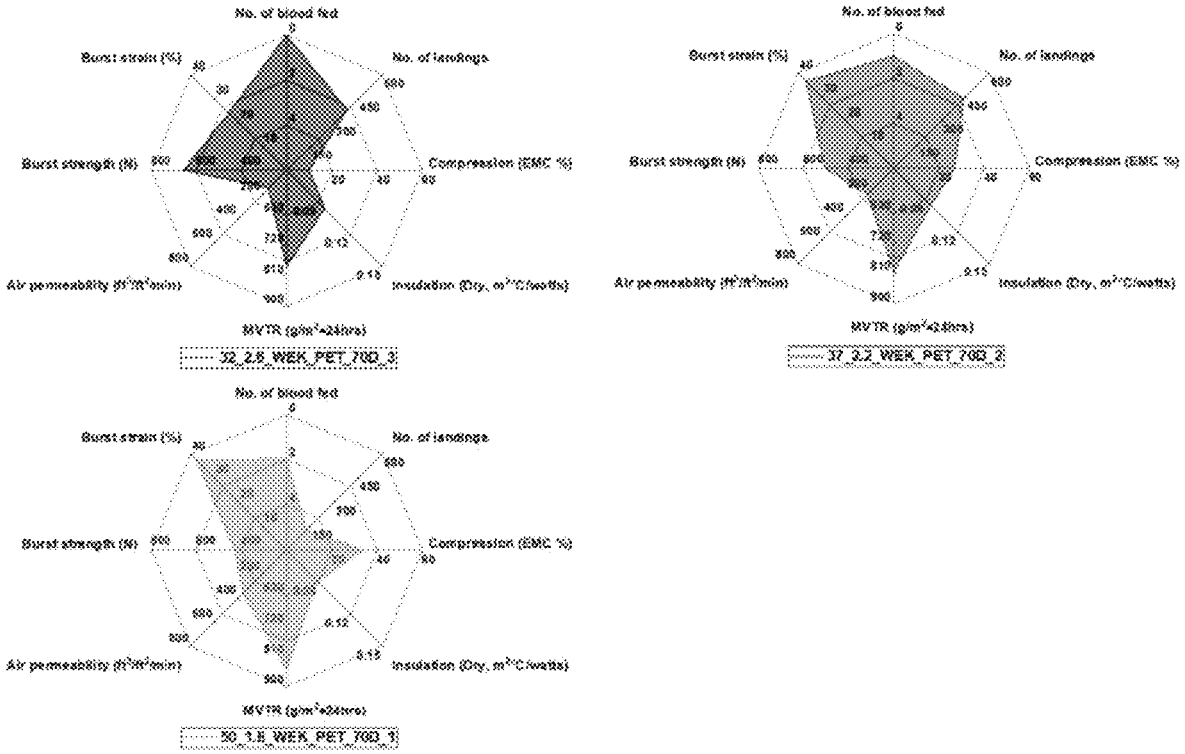
FIGS. 51A-B show the performance of each Case 2 fabric: (51A) weft knit tuck fabrics; (51B) weft knit spacer fabrics.
Figure 51B:
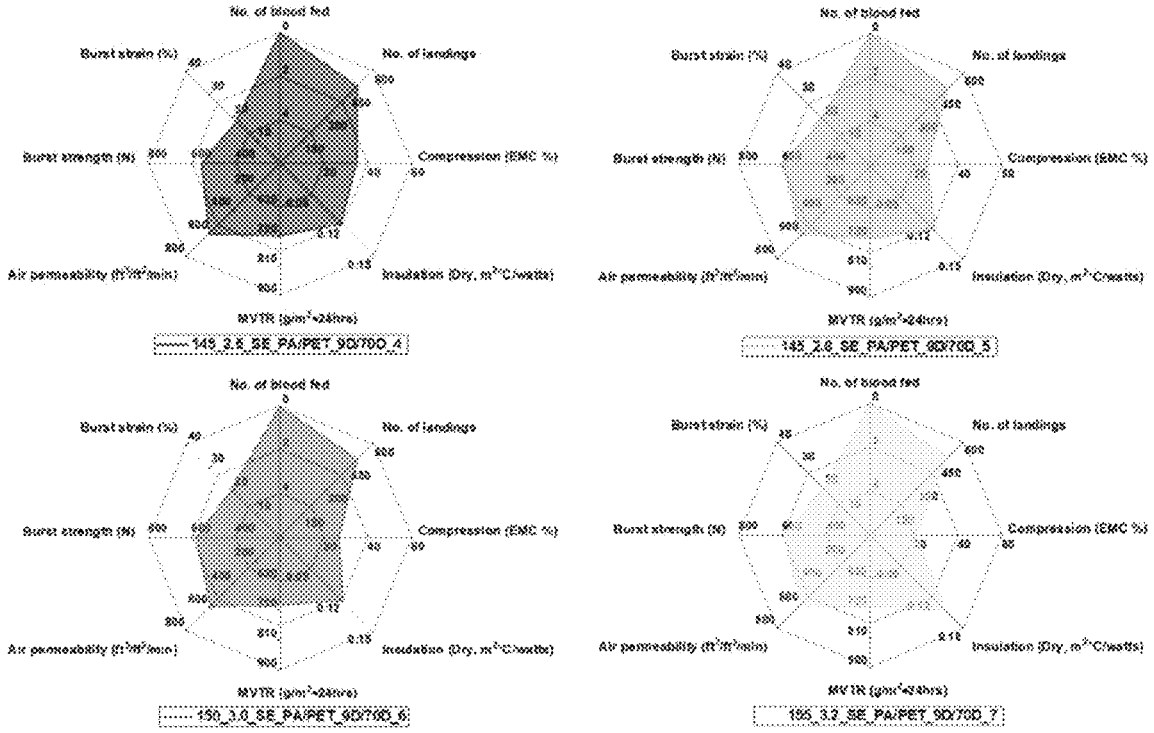
Figure 52A:
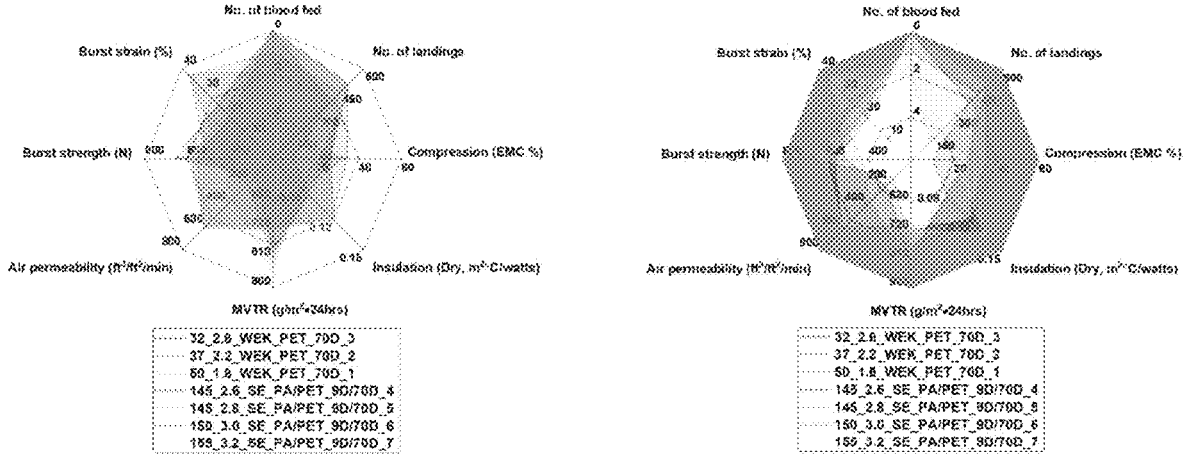
FIGS. 52A-C show the performance range for Case 2 fabrics: (52A) Superimposition of all radar charts for Case 2 fabrics; (52B) Extracting maximum values and drawing continuous loops; (52C) Representation of performance range as area between loops.
Figure 52B:
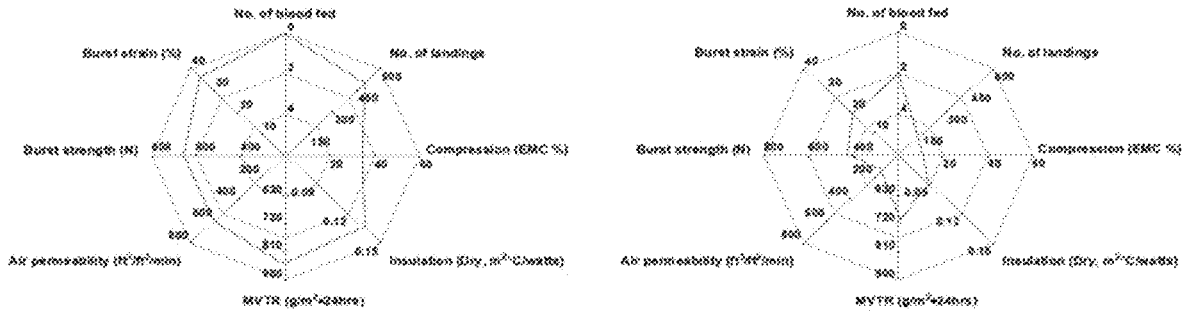
Figure 52C:
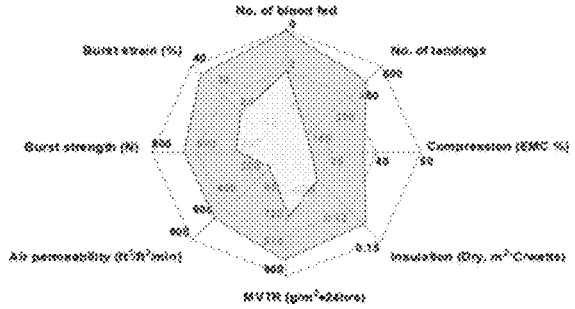

A computerized flat knitting machine (SRY123 LP; Shima Seiki) was used for pattern design and fabric production. Tuck stitches were involved into the pattern to create thicker and wider meshes in technical back. The meshes form spaces among loops to form a weft spacer knit. For this pattern of weft spacer fabric, the yarn count of the top surface was changed to obtain the different combinations of pore size and thickness. Yarn counts of weft spacer fabrics are 70 D×2 ends, 70 D×3 ends, and 70 D×4 ends, respectively. Pore sizes of these weft spacer fabrics fall at the lower end of the range of Case 2 fabrics, as shown in FIG. 6B. In other words, these fabrics can be utilized to evaluate the predicted curve for the low thickness, low pore diameter range of Case 2 fabrics. FIGS. 51A-B show performances of Case 2 fabrics. All of these fabrics show high bite resistance. They show lower moisture and air permeability than the Case 1 fabrics. Weft knit tuck fabrics have higher MVTR than weft knit spacer fabrics. FIGS. 52A-C show the process for determining the range of performance criteria for Case 2 fabrics. Minimum and maximum values for Case 2 fabrics are shown in Table 5.

In brief, weft spacer fabrics for Case 2 include:

(1) 50_1.8_WEK_PET_70D_1

(2) 37_2.2_WEK_PET_70D_2

(3) 32_2.6_WEK_PET_70D_3

TABLE 5

Minima and maxima of performances for Case 2

| | Performances | Unit | Minima | Maxima |
|---|---|---|---|---|
| Bioassay test | No. of blood fed | — | 0 | 2 |
| | No. of landings | — | 125 | 500 |
| Comfort evaluations | Compression (EMC) | % | 10 | 35 |
| | Insulation (Dry) | $m^2$°C/watts | 0.089 | 0.133 |
| | MVTR | $g/m^2 \cdot 24hrs$ | 707 | 850 |
| | Air permeability | $ft^3/min/ft^2$ | 152 | 610 |
| Durability | Burst strength | N | 429 | 656 |
| | Burst strain | % | 18.65 | 37.66 |

3-D Spacer Fabric

Two representative variations 3-D spacer fabrics were used to evaluate the model for both Case 2 and Case 3. The first variation was produced for the present disclosure with the same structure but different thicknesses. The second variation were commercial spacer fabrics with different structures and thus different surface patterns, as well as different combinations of pore size and thickness.

For the first variation, a circular double-bed knitting machine (OVJA 1.6E 3wt; Mayer & Cie) was used for producing 3-D weft knitted spacer fabrics. This machine has individual needles on the cylinder and high & low butt selection on the dial. Yarn counts of PA yarns and PET yarns are 9 D and 70 D, respectively. The machine gauge was changed from 1.0 to 2.8 and the surface and bottom pattern were kept the same. The thickness ranged between 1.7 mm and 3.2 mm. From the predicted combinations, it can be found that the spacer fabrics produced with machine gauge setting of 1.5, 1.6, 1.7, 1.8, 2.0, 2.2 and 2.4 have thicknesses of 2 mm, 2.2 mm, 2.4 mm, 2.6 mm, 2.8 mm, 3.0 mm and 3.2 mm, respectively, which are located in the middle part of the range of pore sizes and thicknesses for Case 2 fabrics. The bioassay results for these fabrics were compared with the predicted bite resistance in the model.

The second variation of 3-D spacer fabrics were commercial products with different structures. The surface (top and bottom) yarns are PA filament tows, and pile yarns in the middle are PA monofilaments. Evaluation of their bite-proof capability and comparison to the predictive model was the basis for further design and development of fabric prototype. These fabrics had pore sizes and thicknesses that fell within the ranges for both Case 2 and Case 3, and specifically, fall within the upper ranges for Case 2, and lower and middle ranges for Case 3. The surface structures for these fabrics are shown in FIGS. 11A-11D. The diversity of the patterns illustrate the wide array of possibilities for structural optimization of potential 3-D bite-proof fabrics.

In brief, 3-D warp & weft spacer fabrics developed for Case 2 and Case 3 evaluations include:

(1) 120_2_SE_PA/PET_9D/70D_1

(2) 130_2.2_SE_PA/PET_9D/70D_2

(3) 140_2.4_SE_PA/P ET_9D/70D_3

(4) 145_2.6_SE_PA/P ET_9D/70D_4

(5) 145_2.8_SE_PA/PET_9D/70D_5

(6) 150_3.3_SE_PA/PET_9D/70D_6

(7) 155_3.2_SE_PA/PET_9D/70D_7

(4) 370_2_SA_PA_SC 1502

(5) 510_2_SA_PA_SC044

(6) 700_2.5_SA_PA_SC082

(7) 1400_3_SA_PA_SC2119

Comfort Evaluation, Durability Assessment and Insect Bioassays

Thermophysiological comfort (air/moisture permeability) properties and durability (stretch, drape, flexing, softness, and surface friction) were characterized for the fabric prototypes. Insect bioassays were performed to validate their bite-proof efficiency.

Air Permeability

Figure 12:
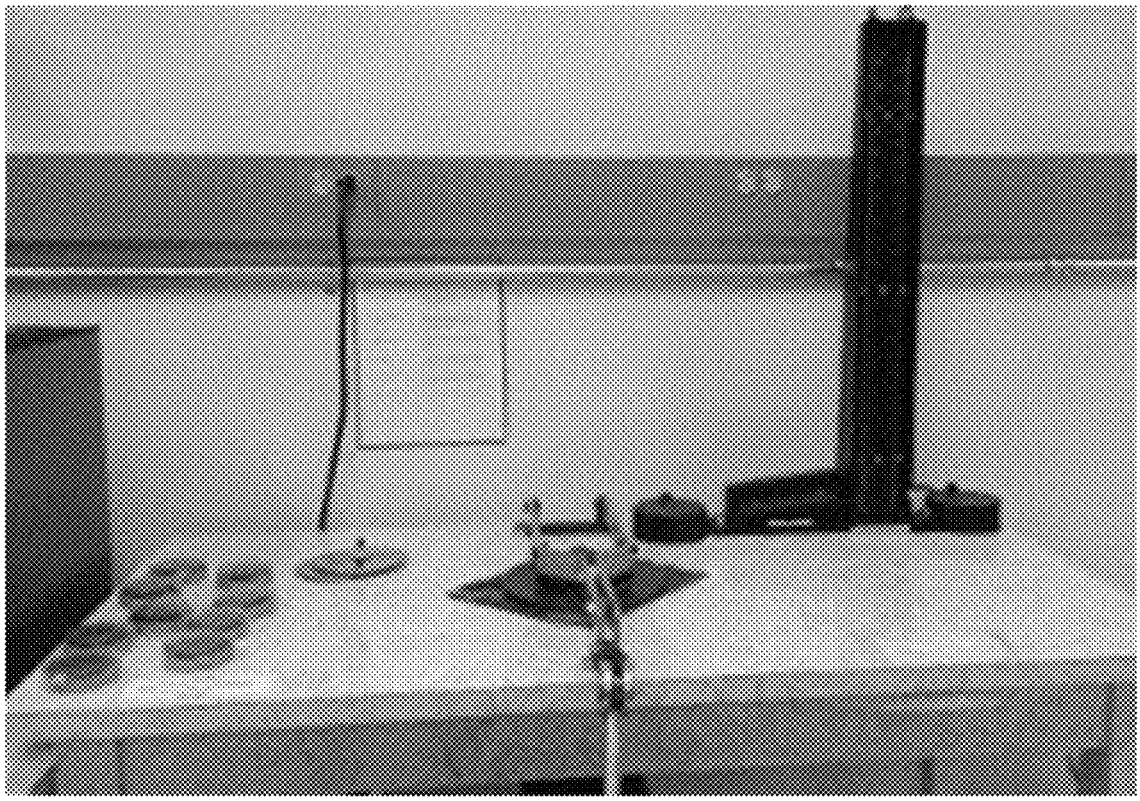
FIG. 12 is an image of the Frazier Air Permeability setup.
Figure 13A:
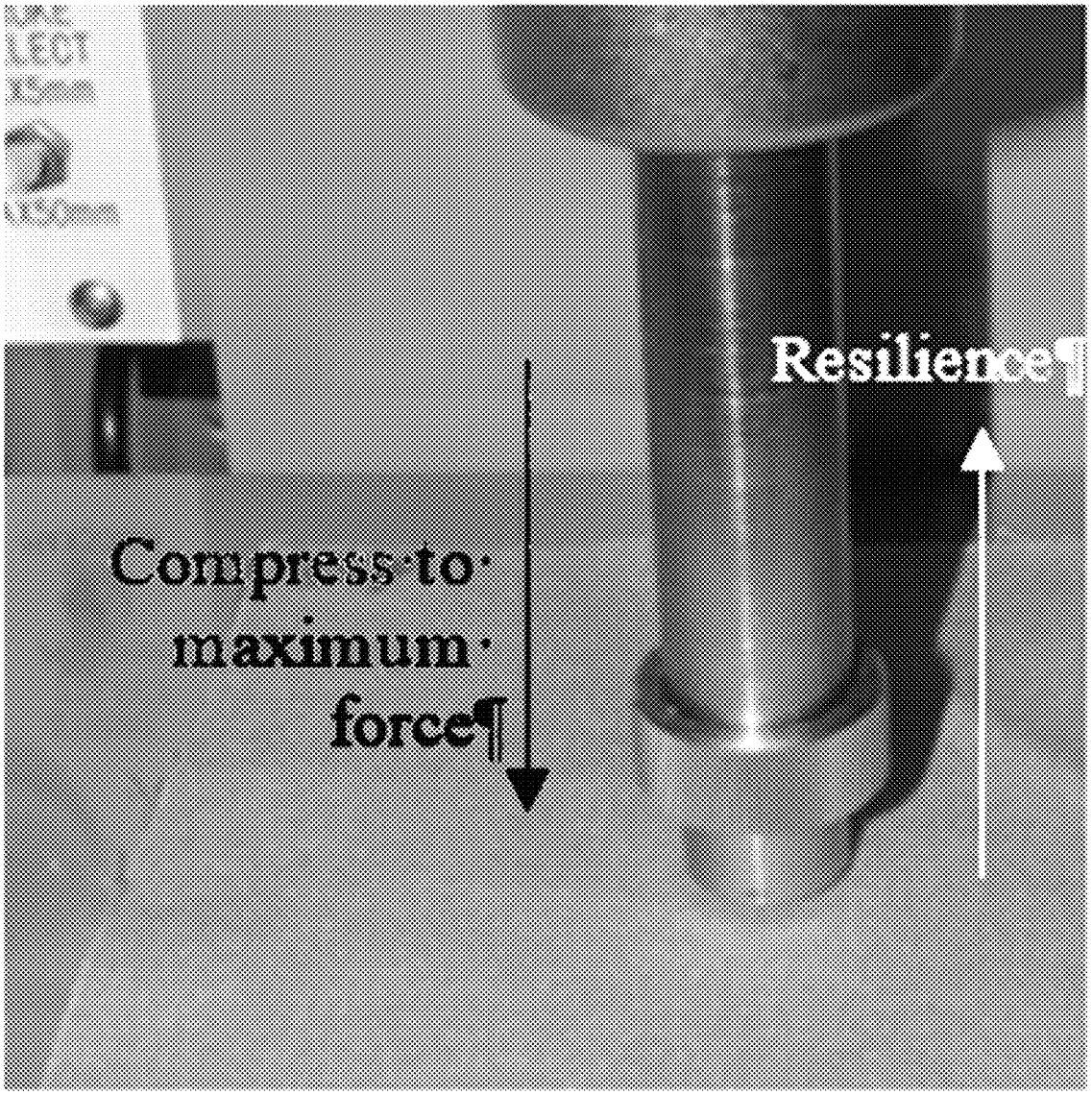
FIGS. 13A-13D are images of the Kawabata Evaluation System for compression (FIG. 13A), bending (FIG. 13B), friction (FIG. 13C), and shear (FIG. 13D).
Figure 13B:
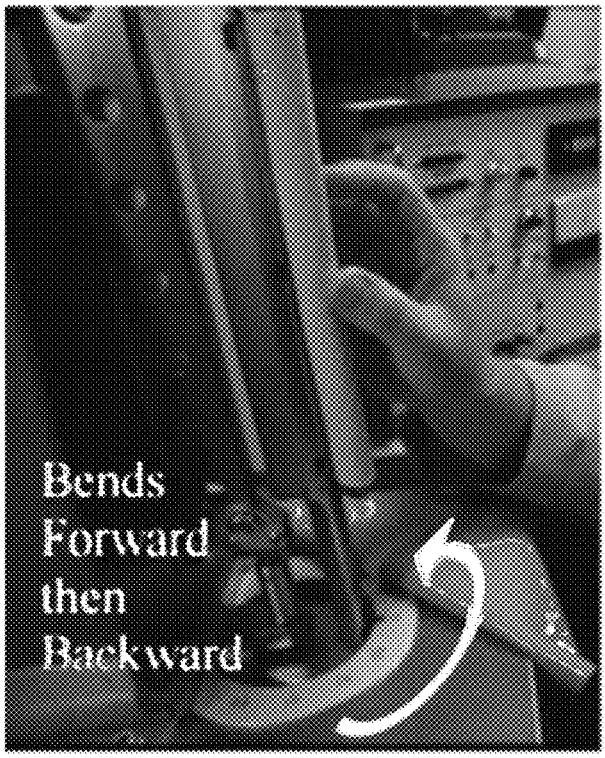
Figure 13C:
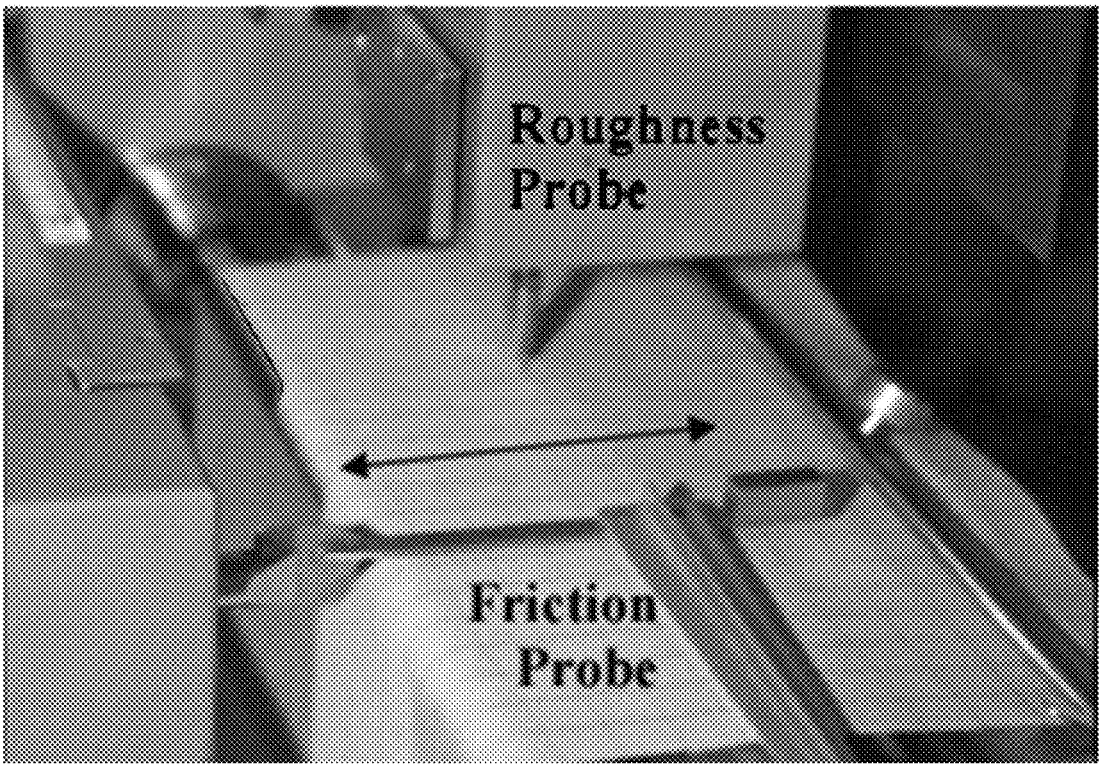
Figure 13D:
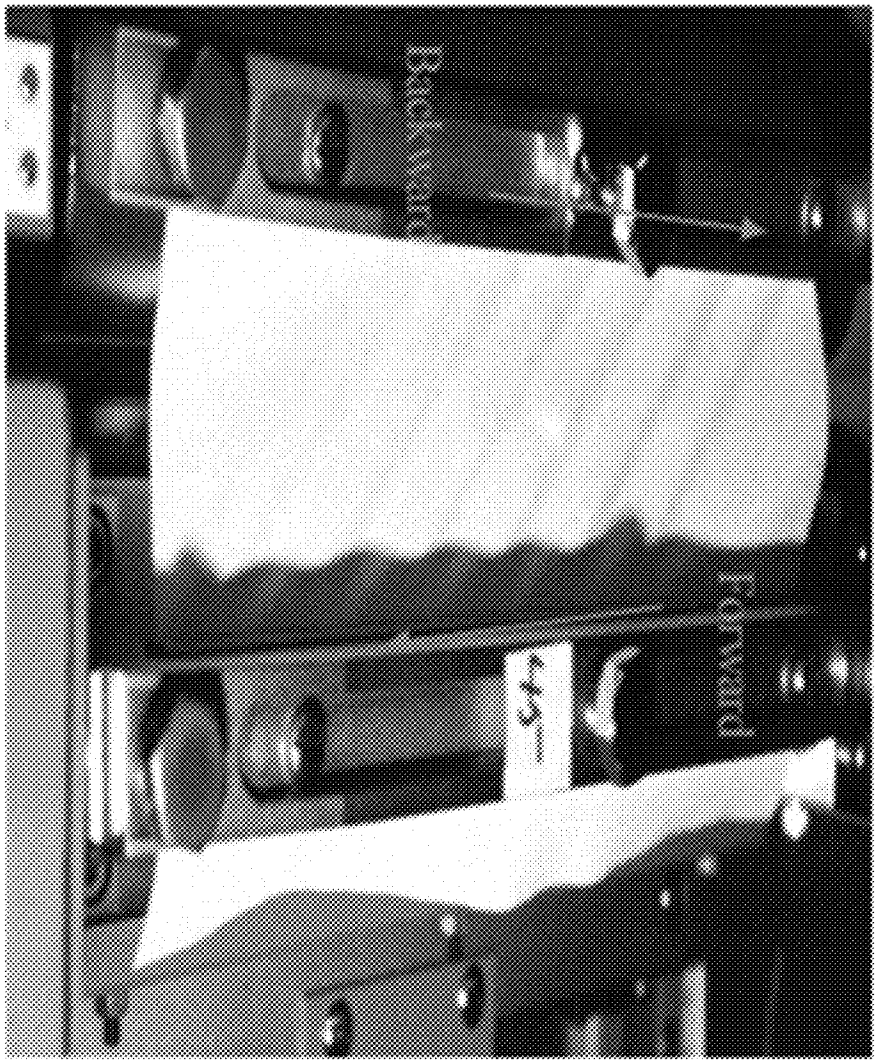

Air permeability of fabric can influence its comfort performance in several ways. First, a structure that is permeable to air is likely to be permeable to water and water vapor. Thus, the moisture vapor permeability and the liquid-moisture transmission are normally related to air permeability. Secondly, the thermal resistance is strongly dependent on the air captured within the fabric, and this is dominated by fabric structure. Bite resistance requires appropriate combinations of pore sizes and thicknesses, which also influence the air permeability, moisture management and thermal comfort. All prototype fabrics were evaluated by Frazier air permeability according to ASTM D737 as shown in FIG. 12.

Kawabata Evaluation System

The Kawabata Evaluation System (KES in FIGS. 13A-13D) is used to assess fabric tactile qualities through objective measurement of the mechanical properties related to comfort perception. KES provides a unique capability, not only to predict human response, but also to provide an understanding of how the variables of fiber, yarn, fabric construction and finish contribute to perceptions of comfort. With low forces applied, as in manipulating/touching fabrics, the Kawabata instruments define the role played by tensile (stretch), shear stiffness (drape), bending rigidity (flexing), compression (thickness, softness), and surface friction and roughness (next to skin) on tactile sensations.

Insect Bioassays

Figure 14A:
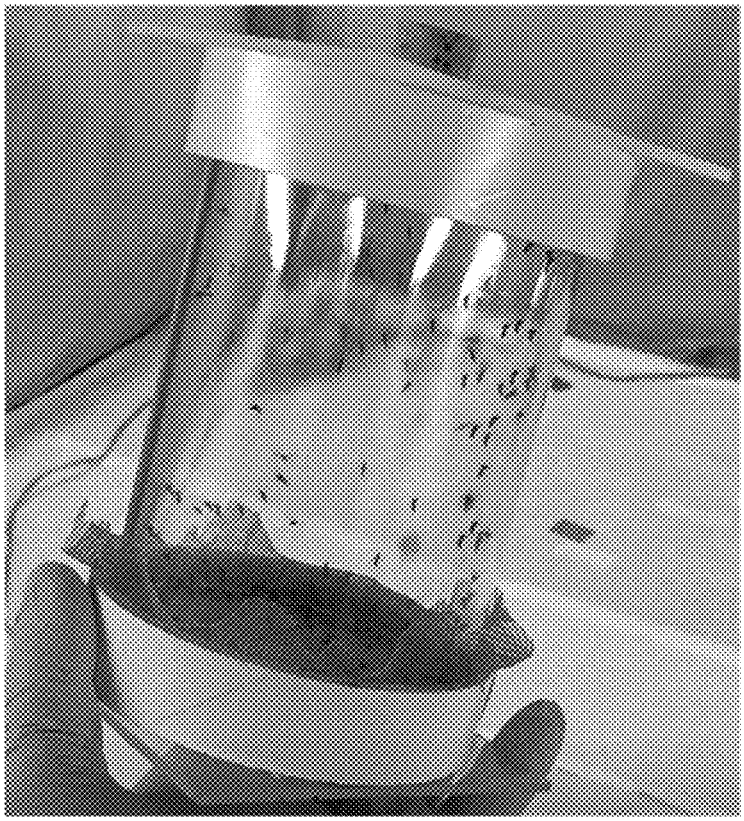
FIGS. 14A-14C are images of the arm-in-cage test of *Aedes aegypti* females.
Figure 14B:
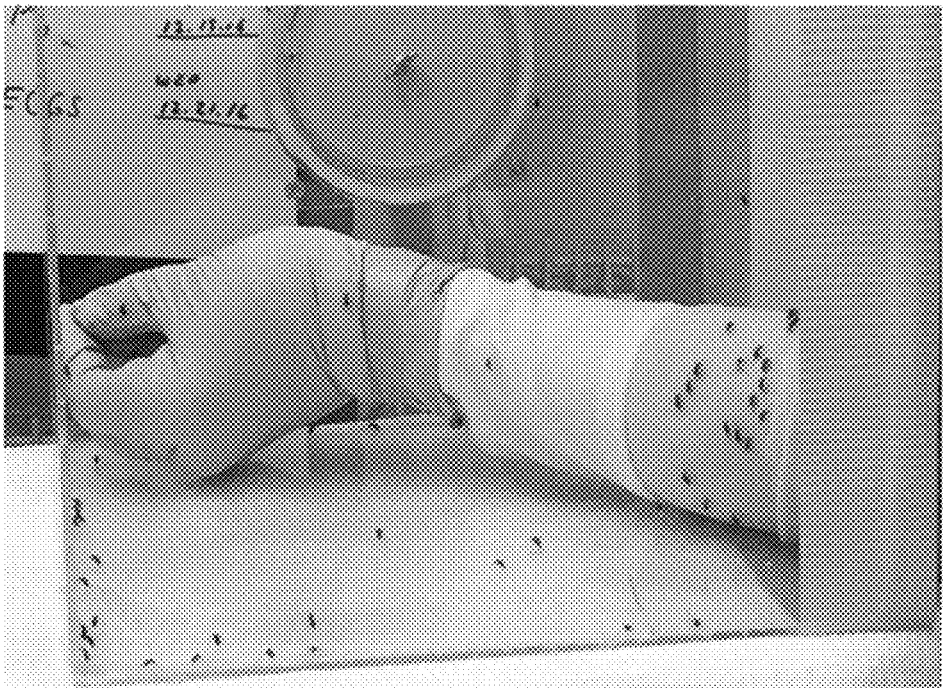
Figure 14C:
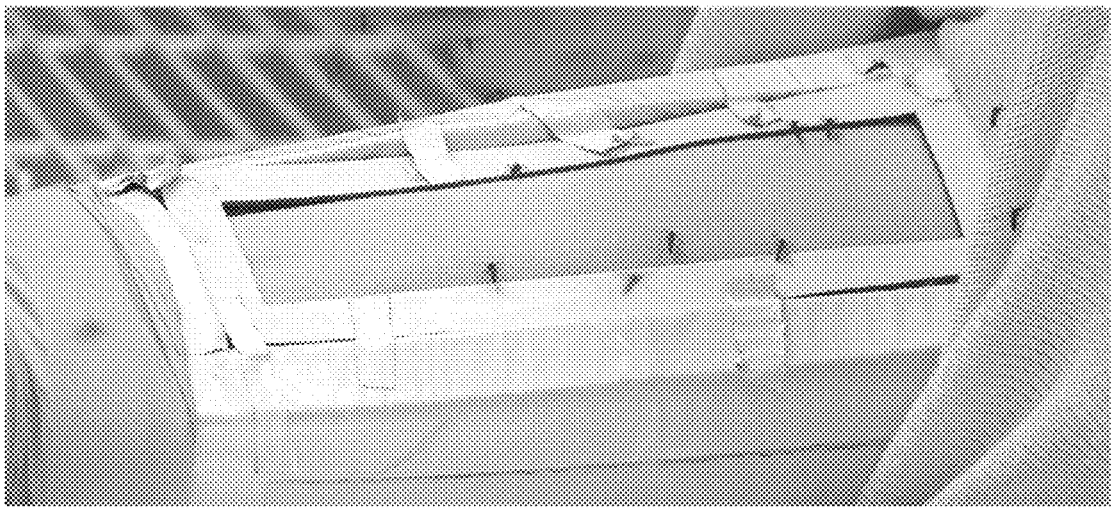

An in vivo testing device has been developed as shown in FIGS. 14A-14C. A frame was attached to a flexible substrate with adjustable wrapping length. The test sample was placed within the frame, which was then inserted within a window cut into a glove. When worn on an arm, exposure is limited to the window containing the fabric sample within the frame. The arm is then inserted into the test cage for an in vivo test. All prototype fabrics are evaluated in this device in order to collect human subject data to correlate with the model's predicted results.

One-hundred adult *Aedes aegypti* females between 5 to 10 days post-emergence were aspirated from colonies maintained in an insectary and transferred to a bioassay cage in FIG. 14A. Females were starved before they were tested (overnight for *Aedes aegypti*). The test cage volume is 40 cm×40 cm×40 cm in FIG. 14B and length×width of plastic frame in FIG. 14C is 14.5 cm×3.4 cm. The temperature of testing environment is 27-29° C. and the humidity is 75-80%.

Superfine Knit

Figure 15A:
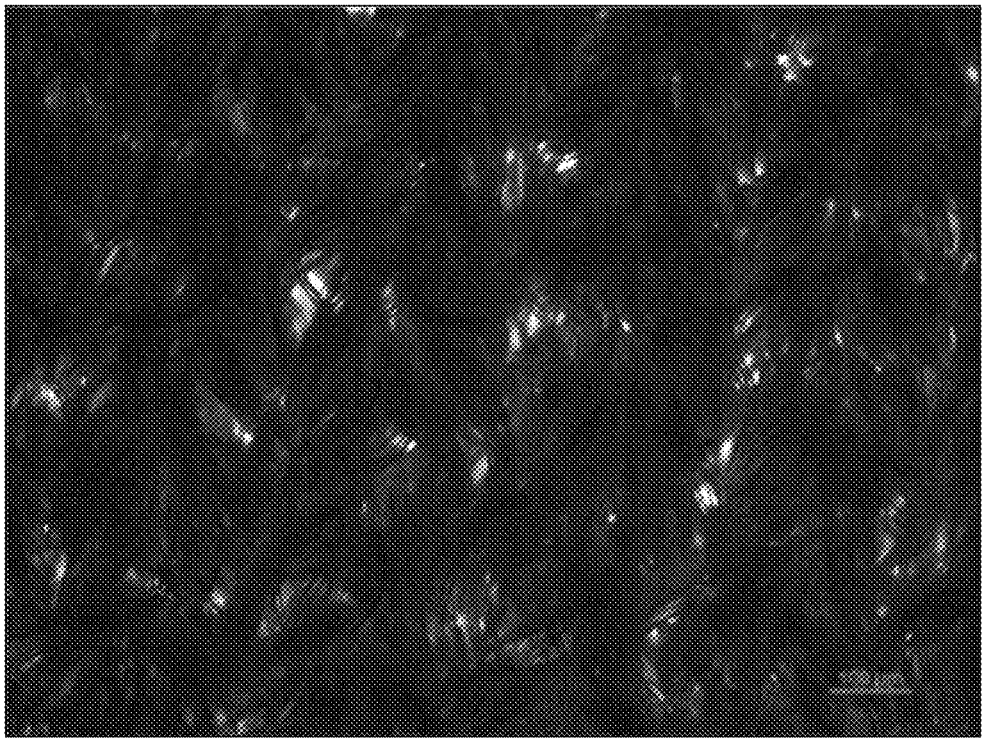
FIGS. 15A-15E depict results for the pore size calculation and distribution including a microscopic image (FIG. 15A), pore in black color (FIG. 15B), outline of pores (FIG. 15C) and pore distribution of 37_0.3_WEK_PA/PU_20D/15D_1 (FIG. 15D); and pore distribution of the same textile after heat setting (16_0.26_WEK_PA/PU_20D/15D_1H) (FIG. 15E).
Figure 15B:
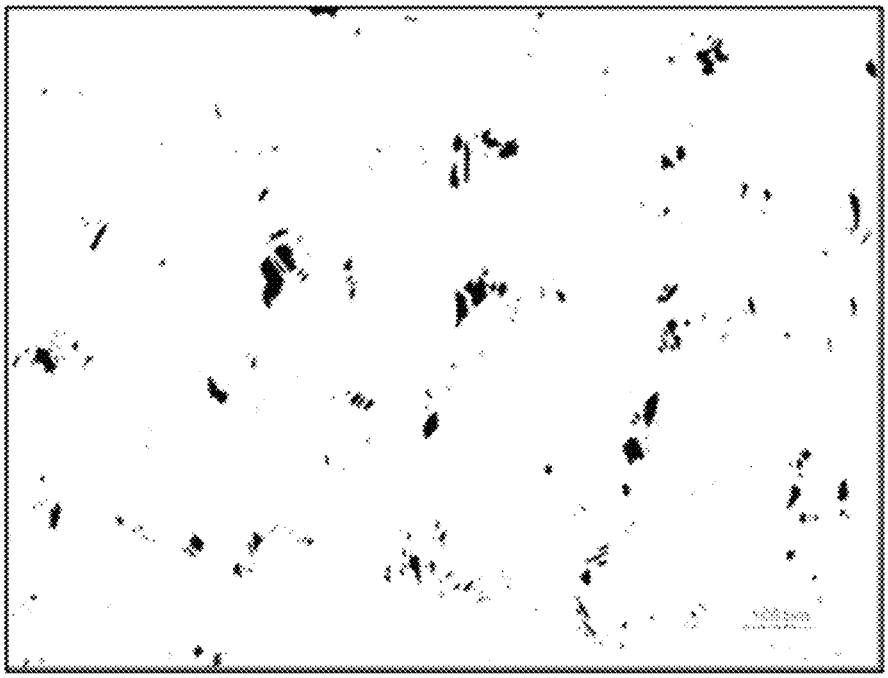
Figure 15C:
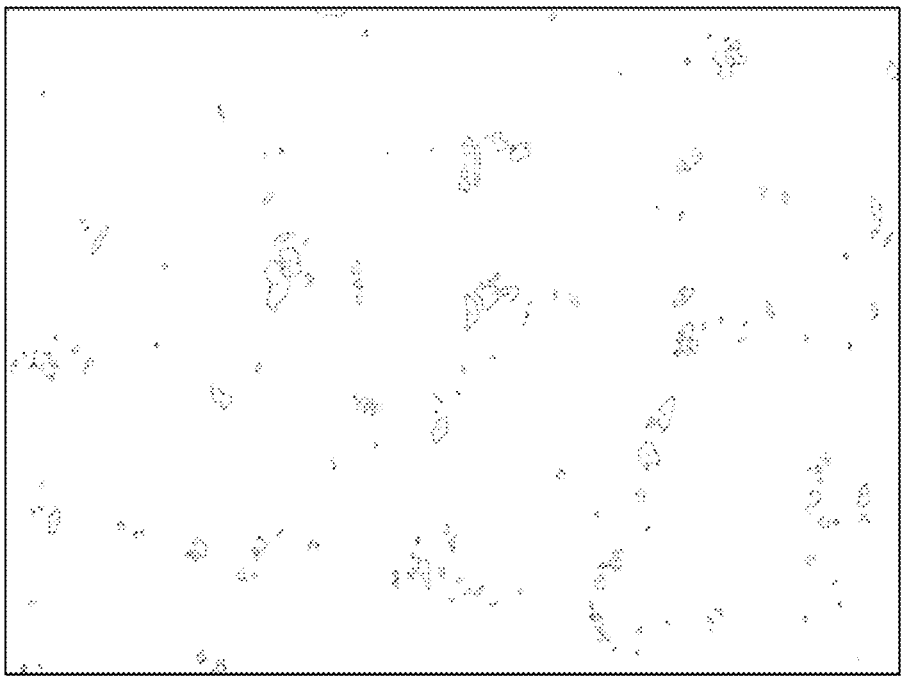
Figure 15D:
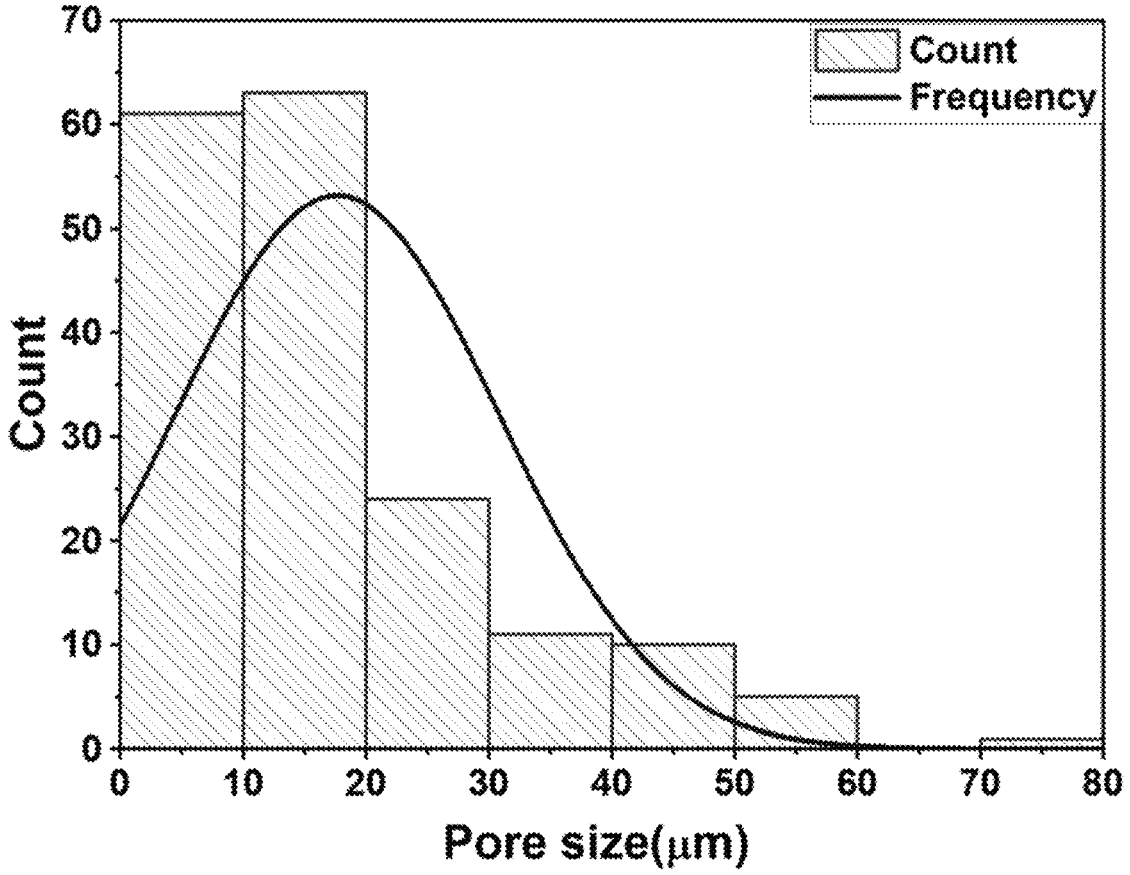
Figure 15E:
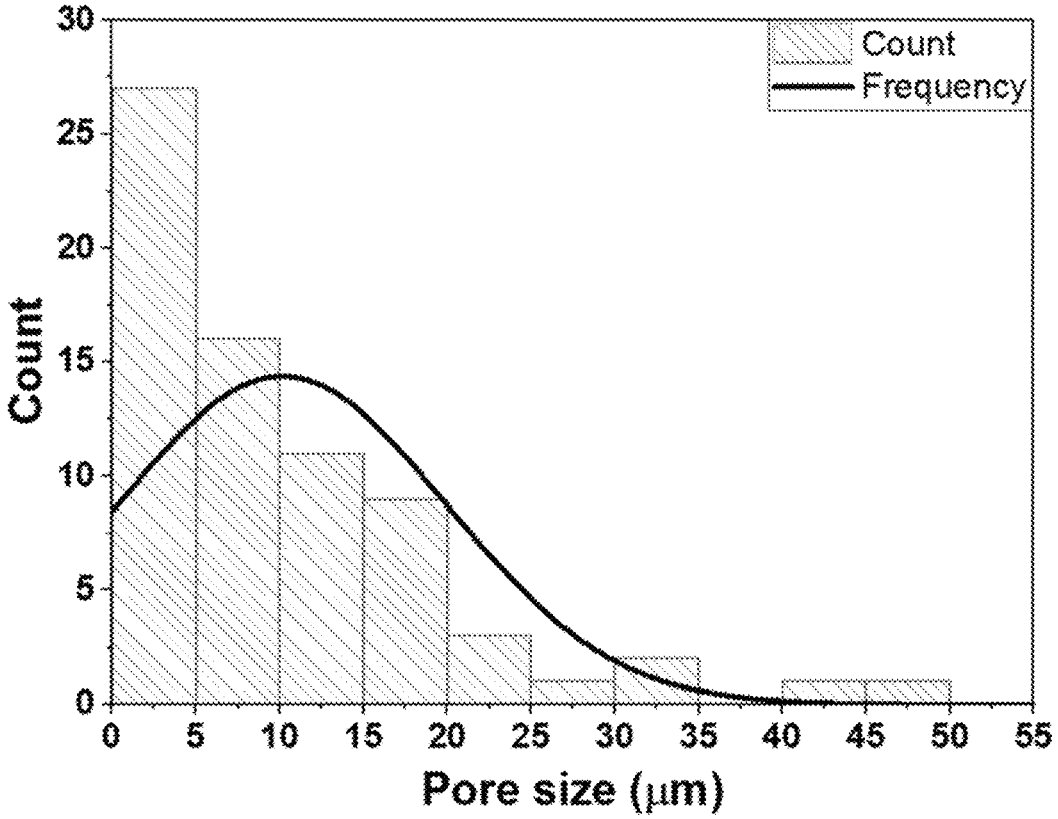

The pore sizes of the superfine knit fabrics were measured by Feret's statistical diameter along the longest direction of pore. As shown in FIGS. 15A-15E, the microscopic image was adjusted with a color threshold into black color in FIG. 15B, and then the outline of pore was obtained by area analyses. The longest diameters were calculated by this process to obtain the average pore size of superfine knit. The distribution of pore sizes is shown in FIG. 15D. The average pore size is about 37 μm. The frequency and count of pore sizes above 27.5 μm determine the bite-proof capacity of superfine knit within a certain range of thicknesses. Hence, an efficient way to improve the bite-proof capacity is to move the peak of frequency to the left, i.e., below 27.5 μm. Both heat setting and washing techniques were used to reduce the pore sizes and the fraction of larger pores in the superfine knit fabrics. In FIG. 15E, after heat setting was performed on fabric 37_0.3_WEK_PA/PU_20D/15D_1 (Temperature: 190° C., and duration time: 2mins), the peak of frequency moved to left and the pore count of pores above 27.5 um was reduced from 60 to 26. The pore size and pore count of 16_0.26_WEK_PA/PU_20D/15D_1H were significantly reduced and the fabric is expected to show better bite-resistance than the untreated fabric.

Air Permeability

Figure 17:
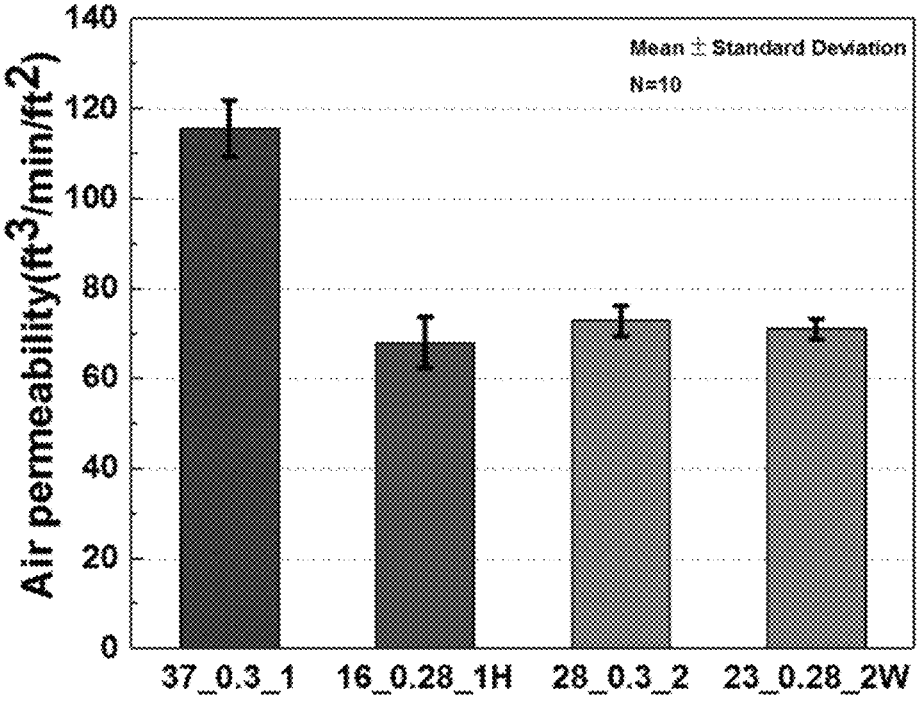
FIG. 17 is a graph of the air permeability of fabrics of Case 1.

FIG. 17 shows air permeability for four candidate fabrics. From comparison of them, the heat setting method can reduce air permeability by decreasing pore size and the air permeability keeps similar after washing.

Kawabata Evaluation System

The mechanical properties related to comfort perception of four prototyping fabrics were evaluated by KES testing. Because the fabric 23_0.28_WEK_PA/PU_20D/20D_2W was only mildly washed and the mechanical properties were not changed, only the results of the unwashed fabric (28_0.3_WEK_PA/PU_20D/20D_2*) are shown below.

As shown in Table 6, these candidate fabrics overall have lower bending rigidities. The increase in yarn count increases fabric stiffness and inelasticity. Heat setting can also increase the bending rigidity.

TABLE 6

KES Bending Data

| Sample ID | B[a] Bending Rigidity (gf·cm²/cm) | | 2HB[b] Hysteresis of Bending Momentum (gf·cm/cm) | |
|---|---|---|---|---|
| | L | C | L | C |
| 37_0.3_WEK_PA/PU_20D/15D_1* | 0.0031 | 0.0040 | 0.0103 | 0.0097 |
| 16_0.26_WEK_PA/PU_20D/15D_1H* | 0.0049 | 0.0047 | 0.0081 | 0.0072 |
| 28_0.3_WEK_PA/PU_20D/20D_2* | 0.0074 | 0.0055 | 0.0119 | 0.0108 |
| 23_0.28_WEK_PA/PU_20D/20D_2W* | N/A | N/A | N/A | N/A |

Note: L = lengthwise direction;

C = crosswise direction [a] Higher B value indicates greater stiffness/resistance to bending motions.

[b]A larger 2HB value means greater fabric inelasticity.

*Sample size was reduced to 10 cm² to perform KES bend testing.

As shown in Table 7, the coefficient of friction means the surface roughness of fabric. The candidate fabrics have low friction and smooth surface with lower variations. Heat setting reduced the surface friction. The increase in yarn count makes the fabric smoother in lengthwise direction and keep same roughness in crosswise direction.

TABLE 7

KES Surface Data - 20 gf/cm

| Sample ID | MIU[a] Coefficient of Friction (—) | | MMD[b] Mean Deviation of MIU (—) | | SMD[c] Geometric Roughness (micron) | |
|---|---|---|---|---|---|---|
| | L | C | L | C | L | C |
| 37__0.3__WEK__PA/PU__20D/15D__1 | 0.0888 | 0.0683 | 0.0031 | 0.0021 | 1.0264 | 0.8439 |
| 16__0.26__WEK__PA/PU__20D/15D__1H | 0.0666 | 0.0649 | 0.0024 | 0.0022 | 1.0898 | 0.7538 |
| 28__0.3__WEK__PA/PU__20D/20D__2 | 0.0775 | 0.0686 | 0.0028 | 0.0024 | 0.9942 | 0.7805 |
| 23__0.28__WEK__PA/PU__20D/20D__2W | N/A | N/A | N/A | N/A | N/A | N/A |

Note:

L = lengthwise direction;

C = crosswise direction

[a]Values from 0 to 1 with higher values corresponding to higher friction.

[b]Higher value corresponds to larger variations of friction.

[c]Higher values mean a geometrically rougher surface.

Table 8 shows the KES shear data for Case 1 fabrics. The shear stiffnesses are relatively low, and they have low resistance to shearing moment. This means the fabrics are easily deformed by small torsion in practical usage.

TABLE 8

KES Shear Data

| Sample ID | G[a] Shear Stiffness (gf/cm · Degree) | | 2HG Hysteresis of Shear Force @ 0.5 Degrees of Shear Angle (gf/cm) | | 2HG5 Hysteresis of Shear force @ 5.0 degree of Shear Angle (gf/cm) | |
|---|---|---|---|---|---|---|
| | L | C | L | C | L | C |
| 37_0.3_WEK_PA/PU_20D/15D_1 | N/A | 0.2106 | N/A | 0.0021 | N/A | 0.4636 |
| 16_0.26_WEK_PA/PU_20D/15D_1H | 0.2021 | 0.2123 | 0.5799 | 0.5843 | 0.4391 | 0.4208 |
| 28_0.3_WEK_PA/PU_20D/20D_2 | N/A | 0.3027 | N/A | 0.7425 | N/A | 0.5272 |
| 23_0.28_WEK_PA/PU_20D/20D_2W | N/A | N/A | N/A | N/A | N/A | N/A |

Note:
L = lengthwise direction;
C = crosswise direction
[a]Higher value means greater stiffness/resistance to shearing movement.

Insect Bioassays

Figure 18:
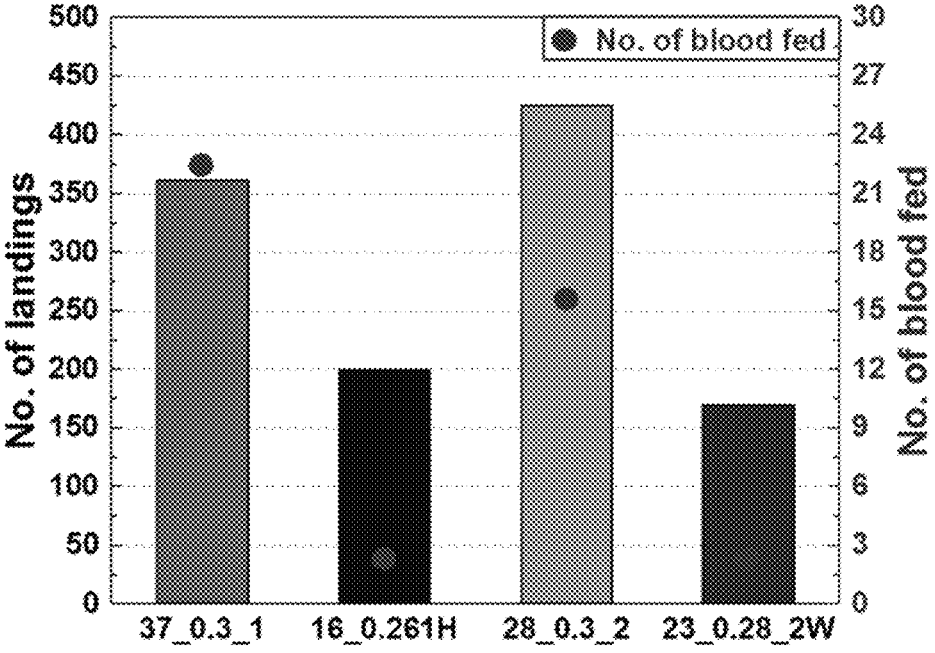
FIG. 18 is a graph of the results of insect bioassay of superfine knit for Case 1.

FIG. 18 shows the insect bioassay results of candidate fabrics of Case 1. As mentioned above, the number of landings is dependent on detection of host cues and is also related to the number of blood of blood feedings (mosquitoes will continue to hop and land if they sense the olfactory cues but are unable to access the skin to take a blood meal). After heat setting and washing, some of pores were much smaller, and the mosquitoes had decreased ability to detect host cues, and therefore, numbers of landings decreased.

Figure 16A:
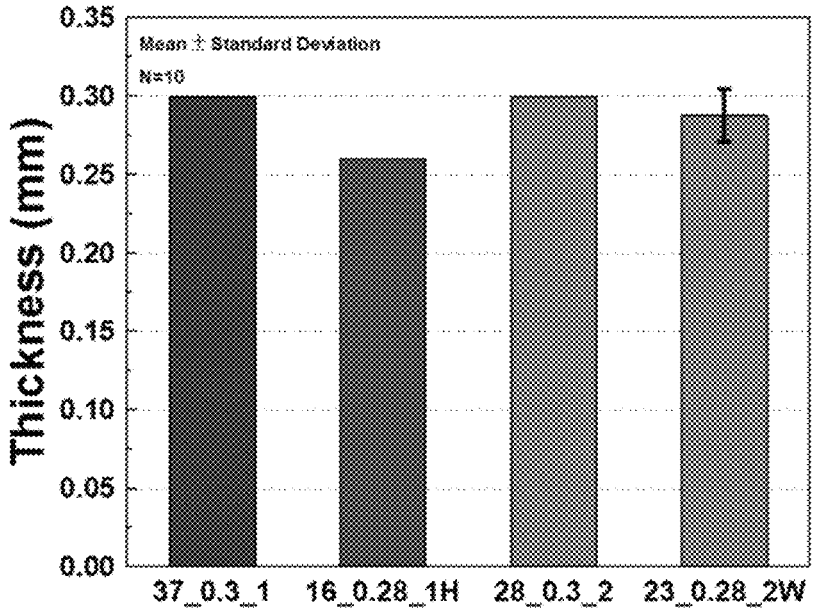
FIGS. 16A-16C are graphs of the thickness (FIG. 16A), pore size (FIG. 16B), and the identification of the fabrics on the graph of the safe thickness versus pore size for *Aedes aegypti* (FIG. 16C) for fabrics of Case 1.
Figure 16B:
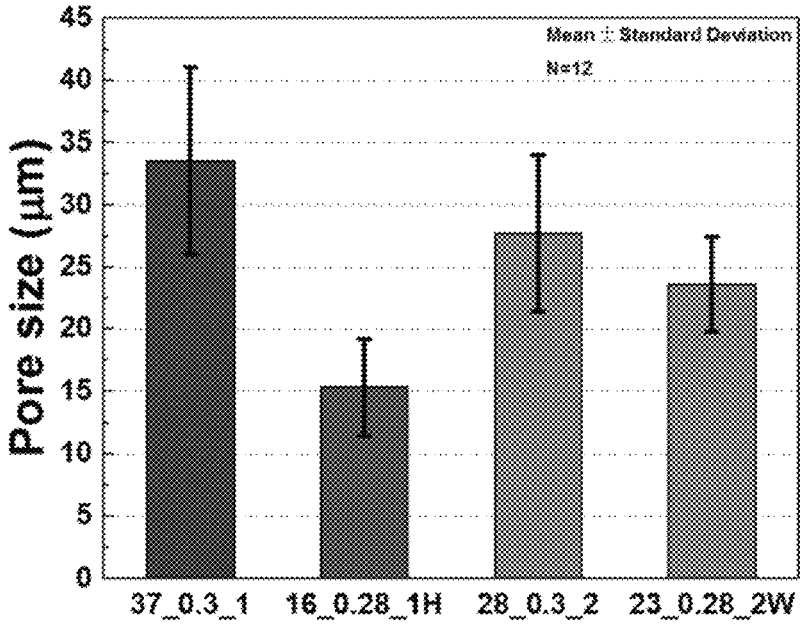
Figure 16C:
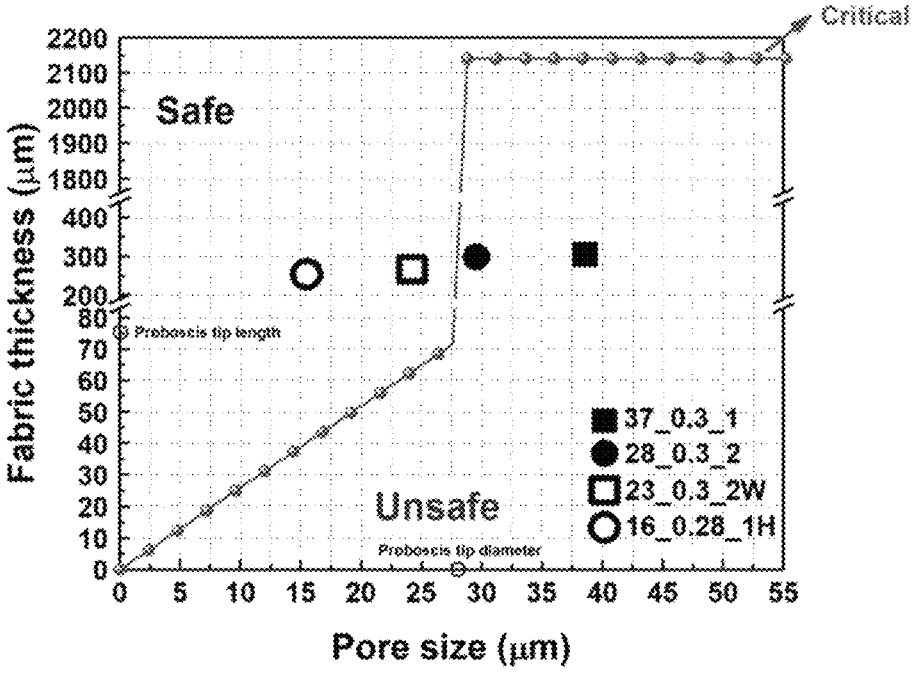

In addition, a reduction in the pore sizes of the superfine knits also reduces the number of blood fed mosquitoes, which increases bite-poof capacity. For non-treated fabrics, changing the yarn count from 15 D to 20 D of PU fiber makes the fabric have a larger area density with the same thickness, and therefore, the pore size was significantly reduced as shown in FIGS. 16A-16B, and thus number of blood fed decreased as shown in FIG. 18.

Overall, these candidate fabrics have good bite-proof capacity and suitable comfort-related properties for use in a variety of applications.

Weft Spacer Knit

Weft knit fabrics with different structures were designed and produced on a flat knitting machine. One of them having a proper combination of thickness and pore size was selected for a further investigation. In this structure, there are yarns that interlock the yarns of top surface and bottom surface together, so it is called a weft spacer knit. In each case by adding one end of yarn on the top surface, the yarn count increased from 140 D to 210 D and 280 D.

Figure 19A:
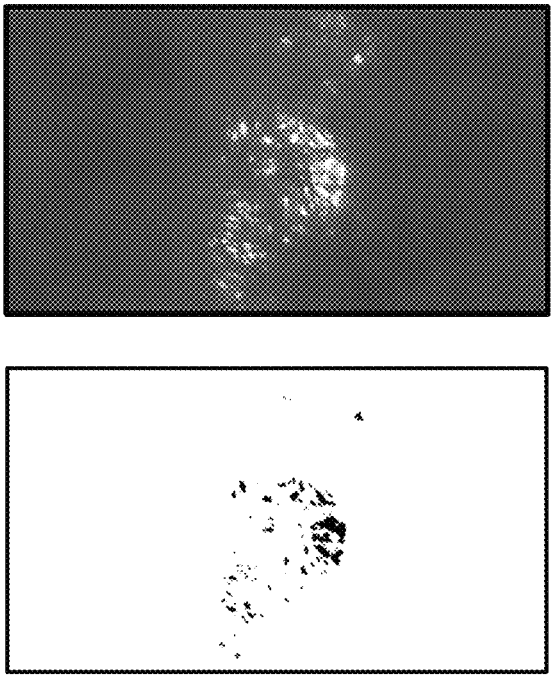
FIGS. 19A-19F depict results for the pore size calculation and distribution including a microscopic image (upper panels) and pore in black color (lower panels) for 50_1.8_WEK_PET_70D_1 (FIG. 19A), 37_2.2_WEK_PET_70D_2 (FIG. 19B), 32_2.6_WEK_PET_70D_3 (FIG. 19C); and graphs of the pore distributions of 50_1.8_WEK_PET_70D_1 (FIG. 19D); 37_2.2_WEK_PET_70D_2 (FIG. 19E); and 32_2.6_WEK_PET_70D_3 (FIG. 19F).
Figure 19B:
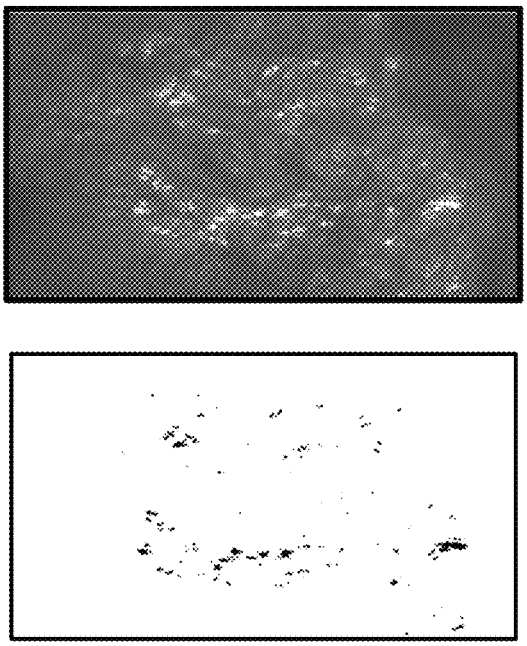
Figure 19C:
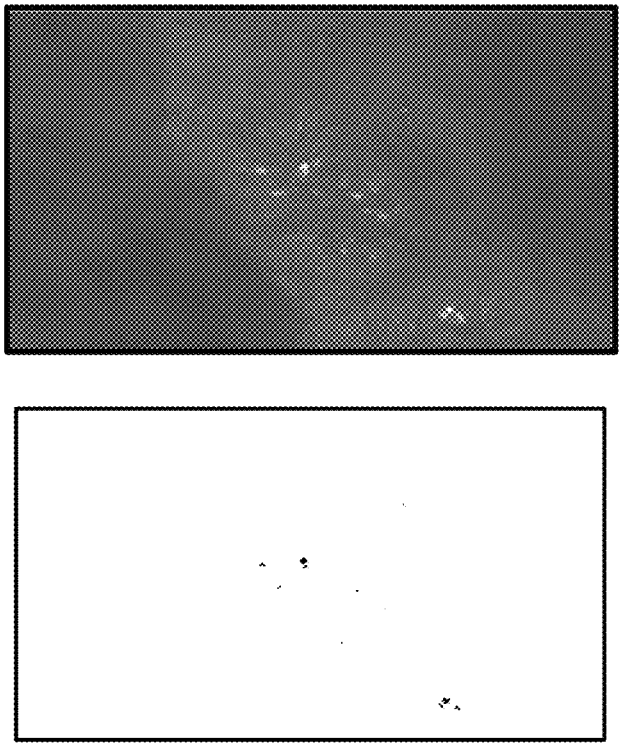
Figure 19D:
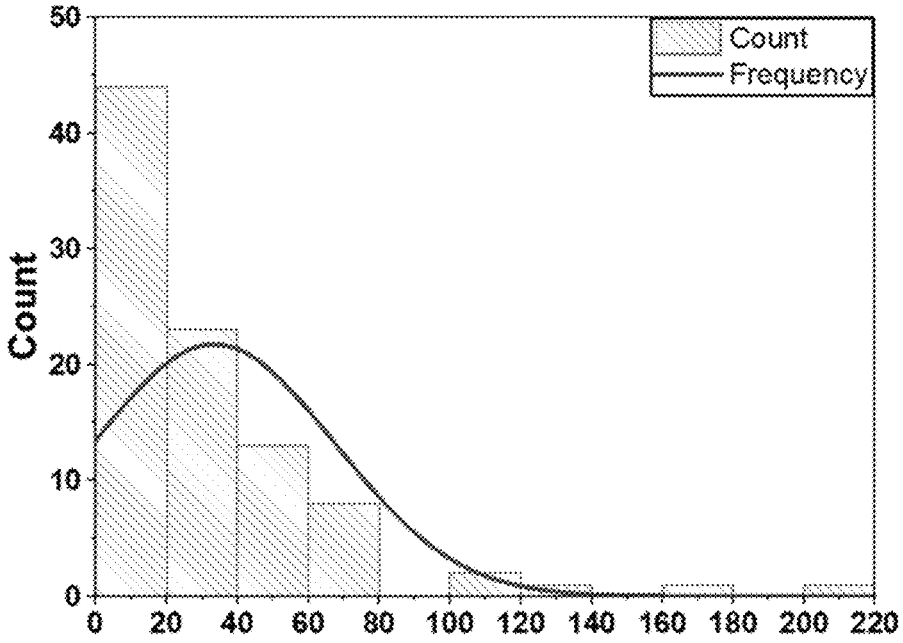
Figure 19E:
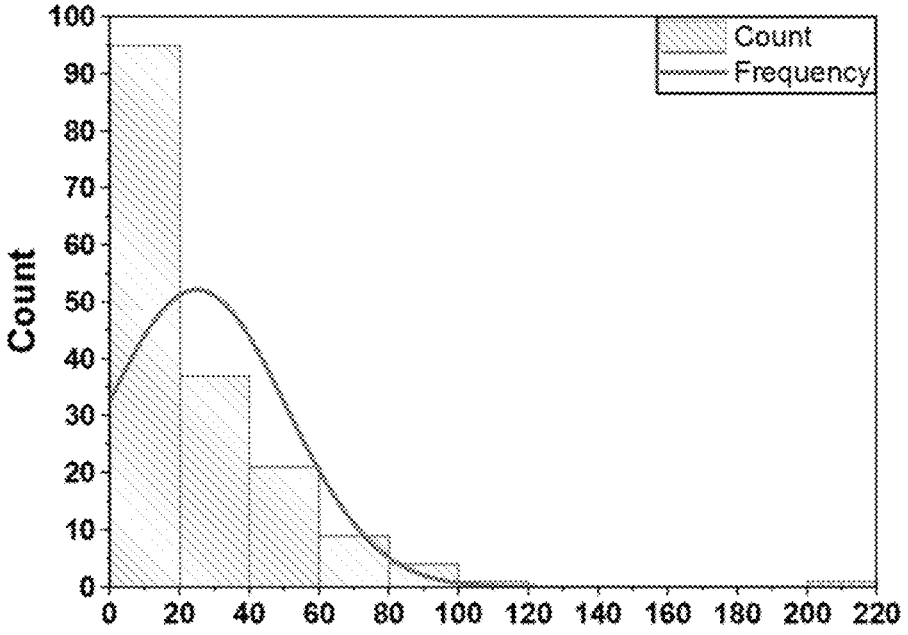
Figure 19F:
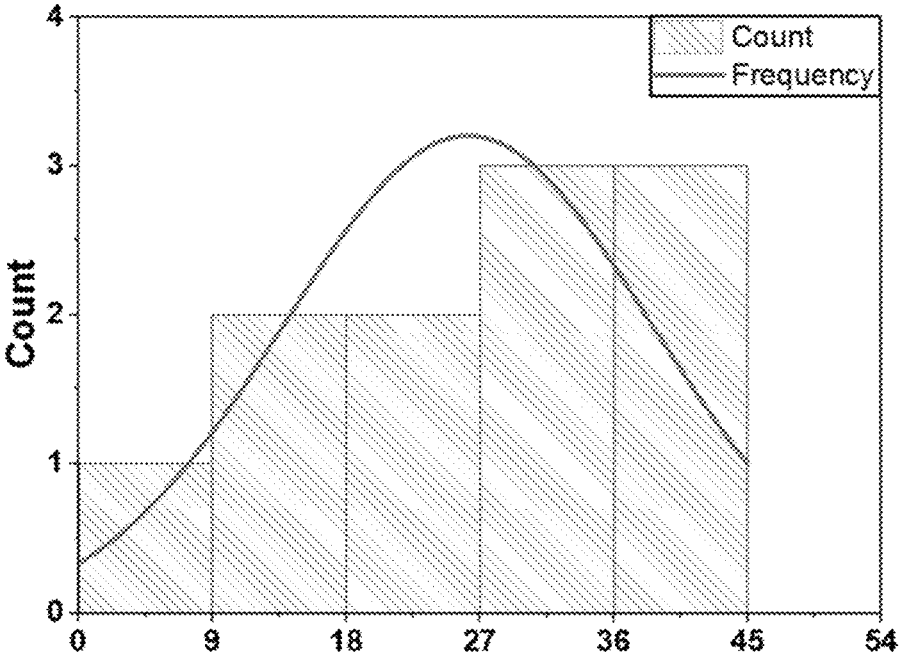

As shown in FIGS. 19A-19C, the porosity and pore area of the fabric decreases as yarn count decreases within this range when the knit process properties are kept constant. Based on the image analysis in FIGS. 19D-19F, the frequency peak moves to left and shrinks the pore area significantly. This was predicted to improve the bite-proof capacity of candidate prototype fabrics.

Figure 20A:
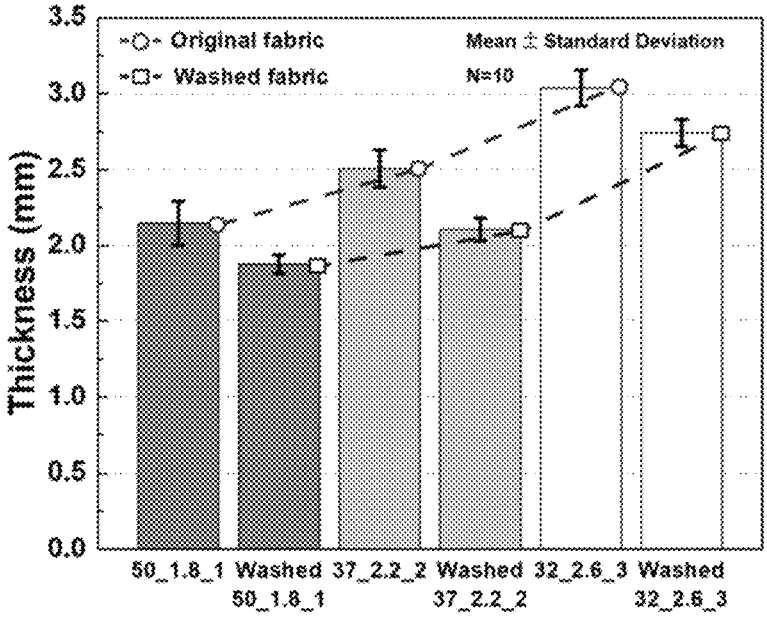
FIGS. 20A-20C are graphs of the thickness (FIG. 20A), pore size (FIG. 20B), and the identification of the fabrics on the graph of the safe thickness versus pore size for *Aedes aegypti* (FIG. 20C) for fabrics of Case 2.
Figure 20B:
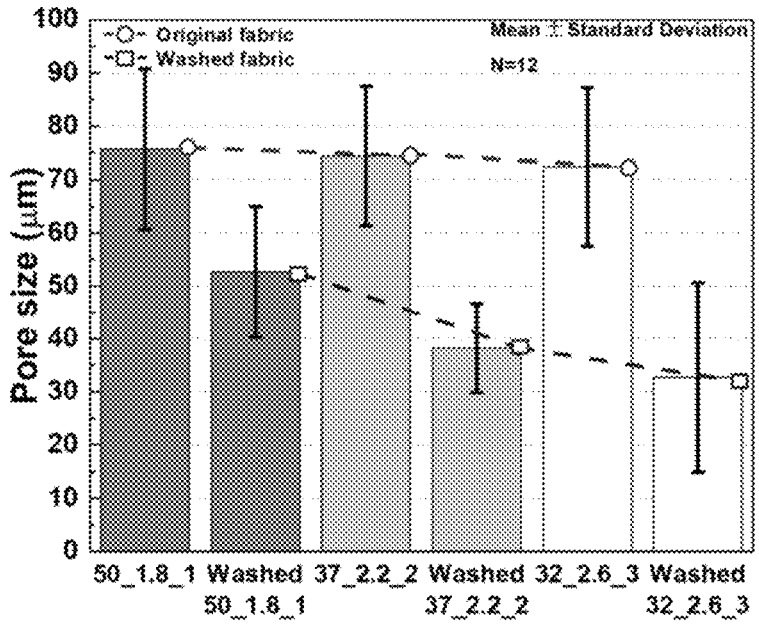
Figure 20C:
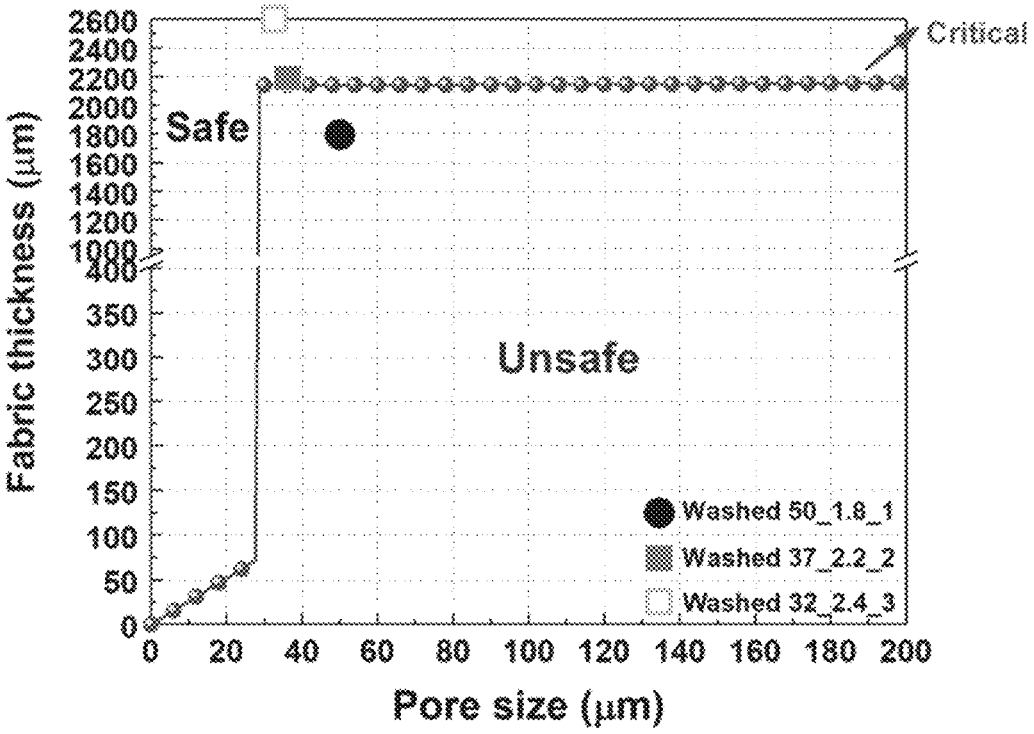

FIGS. 20A-20C show the thickness and pore size of weft spacer knits before and after washing. Both thicknesses and pore sizes decrease by washing. The range of thickness was reduced from 2.2-3.0 mm to 1.8-2.8 mm and range of pore size was reduced from 74-76 μm to 32-52 μm. For washed fabrics, the thickness increases and pore size decreases for yarn count increment. All three weft spacer fabrics are located at the beginning of the range of pores sizes and thicknesses for Case 2. Their combinations of thickness and pore size fall within the safe zone, unsafe zone and required zone, which is suitable for verification of predictive model.

Air Permeability

Figure 21:
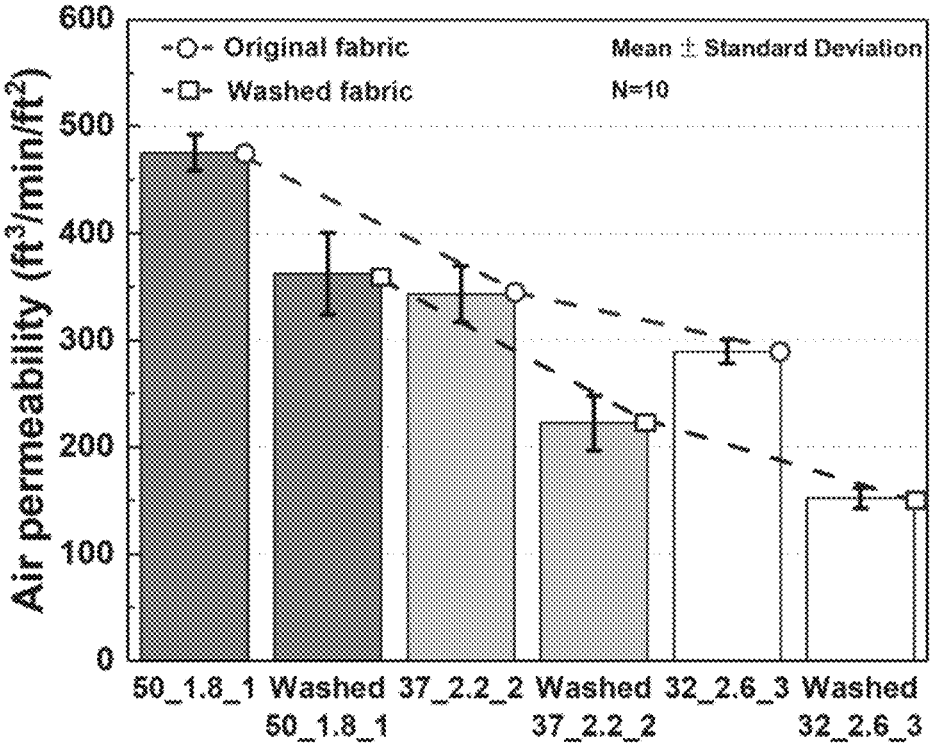
FIG. 21 is a graph of the air permeability of fabrics of Case 2.

FIG. 21 shows the air permeability of weft spacer knits. The increase in thickness and decrease in pore size for washed weft spacer knit resulted in decreases in air permeability r from 350 $ft^3/min/ft^2$ to 210 $ft^3/min/ft^2$ and 150 $ft^3/min/ft^2$.

Insect Bioassays

Figure 22:
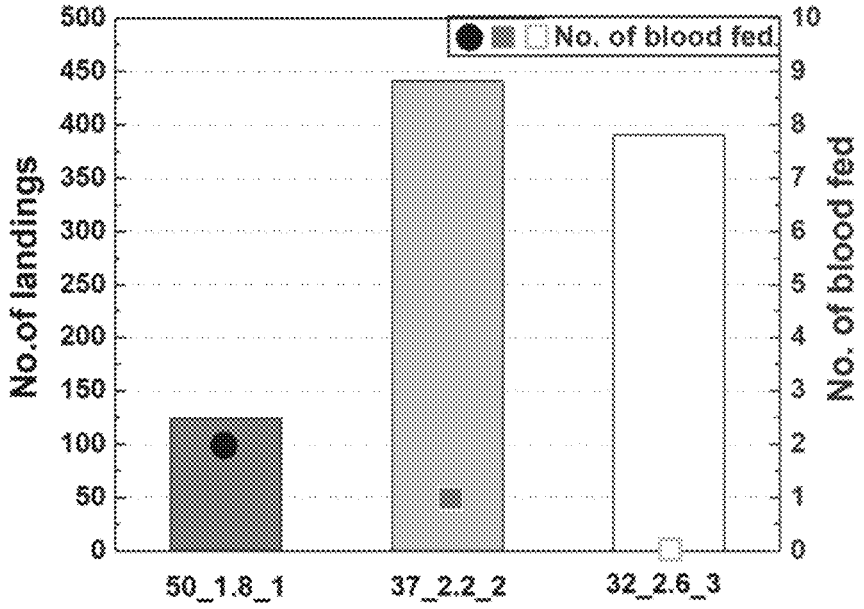
FIG. 22 is a graph of the results of insect bioassay of superfine knit for Case 2.

FIG. 22 shows results of the bioassay tests on the weft spacer knits. The bioassay results verify the accuracy of predictive model. The number of blood feeding instances was reduced to zero after increasing the yarn count. These spacer fabrics have excellent bite-proof capacity.

Warp Spacer Fabric

Warp spacer fabrics have greater structural variability than the weft spacer fabrics, and a wide range of combinations of thicknesses and pore sizes due to flexibility in selection of spacer yarn and surface pattern. In this task, two categories of warp spacer fabrics were characterized to verify the predictive model for Case 2 and Case 3. The first one is the warp spacer fabrics with different thicknesses. The second one is the warp spacer fabrics with different structures.

3-D Spacer Fabrics With Different Thicknesses

Figure 23A:
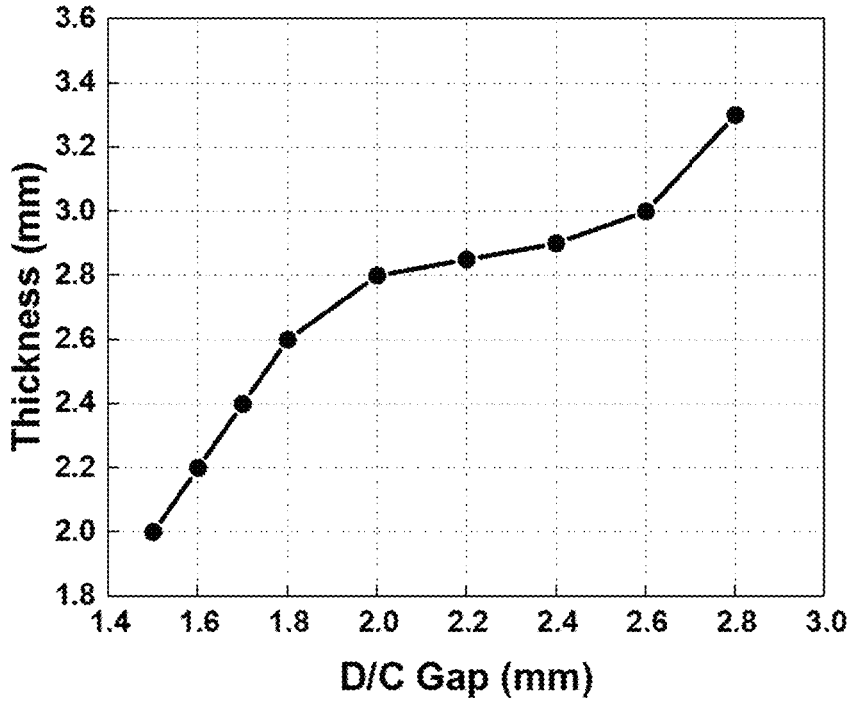
FIGS. 23A-23D are graphs of the basic parameters of 3-D spacer fabrics with different thicknesses.
Figure 23B:
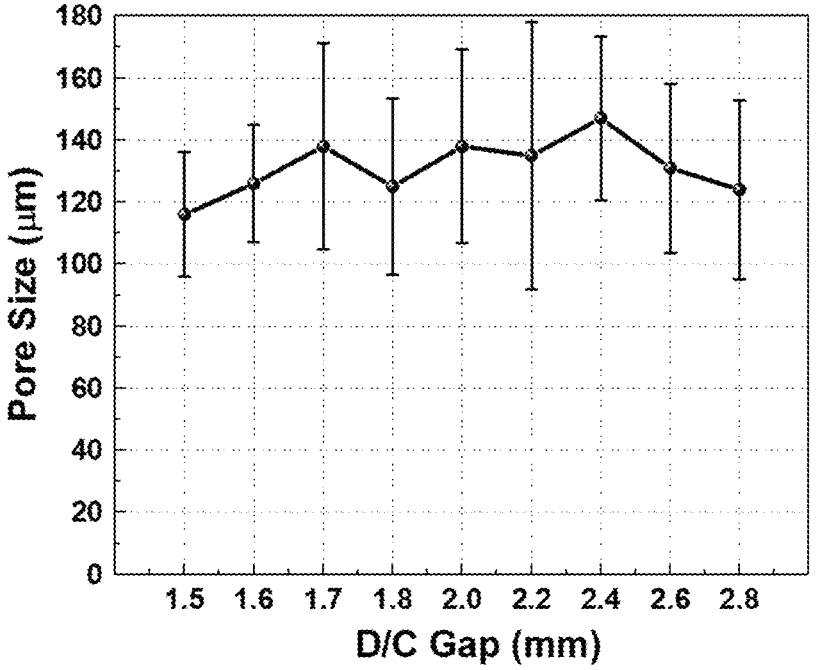
Figure 23C:
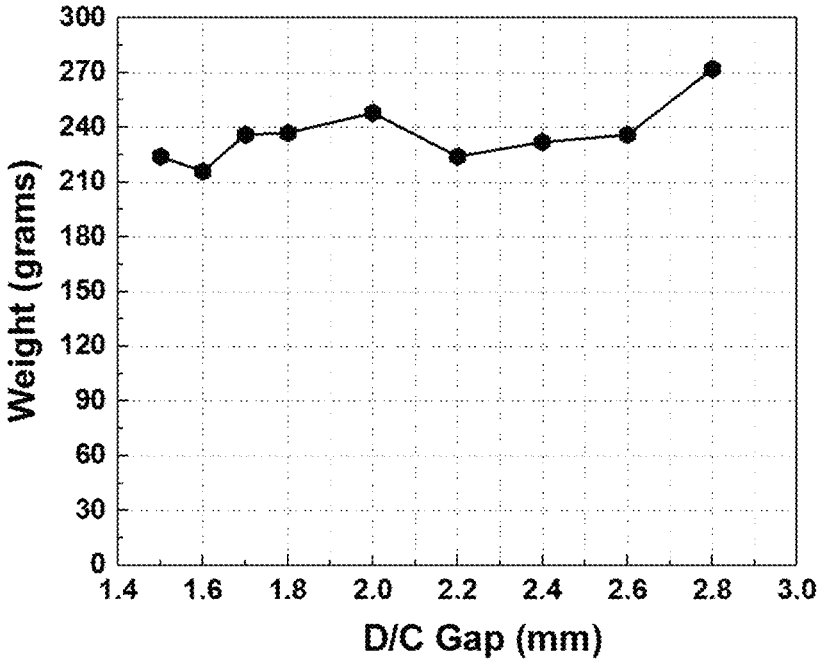

The spacer fabrics were produced on a circular knitting machine. The distance between two knitting beds is adjustable and determines the length of spacer yarn. The fabric thickness is the sum of thickness of surface layers (top and bottom) and length of spacer yarn. As shown in FIG. 23A, setting the D/C gap determines the fabric thickness. D/C gap is the machine gap of a circular knitting machine, the distance between two knitting beds. The D/C gap is normally lower than the thickness of final knitted product due to yarn relaxation and structure recovery after knitting. The D/C gap of 3-D weft knitted fabrics changes from 1.4 mm to 2.8 mm, and fabric thickness changes correspondingly from 2 mm to 3.3 mm. FIG. 23B shows the variabilities in the pore sizes of each fabric, which stay within a range between 110-150 μm. This because only the length of the "pile" or spacer yarn was changed. The knitting structures of the surface layers are the same. The weight of warp spacer fabric as shown in FIG. 23C increased only slightly with the change in length of the pile yarn, and therefore, the density is the same or lower. Therefore, increasing the thickness of the warp knit spacer fabric can be improve the bite-resistance without significantly increasing basis weight.

Figure 23D:
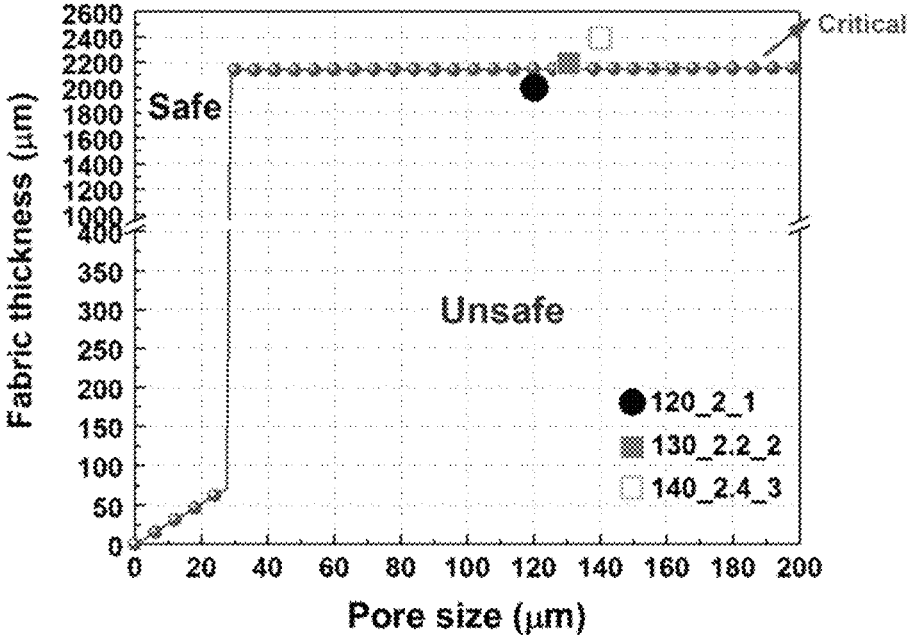

Three fabrics with thickness of 2.0 mm, 2.2 mm and 2.4 mm were selected as candidate fabrics for verification of the predictive model because their thicknesses fall within the range of pore sizes and thicknesses for Case 2 as shown in FIG. 23D.

3-D Spacer Fabrics With Different Structures

Figure 24A:
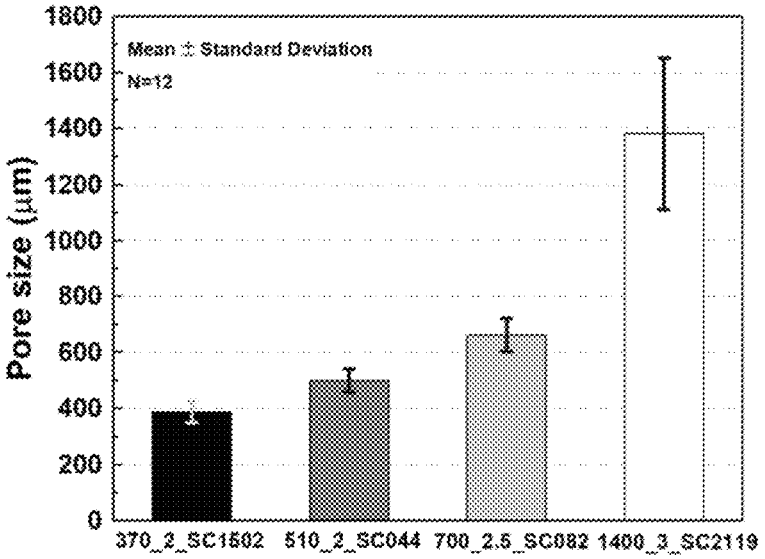
FIGS. 24A-24C are graphs of the pore size (FIG. 24A) and thickness (FIG. 24B) of 3-D space fabrics along with the location (FIG. 24C) on the graph of the safe thickness versus pore size for *Aedes aegypti*.
Figure 24B:
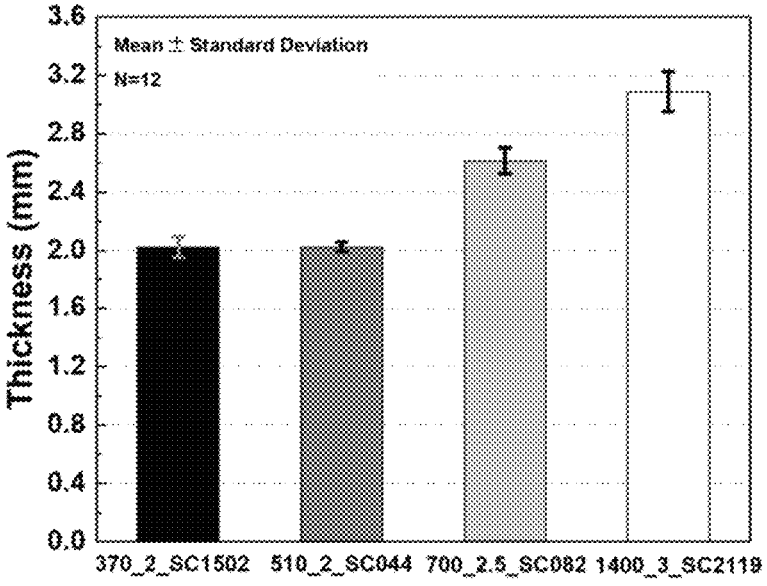
Figure 24C:
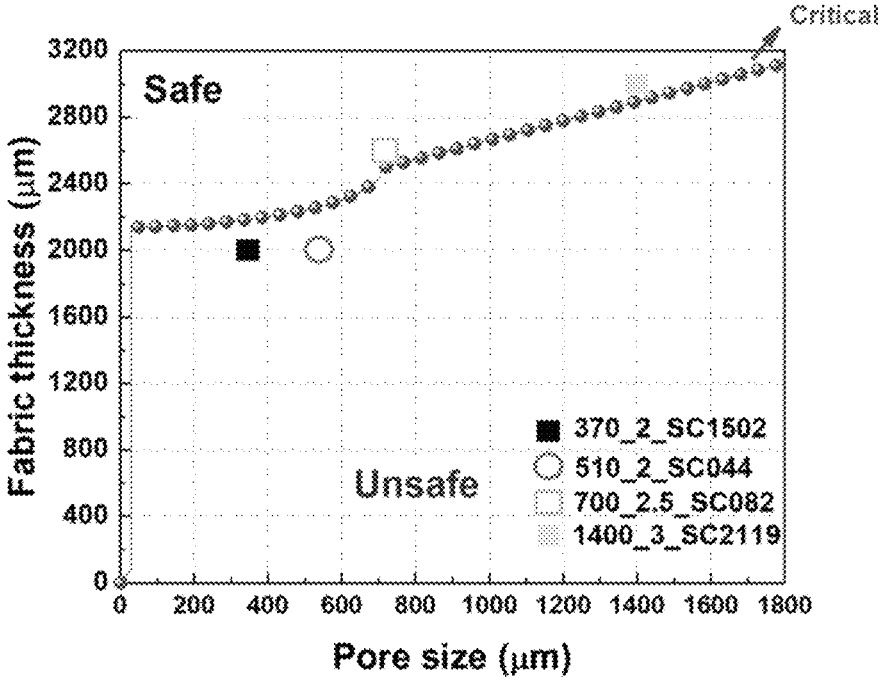

Four 3-D spacer fabrics with different structures were characterized to verify the predictive model for Case 2 and Case 3. FIGS. 24A-24C show the pore sizes, the thicknesses and locations within the predictive model of these four 3-D spacer fabrics.

Air Permeability (1) 3-D Spacer Fabrics With Different Thicknesses

Figure 25:
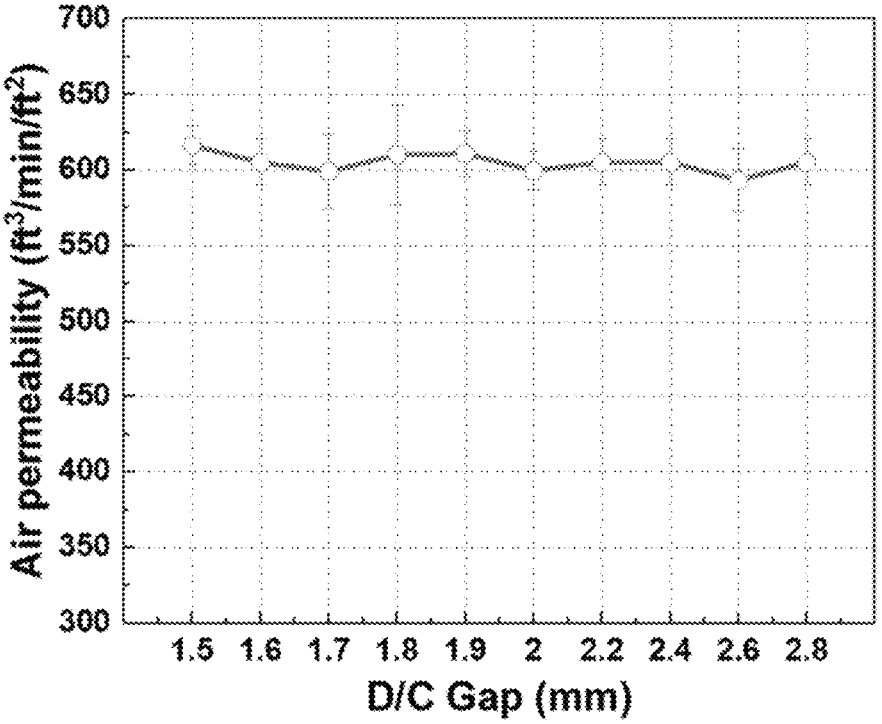
FIG. 25 is a graph of the air permeability of fabrics of 3-D spacer fabrics.

FIG. 25 shows the air permeability of 3-D spacer fabrics with different thicknesses. Air permeability is constant around 600 $ft^3/min/ft^2$ and is not related to thickness. This means the 3-D spacer fabrics with different thicknesses have high air permeability and even thicker fabrics may be thermally comfortable.

(2) 3-D Spacer Fabrics With Different Structures

Because these 3-D spacer fabrics have large pores, the air permeabilities exceeded the machine limit of 700 $ft^3/min/ft^2$.

Insect Bioassays (1) 3-D Spacer Fabrics With Different Thicknesses

Figure 26:
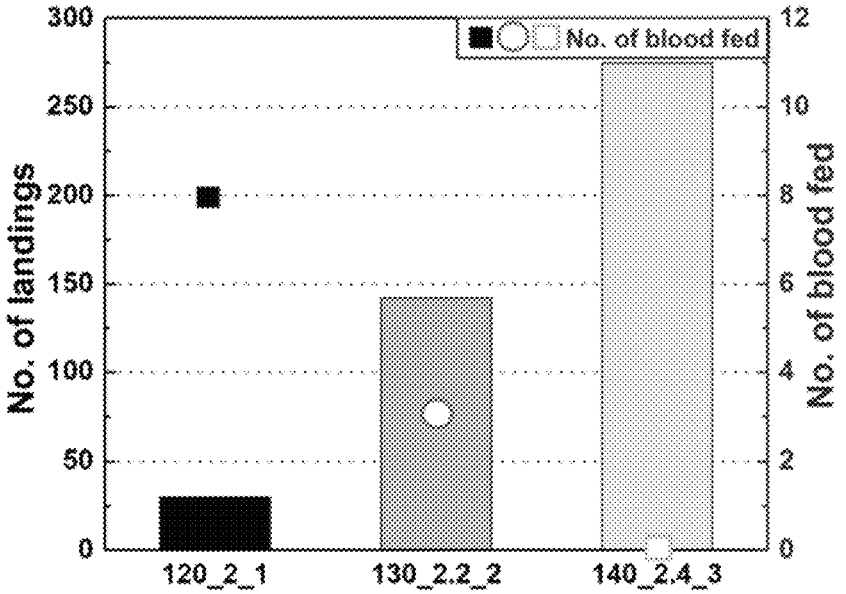
FIG. 26 is a graph of the results of insect bioassay of 3-D spacer fabrics with different thicknesses.

FIG. 26 shows that as the thicknesses of the fabrics increased, the number of blood fed mosquitoes decreased while the number of mosquito landings increased. Increasing the thickness of 3-D spacer fabrics prevented the mosquitoes from reaching the skin to take a blood meal, and the mosquitoes repeatedly probed the fabric, moving place to place in an attempt to locate an accessible channel. Blood-feeding was completely prevented when the thickness exceeded 2.2 mm. Increasing the thickness improved the bite-proof capacity of these 3-D spacer fabrics without diminishing air permeability.

(2) 3-D Spacer Fabrics With Different Structures

Figure 27:
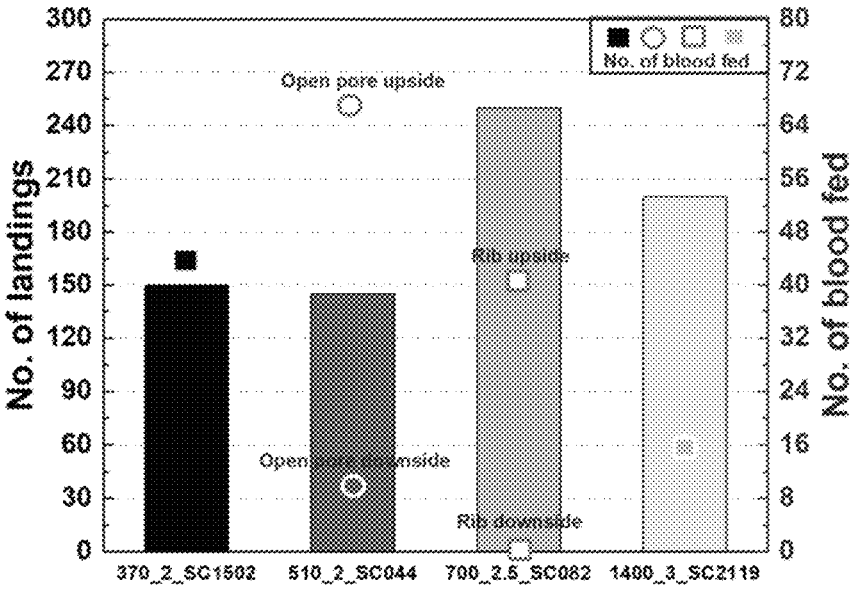
FIG. 27 is a graph of the results of insect bioassay of 3-D spacer fabrics with different structures.

FIG. 27 shows the results of insect bioassays of 3-D spacer fabrics with different structures. Fabrics 510_2_SA_PA_SC044 and 700_2.5_SA_PA_SC082 were each tested in different orientations (right-side up, upside-down) in the bioassay test because they have different bottom and top surfaces. The top surface of 510_2_SA_PA_SC044 is an open pore structure and bottom surface is a single jersey structure. The top surface of 700_2.5_SA_PA_SC082 is a rib structure and bottom surface is also single jersey structure. 370_2_SA_PA_SC1502 has a single jersey structure both on top and bottom surfaces and the middle layer is a honeycomb structure (pile or spacer yarn). Fabric 1400_3_SA_PA_SC2119 has an open pore structure both on top and bottom surfaces.

Fabric 370_2_SA_PA_SC1502 was too thin to provide bite resistance, and thus had a higher number of blood fed. This result verified the model's prediction.

Fabric 510_2_SA_PA_SC044 had an open pore structure on the top surface that allowed mosquitoes to land partially or completely within the pores. Hence, it failed to exclude mosquitoes. After turning the fabric upside down, the number of blood fed mosquitoes was reduced from 67 to 9 as shown in 27. The surface pattern for these spacer fabrics was a key factor in determining the bite-proof capacity.

Fabric 700_2.5_SA_PA_SC082 had a rib structure but a larger thickness as compared with 370_2_SA_PA_SC1502 and 510_2_SA_PA_SC044. The model predicts good bite-resistance as shown in FIG. 24C. When it is oriented with the ribs facing downward toward the skin, it is approximately 100% bite proof. In the opposite orientation (rib side up), it fails with 41 blood fed. The rib structure allows mosquitoes to land in the gaps between ribs where the pore size and thickness fall outside of those considered safe for Case 3. It appears that the shape of pore on the fabric surface is also a key factor that affects the bite-poof capacity.

Fabric 1400_3_SA_PA_SC2119 has an open pore structure and high thickness. The pore size is large enough to allow mosquitoes to land inside of the fabric structure. It failed with 15 blood fed as shown in FIG. 27. Compared with the other three fabrics with open pores or with rib side up, the number of blood fed mosquitoes is far smaller. For this fabric, it appears that the density and orientation of the pile or spacer yarns can affect the bite-proof capacity of 3-D spacer fabrics.

In brief, it can be concluded that there are three efficient ways to improve bite-proof capacity of knitted 3-D spacer fabrics:

1. Increasing the fabric thickness;
2. Designing a dense surface pattern;
3. Creating a dense net-like structure of spacer yarns.

Further development of 3-D spacer fabric will be focused on the varieties of combinations of thickness, surface pattern and structure of spacer yarns.

Figure 28A:
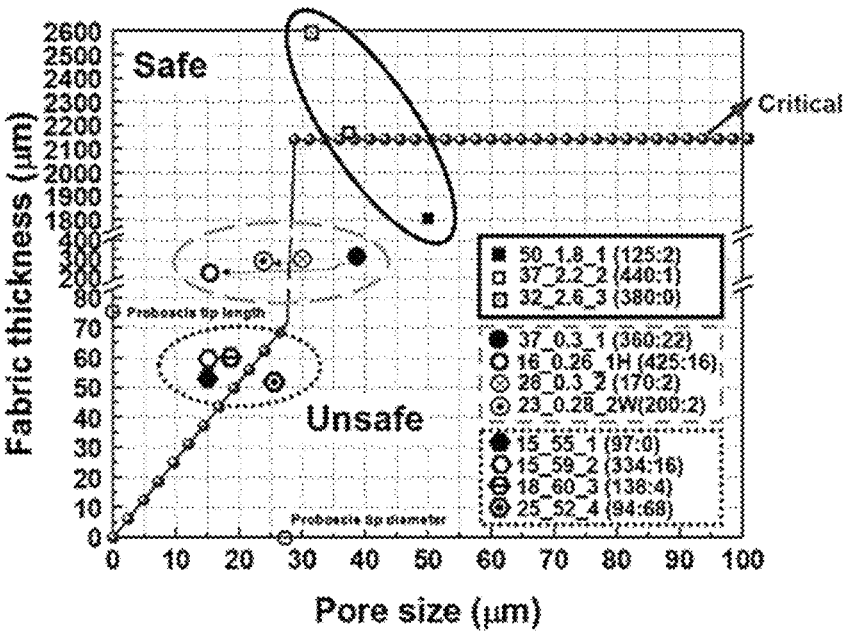
FIGS. 28A-28C are graphs of the validation of the entire range of effectiveness for physical barrier against mosquito biting for Case 1 (FIG. 28A); Case 2 (FIG. 28B); and Case 3 (FIG. 28C).
Figure 28B:
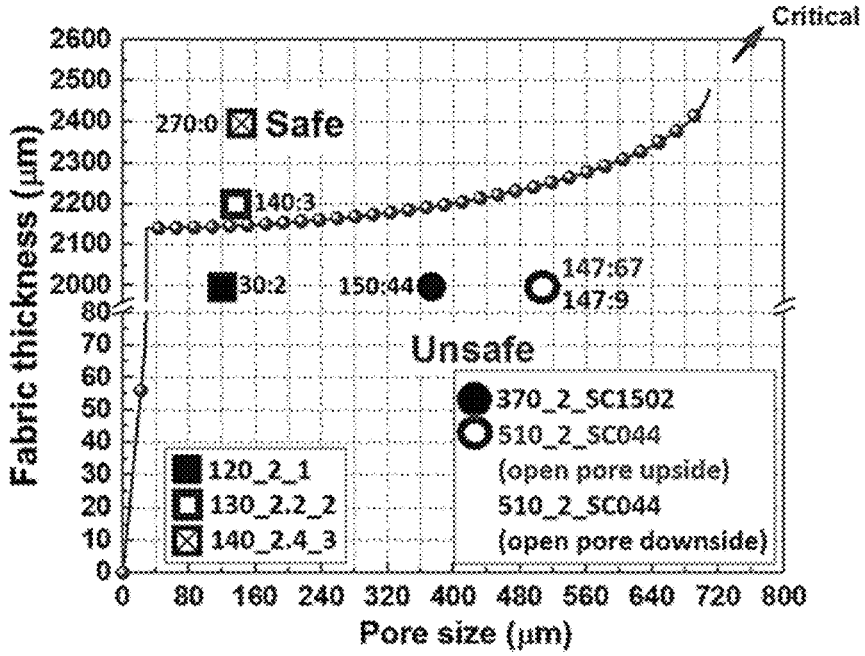
Figure 28C:
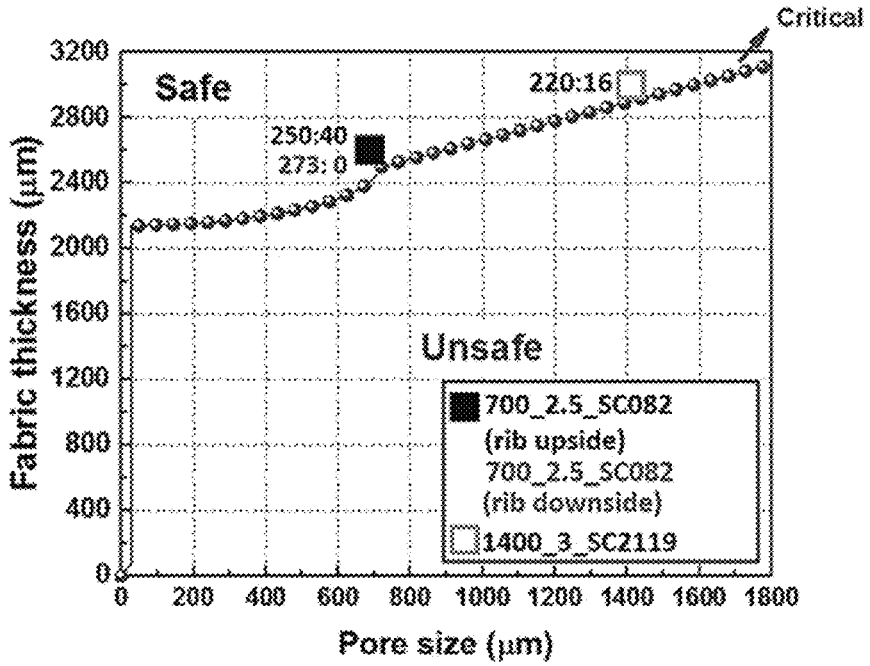

Validation of Entire Range of Effectiveness for Physical Barrier Against Mosquito Biting The bioassay results for different prototype fabrics, as shown in FIG. 18, FIGS. 22A-22C, FIG. 26 and FIG. 27, span the entire range of effectiveness for porous bite-resistant textiles. The comparisons between experimental bioassay data and the predicted bite-resistance according to our models for Case 1, Case 2 and Case 3 are shown in FIGS. 28A-28C.

For Case 1, some of Saatifil® polyester filtration fabrics with plain-woven structures were utilized to verify the smallest pore sizes and thicknesses for the Case 1 model because only those fabrics have proper combinations of thickness and pore size. The number of blood feedings is significantly reduced and bite proof capacity is improved by moving combinations into the safe area on the pore size vs. thickness graph. Some blood feedings did occur for woven fabrics that have pore sizes and thicknesses that fall within the safe area. This can be ascribed to the ability of the mosquito to exert small forces on the fabric which result in micro-scale deformations that increase the pore size or decrease the thickness. The extent of the deformation is determined by micromechanical properties of the mosquito proboscis, fiber properties, the interlock structure of the yarns and the fiber distribution. A numerical model based on geometrical parameters of fabrics with a combination of small pore size and thickness has been developed to reveal the mechanism of penetration or resistance thereof, and to inform fabric design so as to counter deformation induced by mosquito landings. This would help to design new prototyping fabric at small-scale level.

For Case 2 and Case 3, weft spacer fabrics and 3-D spacer fabrics with different combinations of thicknesses and pore sizes have verified that this model can effectively predict the bite-proof capacity of fabrics.

Development of a Predictive Model

The predicted bite-proof capacity for the Case I superfine woven fabrics is not completely accurate because mosquitoes are able to deform the fabrics while attempting to penetrate. A finite element model was developed to allow elucidation of the mechanism of micromechanical deformation of superfine knit during attempted penetration by the proboscis. This model can be used to design new bite-proof fabric structures or to modify existing fabric structures.

Figure 29:
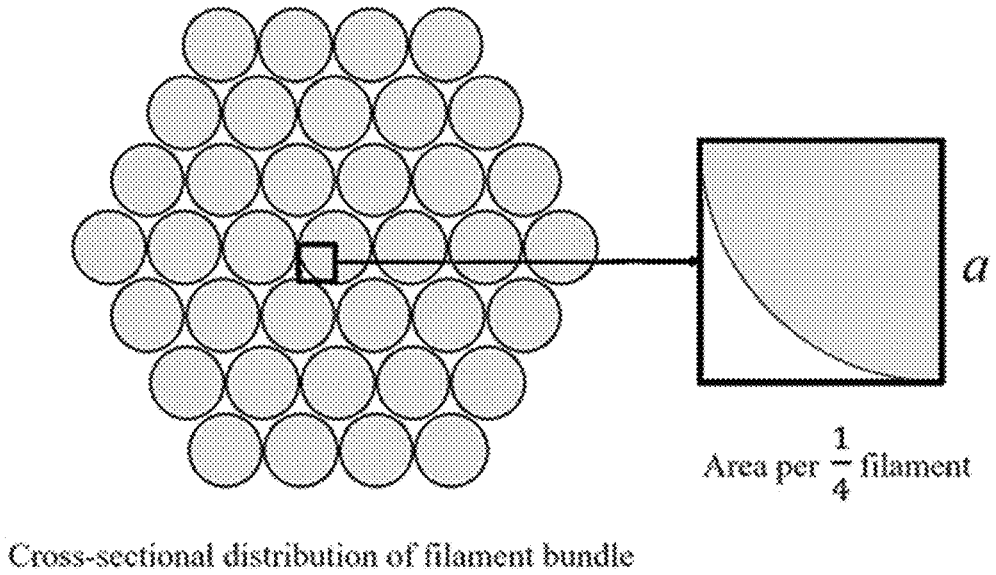
FIG. 29 is a diagram of the cross-sectional distribution of an exemplary filament yarn.

Prior to development of the finite element numerical model for prediction of the bite-proof capacity of Case 1 superfine knit fabrics, a geometrical model was established to investigate the relationship between pore size and manufacturing parameters (yarn count and stitch density). As shown in FIG. 29, assuming the cross-sectional area of filament is circular in shape and the stack of filaments is in contact with surrounding yarns, the area rate of gap (κ) of one quarter of filament is:

$$\kappa = 1 - \frac{\frac{1}{4}\pi a^2}{a^2} - 21.46\% \tag{1}$$

where α is radius of filament.

Then, the area (A) occupied by one filament is:

$$A = \frac{\pi a^2}{1+\kappa} \tag{2}$$

The material density of polymer (ρ) is:

$$\rho = \frac{m}{V} = \frac{m}{n \times A \times l} \tag{3}$$

where m is mass, n is number of filaments, V is volume and l is length of filament.

Yarn count (x) can be calculated as follows:

$$x = \frac{m}{900000 \times l} \tag{4}$$

From equation (3) and equation (4):

$$x = \frac{\rho n A}{900000} \text{ [g/900000 cm]} \tag{5}$$

From equation (2) and (5):

$$r = \sqrt{\frac{900000 \times (1+\kappa)x}{\pi \times \rho \times n}} \text{ [cm]} \tag{6}$$

Figure 30:
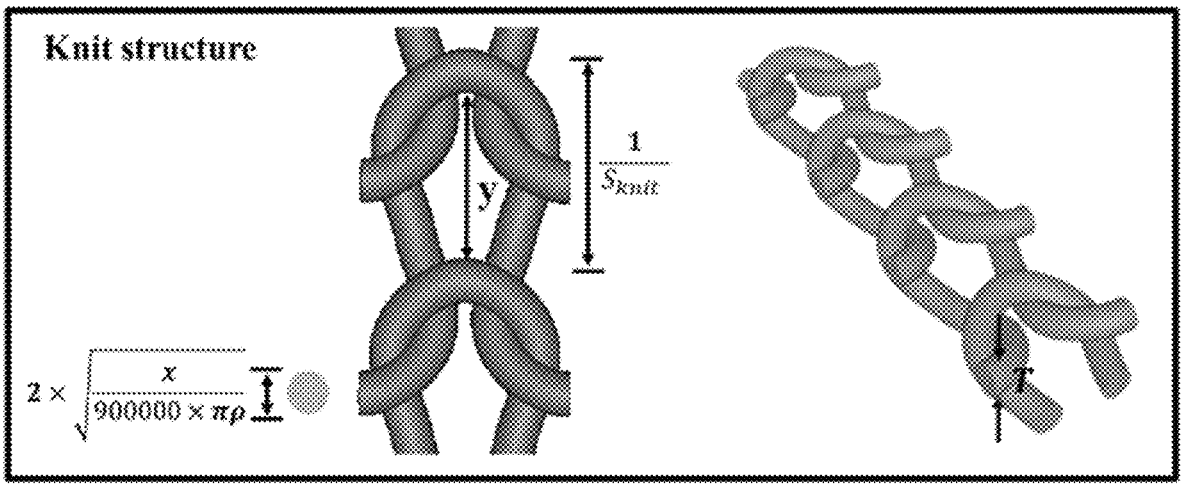
FIG. 30 is a diagram of the geometrical structure of an exemplary single jersey knit.

Therefore, the maximum pore size of single jersey fabric as shown in FIG. 30 is:

$$y = \frac{1}{S_{knit}} - 2\sqrt{\frac{900000 \times (1+\kappa)x}{\pi \times \rho \times n}} \text{ [cm]} \tag{7}$$

where $S_{knit}$ is the stitch density of single jersey knit along longest direction and the unit is /cm (number per centimeter), x is yarn count and unit is g/900000 cm, ρ is polymer density and unit is g/cm$^3$.

Figure 31:
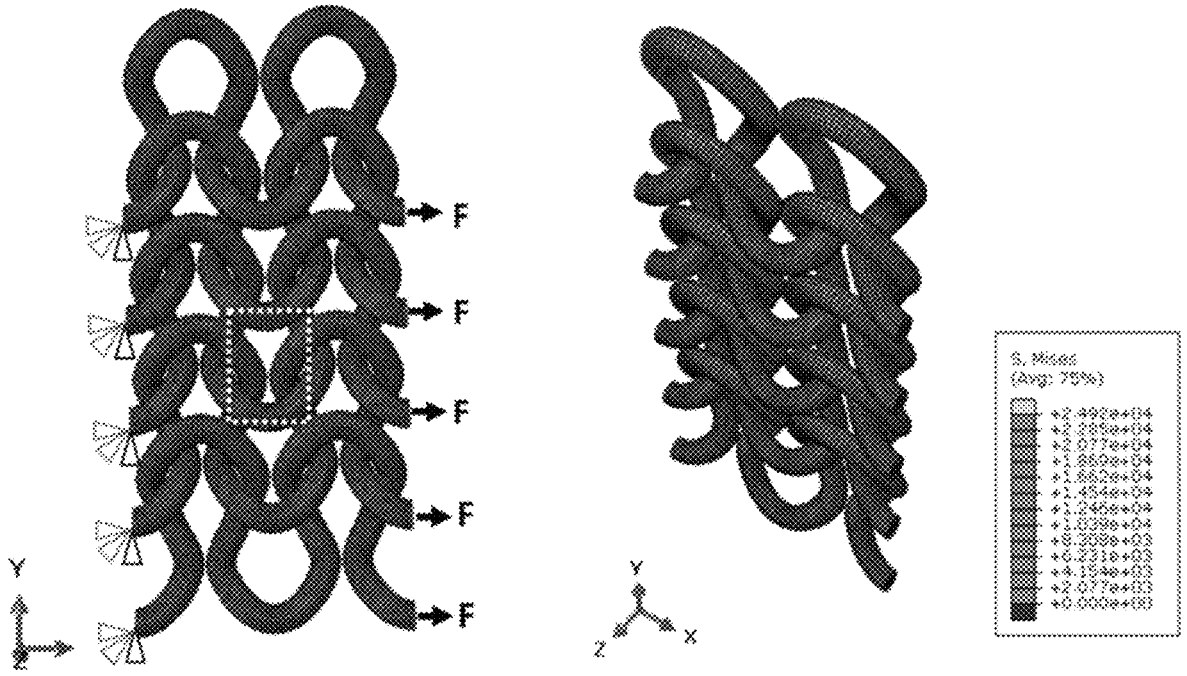
FIG. 31 is an image of the numerical micromechanical model of the exemplary single jersey knit of FIG. 30.

Based on equation (7), a numerical model was established as shown in FIG. 31. A series of virtual mechanical tests under quasi-static loadings including tensile and shear and experimental data from KES testing were conducted in order to verify the model's accuracy.

Figure 32:
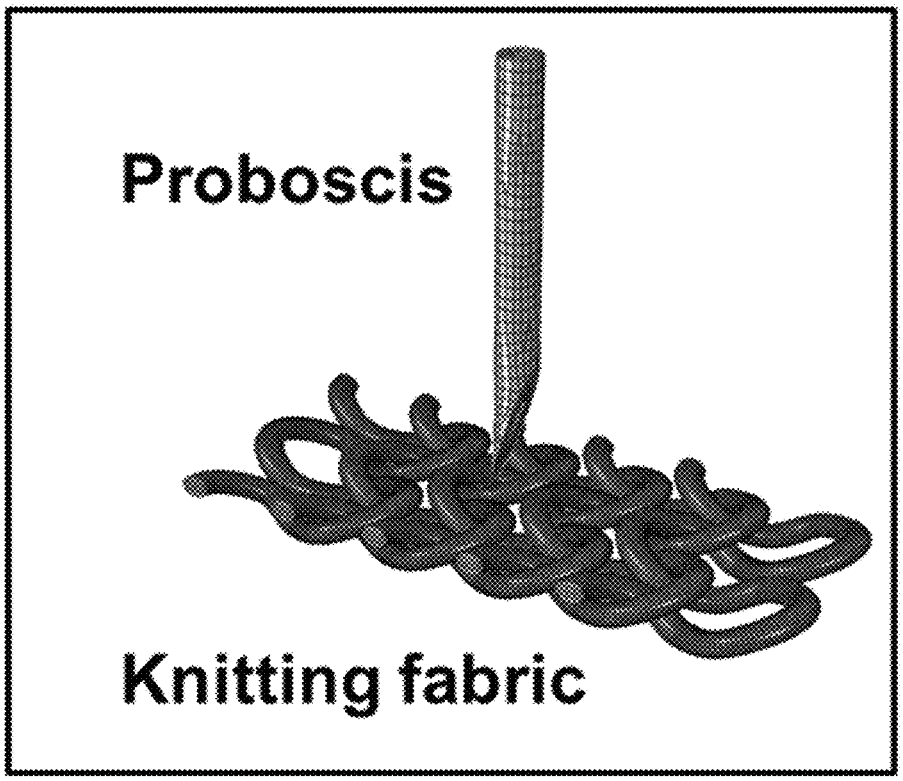
FIG. 32 is a diagram of a micromechanical model of the exemplary single jersey knit of FIG. 30 under penetration of mosquito proboscis.

Then, a geometrical model of a mosquito proboscis was introduced into this model to conduct dynamic analysis of knit structures under penetration as shown in FIG. 32.

Recent changes have been made to the model to incorporate the deformation and stress distribution of knit structure. This theoretical approach reveals the bite-resist mechanisms of knit structures for bite resistance. The model also has the potential to be extended to a variety of other newly designed bite-proof textiles.

Example 2

Liners for Mosquito Bite-Proof Garments

Three combinations of fabrics with liners have been investigated. The first is a double layering of ultra-thin knits A and B. The second is layered ultra-thin knits bonded together with an adhesive (combinations C, D, E, F and G). The third is a combination of a military shirt (H) with a nonwoven fabric liner (I). The knits A-B are produced by a commercial manufacturer according to specifications provided, using blended PA/PU yarns (see the following description of detailed fabric samples). C-G are commercially available. The military T-shirt fabric (Cotton jersey) is currently used in an army T-shirt. The nonwoven fabric liner (I) is commercially available and made from polyester and hot-melt dot adhesive. It was heated and adhered to the military T-shirt fabric (H) using a regular iron with temperature ranging from 120 to 170° C.

Figure 48:
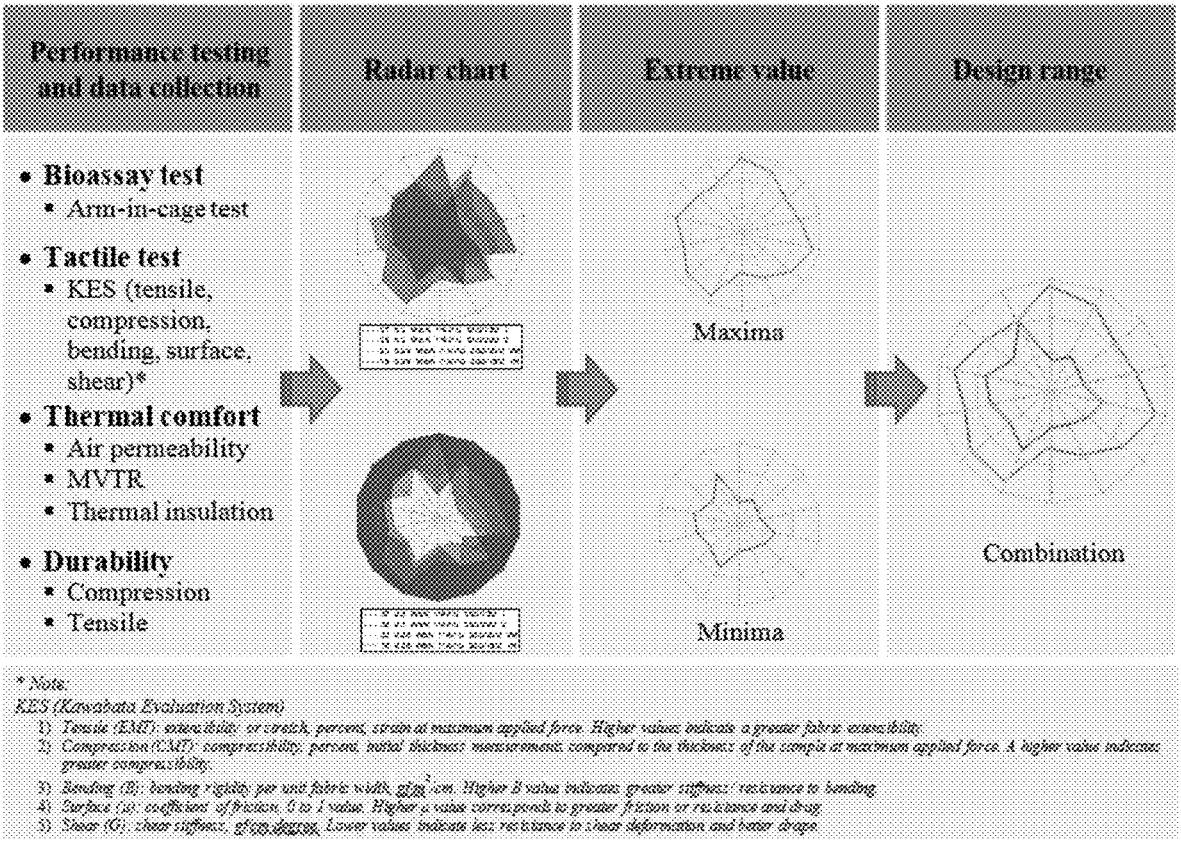
FIG. 48 shows the determination of performance criteria for liner fabric structures.

FIG. 48 shows the procedure by which minimum and maximum performance criteria for the liner fabric structures have been determined. Bioassay tests, tactile evaluation, thermal property tests, and durability tests were conducted on the candidate bite-proof fabrics. All the related parameters were included into a radar chart as shown in FIG. 48. The area in radar chart represents the comprehensive performance of the fabric, including bite-resistance, tactile properties, thermal management and durability. By superimposing the charts for all fabrics, the maxima and minima of each property emerge. These points are connected as shown and form a continuous loop. The area between these loops is the performance range for the liner fabrics.

Detailed fabric samples include (1) Combination I (Layered, not Bonded): Fabric A (20 Denier/20 Denier) PA/PU, Fabric B(20 D/15 D), Lined Fabric A+A, Lined Fabric B+B;

(2) Combination II: Lined Fabrics C (A+A with adhesive), D (B+B with adhesive), E (A+B with adhesive), F (B+B with adhesive and brushed bottom surface), G (A+B with more amount of adhesive than C, D, E and F); For combination II, a commercial fabric laminating machine with polyurethane (PU) glue was used to glue nylon-based knits together.

(3) Combination III (Thermally Bonded): Lined Fabric J (Military T-shirt fabric H+Fabric I (nonwoven)), Lined Fabric K (Military T-shirt fabric H+2×Fabric I (nonwoven)).

The first and second combinations take advantage of new technology that permits very fine gauge knits with very low pore sizes and thicknesses. While these fabrics perform very well as a single layer, the bite-proof capacity is significantly improved when two single fabrics are layered one on top of another. The second combination uses adhesives to bond the out layer to the liner. The third combination uses thermal bonding of a nonwoven lining to significantly improve bite-resistance.

The comfort and bite resistance of the lined fabrics were characterized. Measurements of thickness, pore size, air permeability were performed.

Arm-in-cage studies were used for evaluating fabric bite-proof capacity. One-hundred adult *Aedes aegypti* females between 5 to 10 days post emergence were aspirated from colonies maintained in an insectary and transferred to a bioassay cage. Females were starved before they were tested (overnight for *Aedes aegypti*). The test cage volume is 40 cm×40 cm×40 cm and length×width of plastic frame is 14.5 cm×3.4 cm. The temperature was 27-29° C. and the humidity was 75-80%.

Combination I

The first lined fabric combined ultra-thin knits single jersey structure knits of blended yarn of Polyamide (PA) and polyurethane (PU). Knit A is 20 D PA/20 D PU, and Knit B is 20 D PA/15 D PU.

Figure 33:
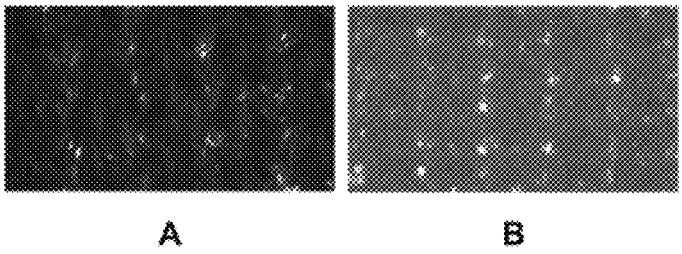
FIG. 33 is an image showing pore distribution on single knit fabrics A and B.
Figure 34:
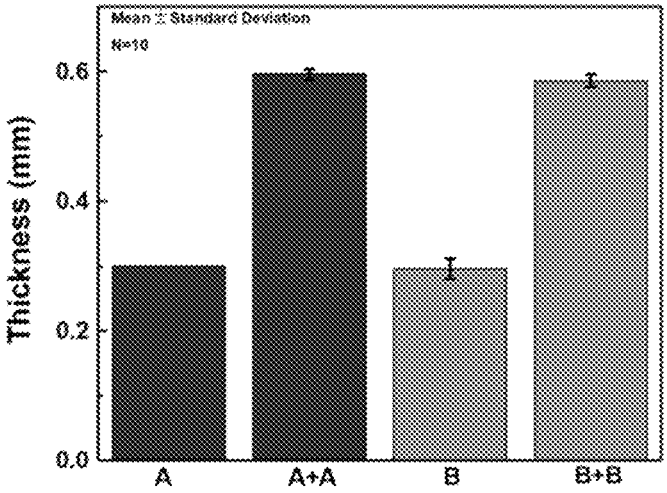
FIG. 34 is a graph showing the thickness of fabric A, Lined Fabric A+A, B and Lined Fabric B+B.
Figure 35:
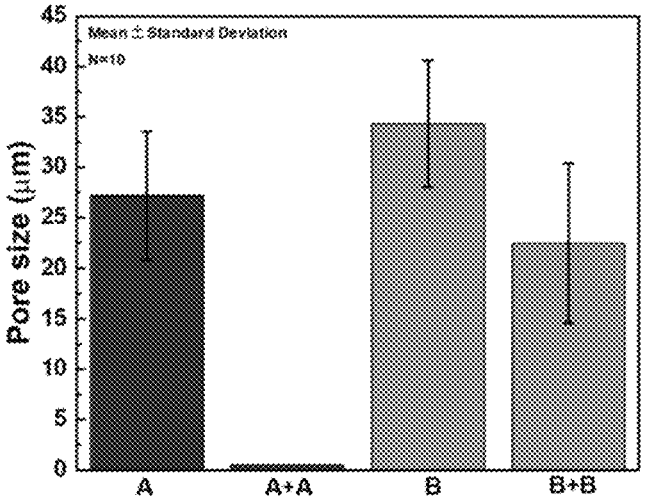
FIG. 35 is a graph showing the pore size of fabric A, Lined Fabric A+A, B and Lined Fabric B+B.
Figure 36:
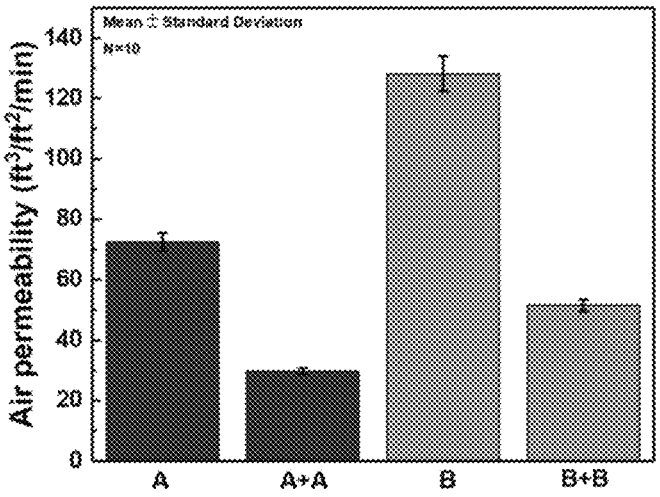
FIG. 36 is a graph showing the air permeability of fabric A, Lined Fabric A+A, B and Lined Fabric B+B.

FIG. 33 is a photomicrograph showing pores as bright spots for Knits A and B. As shown in FIG. 34, fabrics A and B have same thickness of approx. 0.3 mm. The Lined Fabric A (A+A) and Lined Fabric B (B+B) are approx. 0.6 mm thick. Their apparent pore sizes are shown in FIG. 35. Lining Fabrics A and B reduced their average pore diameters from 28 μm to 0 μm and from 37 μm to 23 μm, respectively, and were predicted to exclude the proboscis. The air permeabilities for the single layer knits A and B were reduced from 70 $ft^3/ft^2$/min to 30 $ft^3/ft^2$/min, and 130 $ft^3/ft^2$/min to 50 $ft^3/ft^2$/min when combined as an outer fabric plus a liner (FIG. 36).

Figure 37:
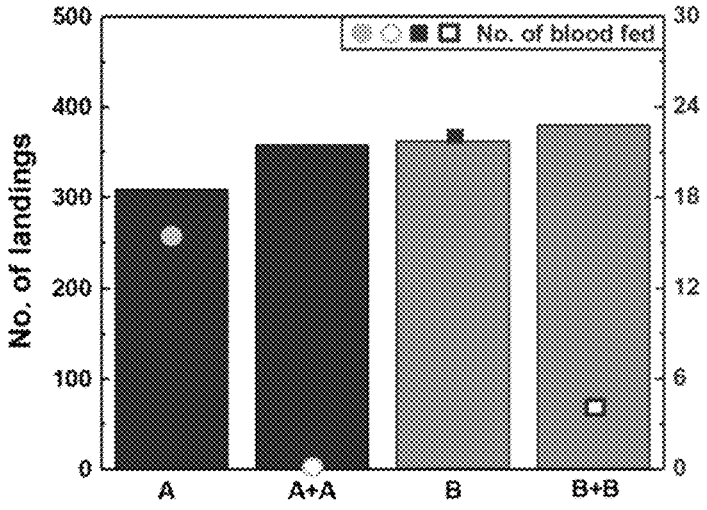
FIG. 37 is a graph showing the bioassay test result of A, Lined Fabric A+A, B and Lined Fabric B+B.

FIG. 37 shows the bioassay test results for single knits A and B, and Lined Fabrics A+A and B+B. The number of blood fed for A+A and B+B are significantly reduced compared with single layer A and single layer B. The percentages of bite resistance are 100% and 96%, respectively.

Combination II

Although the layered knits have good bite-resistance, the outer and inner fabrics are free to move relative to one another, and dimensional stability is a challenge. Adhesive was used to attach adjacent layers and to improve dimensional stability.

In this combination, the Lined Fabrics include C(A+A with adhesive), D(B+B with adhesive), E(A+B with adhesive), F(B+B with adhesive and brushed bottom surface), G(A+B with more amount of adhesive than C, D, E and F). The amount of adhesive controls the percentage of adhesive covered fabric surface area. The coverage of C, D, E, F is 5%, while the coverage of G is 40%.

Figure 38:
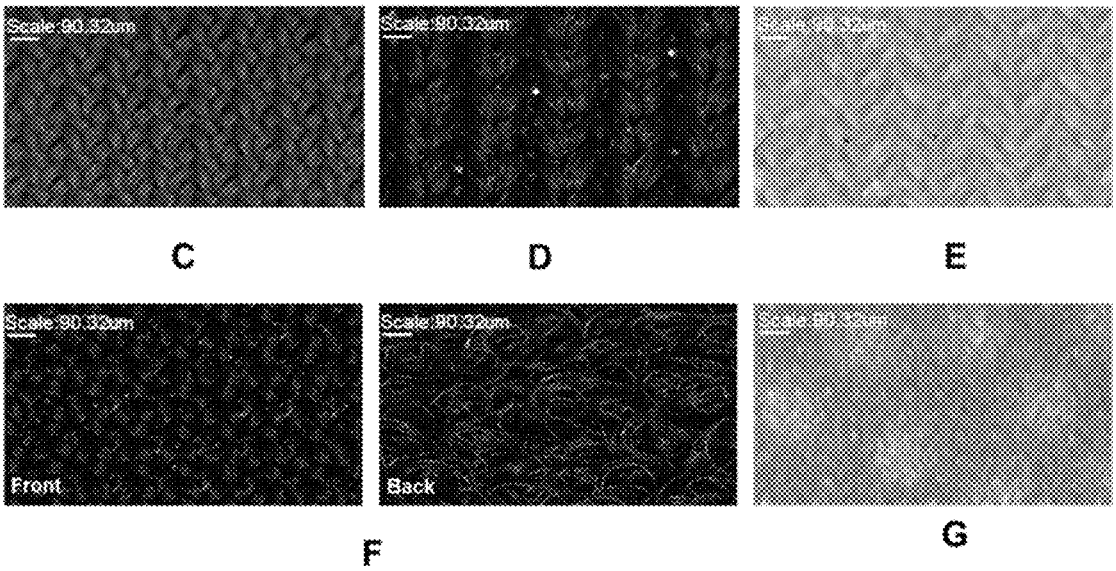
FIG. 38 provides images of pore distribution on Lined Fabrics C, D, E, F (front and back) and G.
Figure 39:
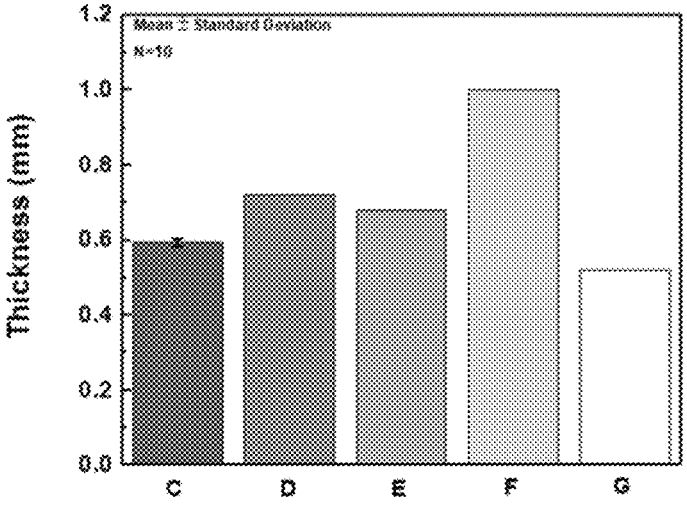
FIG. 39 is a graph showing thicknesses of Lined Fabrics C, D, E, F and G.
Figure 40:
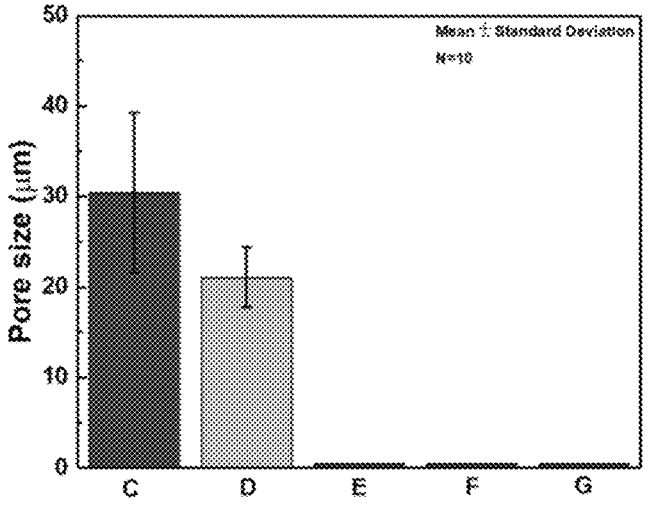
FIG. 40 is a graph showing Pore sizes of Lined Fabrics C, D, E, F and G.
Figure 41:
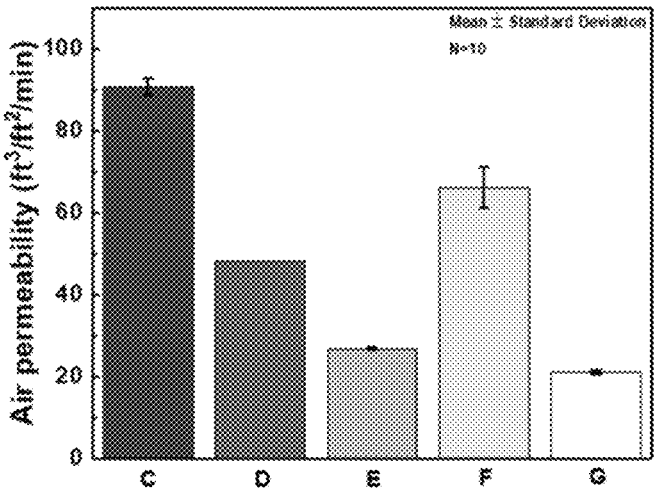
FIG. 41 is a graph showing air permeabilities of Lined Fabrics C, D, E, F and G.

FIG. 38 shows photomicrographs of Lined Fabrics C, D, E, F and G. There are almost no visible pores on Lined Fabrics E, F and G. In FIG. 39, thicknesses of Lined Fabrics C, D and E are double that of single knit fabrics A or B. The thickness of Lined Fabric F is higher than Lined Fabric B+B because the bottom surface was brushed with five rollers with pinned bars at speed of 500rpm. The larger amount of adhesive caused Lined Fabric G to have a smaller thickness than that of Lined Fabric E. The pore sizes of Lined Fabrics D, E, F and G in FIG. 40 are small enough to exclude the mosquito proboscis. FIG. 41 shows air permeability results for Lined Fabrics C, D, E, F and G.

Figure 42:
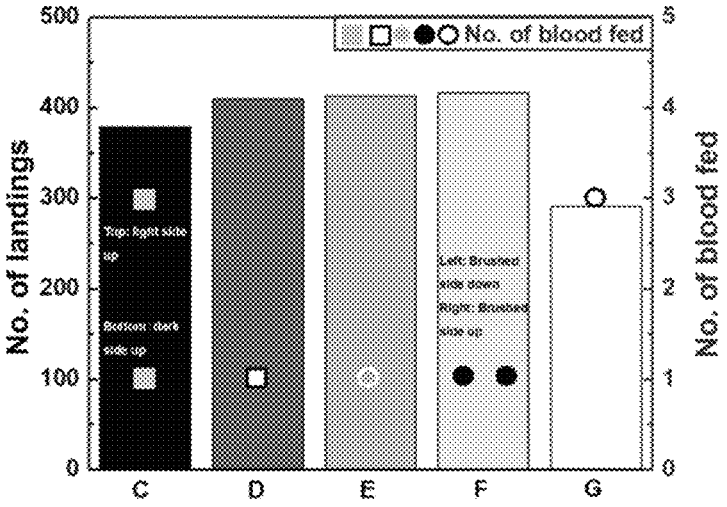
FIG. 42 is a graph showing bioassay test results for Lined Fabrics C (changing upward side), D, E, F (changing upward side) and G.

Bioassay test results are shown in FIG. 42. The blood feedings for Lined Fabrics C, D, E, F and G are as low as 1 bite, and the bite resistance is higher than 95%.

Combination III

Figure 43:
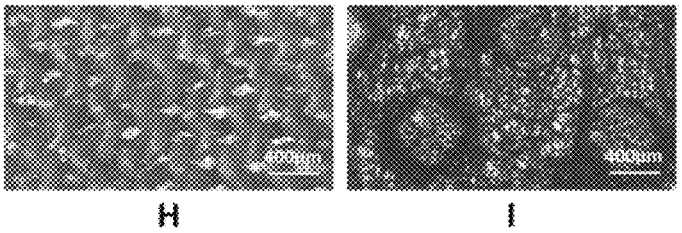
FIG. 43 are images showing the Pore distribution of military shirt fabric (H) and nonwoven lining (I).
Figure 44:
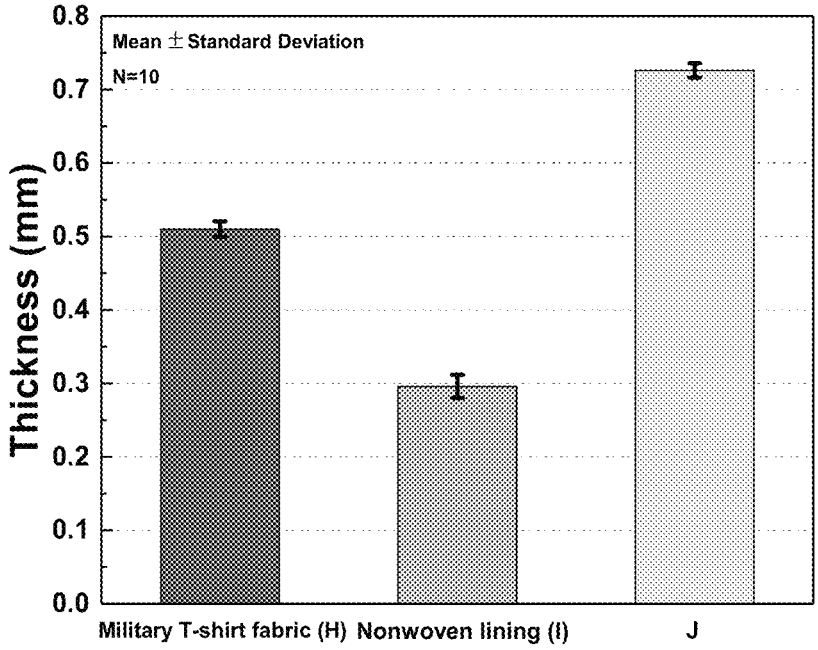
FIG. 44 is a graph showing the thickness of H, I, and J.
Figure 45:
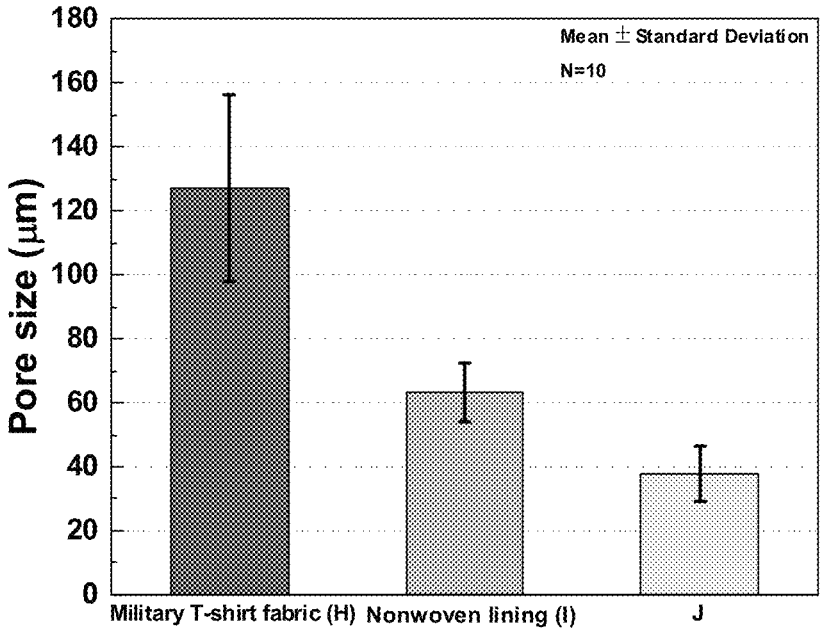
FIG. 45 is a graph showing the pore sizes of Fabric H, Fabric I, and Lined Fabric J.
Figure 46:
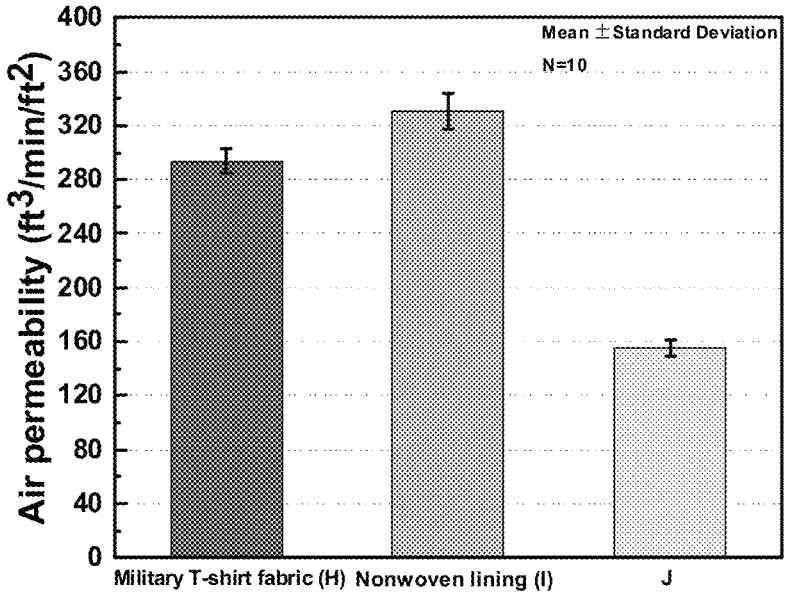
FIG. 46 is a graph showing the air permeability of Fabrics H, I and Lined Fabric J.

The military T-shirt fabric H in FIG. 43 is a single jersey structure knit with cotton yarns. The thickness is 0.5 mm and average pore size is higher than 120 μm as shown in FIGS. 44 and 45. The combination of thickness and pore size result in air permeability higher than 280 $ft^3/ft^2$/min, as shown in FIG. 46, but has poor bite-resistance.

A commercially available nonwoven lining (Fabric I, polyester fiber) was selected as a model liner. It has a thickness is 0.3 mm and pore size of approx. 60 μm. The air permeability for the nonwoven liner Fabric I was found to be 320 $ft^3/ft^2$/min, even higher than military T-shirt Fabric H. Lined Fabric J was made by applying heat to the nonwoven to adhere it to the military T-shirt fabric at a temperature of approximately 130 ° C. The air permeability for Lined Fabric J is sharply reduced to around 160 $ft^3/ft^2$/min as shown in FIG. 46.

Figure 47:
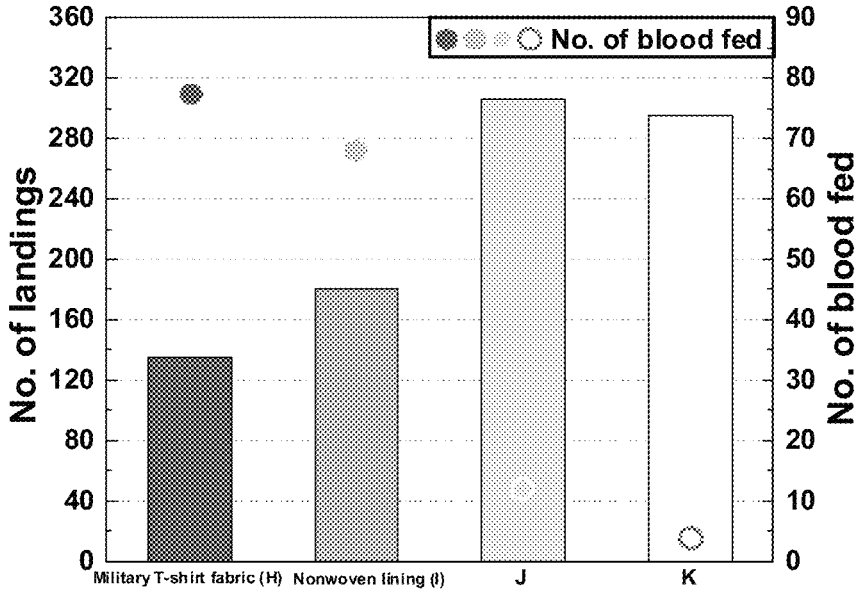
FIG. 47 is a graph showing the bioassay test result of Fabrics H, I, and Lined Fabrics J and K.

FIG. 47 shows the results of arm-in-cage of the military T-shirt fabric, nonwoven lining and Lined Fabric J. The bite-proof capacity of military shirt fabric was improved with nonwoven lining. Addition of two layers of nonwoven linings (K) increased the bite resistance to 96% as shown in FIG. 47.

The selection of three combinations for making bite-proof garment will be determined by requirements of different conditions. Combination I has good comfort but has low resistance to shear that will decrease bite-proof capacity because of structural instability. It is suitable for an area that has less shear. Combination II has adhesive between layers and owns better bite-proof capacity but relatively lower air permeability compared with combination I. It can be used in areas that need higher durability and less comfort. Combination III provides an efficient and economical method for developing and improving the bite-proof capacity of currently used military T-shirt. Fabrics in combination III have less durability and cannot be applied on garments used in severe military service conditions.

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

We claim:

1. A textile having a plurality of microscopic pores, wherein the pores have a pore size of about 18 μm or less, and wherein one or more of the following provides at least 95%, mosquito bite resistance: a thickness of the textile, a pore tortuosity, a pore shape, a number of structures external or internal to the pores that prevent bending of a mouth part sheath of a mosquito, or a presence of fine structures on the external or internal of the pores that hit an antenna or other sensor organ of a mosquito when on a surface of the textile.

2. The textile of claim 1, wherein the textile has a single fabric layer.

3. The textile of claim 1, wherein the textile has two or more fabric layers.

4. The textile of claim 1, wherein the textile is woven, weft knit, warp knit, nonwoven, or a combination thereof.

5. The textile of claim 1, wherein the textile is made from a fine yarn between 15D to 50D, and wherein the pores have a pore size of about 17 μm or less.

6. The textile of claim 5, wherein the yarn is elastomeric.

7. The textile of claim 1, wherein the textile has an open area that is about 14% to 16% .

8. The textile of claim 1, wherein the textile has bite resistance of about 99.9% or more when measured according to one or both of the in vivo feeding bioassay or the arm-in-cage test.

9. The textile of claim 1, wherein the pore size is 16 μm or less.

10. The textile of claim 1, wherein the textile is a nylon/cotton blend.

11. The textile of claim 1, wherein the textile is a flame-resistant blend of rayon, para-aramid, and nylon.

12. The textile of claim 1, wherein the textile is made from a fine yarn between 15 D to 50 D, and wherein the pores have a pore size of about 15 μm or less.

13. The textile of claim 1, wherein the pores have a pore size of 18 μm or less, wherein two or more of the following-provides at least 95% mosquito bite resistance:

a thickness of the textile, a pore tortuosity, a pore shape, a number of structures external or internal to the pores that prevent bending of a mouth part sheath of a mosquito, or a presence of fine structures on the external or internal of the pores that hit an antenna or other sensor organ of a mosquito when on a surface of the textile.

14. The textile of claim 1, wherein the pores have a pore size of 17 μm or less, wherein three or more of the following-provides at least 95% mosquito bite resistance: a thickness of the textile, a minimum pore size, a pore tortuosity, a pore shape, a number of structures external or internal to the pores that prevent bending of a mouth part sheath of a mosquito, or a presence of fine structures on the external or internal of the pores that hit an antenna or other sensor organ of a mosquito when on a surface of the textile.

15. The textile of claim 1, wherein the following-provides at least 95% mosquito bite resistance: a thickness of the textile, a pore tortuosity, a pore shape, a number of structures external or internal to the pores that prevent bending of a mouth part sheath of a mosquito, and a presence of fine structures on the external or internal of the pores that hit an antenna or other sensor organ of a mosquito when on a surface of the textile.

16. The textile of claim 1, wherein the textile has two or more fabric layers, wherein the pores have a pore size of about 15 μm or less, wherein the following provides at least 99% mosquito bite resistance when measured according to one or both of the in vivo feeding bioassay or the arm-in-cage test: a thickness of the textile, a pore tortuosity, a pore shape, a number of structures external or internal to the pores that prevent bending of a mouth part sheath of a mosquito, and a presence of fine structures on the external or internal of the pores that hit an antenna or other sensor organ of a mosquito when on a surface of the textile.

17. The textile of claim 16, wherein the textile is woven.

18. The textile of claim 16, wherein the textile is nonwoven.

* * * * *